US010881917B2

(12) United States Patent
Greensmith et al.

(10) Patent No.: US 10,881,917 B2
(45) **Date of Patent: *Jan. 5, 2021**

(54) GOLF CLUB HEADS

(71) Applicant: Taylor Made Golf Company, Inc., Carlsbad, CA (US)

(72) Inventors: Matthew Greensmith, Vista, CA (US); Matthew David Johnson, San Diego, CA (US); Bing-Ling Chao, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/582,632

(22) Filed: Sep. 25, 2019

(65) Prior Publication Data

US 2020/0038721 A1 Feb. 6, 2020

Related U.S. Application Data

(63) Continuation of application No. 16/161,337, filed on Oct. 16, 2018, which is a continuation-in-part of application No. 16/059,801, filed on Aug. 9, 2018.
(Continued)

(51) Int. Cl.
*A63B 53/04* (2015.01)
*A63B 53/06* (2015.01)
(Continued)

(52) U.S. Cl.
CPC ..... *A63B 53/0466* (2013.01); *A63B 53/06* (2013.01); *A63B 60/04* (2015.10); *B22C 7/02* (2013.01); *B22C 9/04* (2013.01); *B22D 13/04* (2013.01); *B22D 25/02* (2013.01); *C22C 14/00* (2013.01); *A63B 53/0408* (2020.08); *A63B 53/0412* (2020.08); *A63B 53/0416* (2020.08);
(Continued)

(58) Field of Classification Search
CPC ..... A63B 53/04; A63B 2053/0458; A63B 2053/0408
USPC ..... 473/324, 329, 345, 348, 349
See application file for complete search history.

(56) References Cited

U.S. PATENT DOCUMENTS 727,819 A 5/1903 Mattern
1,337,958 A 4/1920 Reach
(Continued)

FOREIGN PATENT DOCUMENTS

JP 2002165903 6/2002
JP 2002172187 6/2002
(Continued)

*Primary Examiner* — John E Simms, Jr.
(74) *Attorney, Agent, or Firm* — Klarquist Sparkman, LLP

(57) ABSTRACT

A cast cup can include a forward portion of a golf club head, including a hosel, a face portion, and forward portions of a crown, sole, heel and toe. A rear ring can be formed separately from the cast cup and coupled to heel and toe portions of the cast cup to form a metallic club head body, such that the club head body defines a hollow interior region, a crown opening, and a sole opening. The cast cup and rear ring can be cast of titanium alloys. Composite crown and sole inserts can then be coupled to the crown opening and sole opening. The face portion of the cast cup can have a desirably complex geometry. The rear surface of the face portion of the cast cup can be modified before the rear ring is attached.

18 Claims, 30 Drawing Sheets

Related U.S. Application Data

(60) Provisional application No. 62/543,778, filed on Aug. 10, 2017.

(51) Int. Cl.

| | |
|---|---|
| ***B22D 25/02*** | (2006.01) |
| ***B22C 7/02*** | (2006.01) |
| ***C22C 14/00*** | (2006.01) |
| ***A63B 60/04*** | (2015.01) |
| ***B22C 9/04*** | (2006.01) |
| ***B22D 13/04*** | (2006.01) |
| *A63B 102/32* | (2015.01) |
| *A63B 60/52* | (2015.01) |

(52) U.S. Cl.

CPC ..... *A63B 53/0433* (2020.08); *A63B 53/0437* (2020.08); *A63B 53/0454* (2020.08); *A63B 53/0458* (2020.08); *A63B 53/0462* (2020.08); *A63B 60/52* (2015.10); *A63B 2053/0491* (2013.01); *A63B 2102/32* (2015.10); *A63B 2209/00* (2013.01)

(56) References Cited

U.S. PATENT DOCUMENTS 1,396,470 A 2/1921 Taylor
1,509,429 A 1/1924 Hillerich
1,526,438 A 2/1925 Scott
1,965,954 A 4/1930 Davis
2,005,401 A 6/1935 Storz
2,460,435 A 2/1949 Schaffer
3,637,218 A 1/1972 Carlino
3,941,390 A 3/1976 Hussey
4,753,440 A 6/1988 Chorne
4,811,950 A 3/1989 Kobayashi
5,193,811 A 3/1993 Okumoto et al.
5,219,408 A 6/1993 Sun
5,282,624 A 2/1994 Viste
5,344,140 A 9/1994 Anderson
5,437,088 A 8/1995 Igarashi
5,499,814 A 3/1996 Lu
5,527,034 A 6/1996 Ashcraft et al.
5,547,427 A 8/1996 Rigal et al.
5,676,606 A 10/1997 Schaeffer et al.
5,720,674 A 2/1998 Galy
5,785,610 A 7/1998 Birmingham
5,930,887 A 8/1999 Tomita et al.
5,993,329 A 11/1999 Shieh
6,001,032 A 12/1999 Onuki et al.
6,001,495 A 12/1999 Bristow et al.
6,117,023 A 9/2000 Onuki et al.
6,224,497 B1 5/2001 Antonious
6,248,025 B1 6/2001 Murphy et al.
6,305,063 B1 10/2001 Ashcraft et al.
6,309,310 B1 10/2001 Shira
6,319,148 B1 11/2001 Tom
6,332,848 B1 12/2001 Long et al.
6,348,013 B1 2/2002 Kosmatka
6,364,789 B1 4/2002 Kosmatka
6,398,665 B1 6/2002 Antonious
6,428,426 B1 8/2002 Helmstetter et al.
6,471,604 B2 10/2002 Hocknell et al.
6,491,592 B2 12/2002 Cackett et al.
6,497,629 B2 12/2002 Takeda
6,565,452 B2 5/2003 Helmstetter et al.
6,575,845 B2 6/2003 Galloway et al.
6,582,323 B2 6/2003 Soracco et al.
6,592,466 B2 7/2003 Helmstetter et al.
6,604,568 B2 8/2003 Bliss et al.
6,607,452 B2 8/2003 Helmstetter et al.
6,623,376 B2 9/2003 Poyner
6,645,086 B1 11/2003 Chen
6,648,773 B1 11/2003 Evans
6,652,391 B1 11/2003 Kubica et al.
6,663,504 B2 12/2003 Hocknell et al.
6,669,578 B1 12/2003 Evans
6,676,536 B1 1/2004 Jacobson
6,710,287 B2 3/2004 Lu
6,713,717 B2 3/2004 Takeda
6,719,644 B2 4/2004 Beach
6,739,376 B1 5/2004 Cheng et al.
6,739,982 B2 5/2004 Murphy et al.
6,739,983 B2 5/2004 Helmstetter et al.
6,758,763 B2 7/2004 Murphy et al.
6,789,304 B2 9/2004 Kouno
6,800,038 B2 10/2004 Willett et al.
6,860,818 B2 3/2005 Mahaffey et al.
6,860,824 B2 3/2005 Evans
6,875,129 B2 4/2005 Erickson et al.
6,881,159 B2 4/2005 Galloway et al.
6,890,267 B2 5/2005 Mahaffey et al.
6,904,663 B2 6/2005 Willett et al.
6,926,619 B2 8/2005 Helmstetter et al.
6,929,565 B2 8/2005 Nakahara et al.
6,929,566 B2 8/2005 Sano
6,955,612 B2 10/2005 Lu
6,966,848 B2 11/2005 Kusumoto
6,971,436 B2 12/2005 Huang
6,988,960 B2 1/2006 Mahaffey et al.
6,991,558 B2 1/2006 Beach et al.
6,994,635 B2 2/2006 Poyner
6,994,637 B2 2/2006 Murphy et al.
7,025,692 B2 4/2006 Erickson et al.
7,066,833 B2 6/2006 Yamamoto
7,066,835 B2 6/2006 Evans et al.
7,070,517 B2 7/2006 Cackett et al.
7,086,962 B2 8/2006 Galloway et al.
7,097,573 B2 8/2006 Erickson et al.
7,118,493 B2 10/2006 Galloway
7,121,957 B2 10/2006 Hocknell et al.
7,125,344 B2 10/2006 Hocknell et al.
7,128,661 B2 10/2006 Soracco et al.
7,128,664 B2 10/2006 Onoda et al.
7,144,333 B2 12/2006 Murphy et al.
7,152,656 B2 12/2006 Huang et al.
7,166,038 B2 1/2007 Williams et al.
7,166,039 B2 1/2007 Hettinger et al.
7,189,165 B2 3/2007 Yamamoto
7,229,362 B2 6/2007 Tavares
7,258,630 B2 8/2007 Erickson et al.
7,258,631 B2 8/2007 Galloway et al.
7,291,074 B2 11/2007 Kouno et al.
7,291,075 B2 11/2007 Williams et al.
7,306,527 B2 12/2007 Williams et al.
7,338,388 B2 3/2008 Schweigert et al.
7,338,390 B2 3/2008 Lindsay
7,344,452 B2 3/2008 Imamoto et al.
7,360,578 B2 4/2008 Tseng
7,371,191 B2 5/2008 Sugimoto
7,402,113 B2 7/2008 Mori et al.
7,413,520 B1 8/2008 Hocknell et al.
7,416,496 B2 8/2008 Galloway et al.
7,431,667 B2 10/2008 Vincent et al.
7,435,190 B2 10/2008 Sugimoto
7,448,961 B2 11/2008 Lin
7,452,286 B2 11/2008 Lin et al.
7,462,109 B2 12/2008 Erickson et al.
7,470,201 B2 12/2008 Nakahara et al.
7,476,161 B2 1/2009 Williams et al.
7,481,720 B2 1/2009 Tavares
7,497,789 B2 3/2009 Burnett et al.
7,503,854 B2 3/2009 Galloway et al.
7,513,296 B1 4/2009 Yu et al.
7,524,249 B2 4/2009 Breier et al.
7,540,810 B2 6/2009 Hettinger et al.
7,549,935 B2 6/2009 Foster et al.
7,584,531 B2 9/2009 Schweigert et al.
7,594,863 B2 9/2009 Ban
7,607,991 B2 10/2009 Sorenson
7,628,713 B2 12/2009 Tavares
7,632,193 B2 12/2009 Thielen
7,637,822 B2 12/2009 Foster et al.
7,658,686 B2 2/2010 Soracco

(56) References Cited

U.S. PATENT DOCUMENTS 7,674,188 B2 3/2010 Ban
7,674,190 B2 3/2010 Galloway et al.
7,677,990 B2 3/2010 Ban
7,690,098 B2 4/2010 Chen
7,691,008 B2 4/2010 Oyama
7,695,377 B2 4/2010 Yamagishi et al.
7,749,097 B2 7/2010 Foster et al.
7,758,449 B2 7/2010 Gilbert et al.
7,758,454 B2 7/2010 Burnett et al.
7,785,212 B2 8/2010 Lukasiewicz, Jr. et al.
7,803,065 B2 9/2010 Breier et al.
7,811,178 B2 10/2010 Davis
7,815,521 B2 10/2010 Ban et al.
7,819,756 B2 10/2010 Ban et al.
7,828,671 B2 11/2010 Ban
7,846,038 B2 12/2010 Foster et al.
7,846,040 B2 12/2010 Ban
7,878,923 B2 2/2011 Yamagishi et al.
7,901,297 B2 3/2011 Ban et al.
7,905,798 B2 3/2011 Petersen et al.
7,918,747 B2 4/2011 Johnson et al.
7,931,546 B2 4/2011 Bennett et al.
7,934,998 B2 5/2011 Yakota
7,976,404 B2 7/2011 Golden et al.
7,976,406 B2 7/2011 Gilbert et al.
7,980,964 B2 7/2011 Soracco
7,993,216 B2 8/2011 Lee
8,012,036 B2 9/2011 Nakamura
8,020,606 B2 9/2011 Chao et al.
8,033,929 B2 10/2011 Yamagishi et al.
8,038,545 B2 10/2011 Soracco
8,043,167 B2 10/2011 Boyd et al.
8,062,151 B2 11/2011 Boyd et al.
8,092,320 B2 1/2012 Yamagishi et al.
8,100,781 B2 1/2012 Burnett et al.
8,128,511 B2 3/2012 Golden et al.
8,128,513 B2 3/2012 Gilbert et al.
8,133,135 B2 3/2012 Stites et al.
8,147,354 B2 4/2012 Hartwell et al.
8,167,739 B2 5/2012 Lukasiewicz, Jr. et al.
8,172,699 B2 5/2012 Nakamura
8,187,119 B2 5/2012 Rae et al.
8,214,992 B2 7/2012 Hirano
8,216,087 B2 7/2012 Breier et al.
8,221,260 B2 7/2012 Stites et al.
8,226,499 B2 7/2012 Soracco
8,277,336 B2 10/2012 Hirano
8,337,324 B2 12/2012 Sander et al.
8,337,326 B2 12/2012 Lukasiewicz, Jr. et al.
8,342,981 B2 1/2013 Johnson et al.
8,376,877 B1 2/2013 Galloway
8,419,569 B2 4/2013 Bennett et al.
8,475,292 B2 7/2013 Rahrig et al.
8,506,420 B2 8/2013 Hocknell et al.
8,506,421 B2 8/2013 Stites et al.
8,517,861 B2 8/2013 Golden et al.
8,523,703 B2 9/2013 Rife
8,523,705 B2 9/2013 Breier et al.
8,550,935 B2 10/2013 Stites et al.
8,585,513 B2 11/2013 Ban
8,684,861 B2 4/2014 Carlyle et al.
8,696,490 B2 4/2014 Ban
8,715,109 B2 5/2014 Bennett et al.
8,727,908 B2 5/2014 Goto
8,747,252 B2 6/2014 Lukasiewicz, Jr. et al.
8,758,162 B2 6/2014 Ban
8,827,832 B2 9/2014 Breier et al.
8,827,833 B2 9/2014 Amano et al.
8,834,291 B2 9/2014 Ban
8,845,453 B1 9/2014 Ehlers
8,858,361 B2 10/2014 Ripp et al.
8,864,601 B1 10/2014 Ehlers
8,938,871 B2 1/2015 Roach et al.
8,939,192 B2 1/2015 Solesbee et al.
8,979,670 B2 3/2015 Aguayo et al.
9,028,340 B2 5/2015 Ban
9,033,820 B2 5/2015 Kato
9,079,079 B2 7/2015 Fossum et al.
9,089,746 B2 7/2015 Schweigert
9,149,692 B2 10/2015 Shimahara
9,162,116 B2 10/2015 Carlyle et al.
9,162,117 B2 10/2015 Ehlers
9,308,421 B2 4/2016 Ban et al.
9,308,422 B2 4/2016 Ripp et al.
9,320,949 B2 4/2016 Golden et al.
9,403,068 B2 8/2016 Golden et al.
9,457,245 B2 10/2016 Lee
9,474,946 B2 10/2016 Bennett et al.
9,480,887 B2 11/2016 Myrhum et al.
9,486,676 B1 11/2016 Thall et al.
9,504,885 B2 11/2016 Ban
9,504,889 B2 11/2016 Mitzel et al.
9,539,477 B2 1/2017 Ripp et al.
9,545,545 B2 1/2017 Li
9,545,546 B2 1/2017 Li
9,545,661 B2 1/2017 Li
9,555,298 B2 1/2017 Carlyle et al.
9,566,480 B2 2/2017 Voges
9,579,550 B2 2/2017 Aguayo et al.
9,636,559 B2 5/2017 de la Cruz et al.
9,636,757 B1 5/2017 Rice et al.
9,687,703 B2 6/2017 Li
9,687,704 B2 6/2017 Li
9,782,642 B1 * 10/2017 DeMille ..... A63B 53/04
9,814,944 B1 11/2017 Greaney et al.
9,814,951 B2 11/2017 Ripp et al.
9,844,709 B2 12/2017 Tassistro
9,868,037 B1 1/2018 Ripp et al.
9,901,789 B2 2/2018 Kitagawa et al.
9,908,013 B2 3/2018 Hettinger et al.
9,914,027 B1 * 3/2018 Harbert ..... A63B 60/00
9,931,550 B1 4/2018 Seluga et al.
9,937,389 B2 4/2018 Kitagawa et al.
9,950,225 B2 4/2018 Aguayo et al.
9,975,014 B2 5/2018 Carlyle et al.
9,975,015 B2 5/2018 Ripp et al.
10,004,958 B2 6/2018 Tang et al.
10,076,689 B2 9/2018 de la Cruz et al.
10,130,855 B2 11/2018 Stokke
10,155,144 B2 12/2018 Lee
10,183,201 B2 1/2019 Schweigert
10,195,502 B2 2/2019 Ripp et al.
10,213,660 B1 2/2019 Beno et al.
10,213,663 B2 2/2019 Goudarzi et al.
10,238,926 B2 3/2019 Carlyle et al.
2002/0091014 A1 7/2002 Aldrich
2002/0183134 A1 12/2002 Allen et al.
2002/0187853 A1 12/2002 Beach et al.
2003/0017886 A1 1/2003 Hitoshi et al.
2003/0060306 A1 3/2003 Aldrich
2003/0064823 A1 * 4/2003 Yamamoto ..... A63B 53/04
473/329
2003/0083151 A1 * 5/2003 Nakahara ..... A63B 53/04
473/345
2003/0092506 A1 * 5/2003 Matsunaga ..... A63B 53/0466
473/345
2004/0083596 A1 5/2004 Willett et al.
2004/0099538 A1 5/2004 Chao et al.
2004/0116208 A1 6/2004 De Shiell et al.
2005/0034834 A1 2/2005 Huang
2005/0181310 A1 8/2005 Yang et al.
2005/0221915 A1 * 10/2005 De Shiell ..... A63B 60/00
473/345
2005/0224207 A1 10/2005 Huang
2006/0019770 A1 1/2006 Meyer et al.
2006/0025233 A1 2/2006 Lin
2006/0052177 A1 3/2006 Norihiko et al.
2006/0100028 A1 5/2006 Kuo
2007/0049410 A1 * 3/2007 Matsunaga ..... A63B 53/0466
473/345
2007/0049415 A1 3/2007 Shear
2007/0079946 A1 4/2007 Lin
2007/0173346 A1 7/2007 Chiang et al.
2008/0139339 A1 6/2008 Cheng

(56) References Cited

U.S. PATENT DOCUMENTS

| | | | | |
|---|---|---|---|---|
| 2008/0171610 | A1 | 7/2008 | Shin | |
| 2009/0209364 | A1 | 8/2009 | Lukasiewicz, Jr. et al. | |
| 2009/0286615 | A1 | 11/2009 | De La Cruz et al. | |
| 2010/0105499 | A1 | 4/2010 | Roach et al. | |
| 2010/0125000 | A1 | 5/2010 | Lee | |
| 2010/0248860 | A1 | 9/2010 | Guerrette et al. | |
| 2010/0290944 | A1* | 11/2010 | Lin | A63B 53/04 420/420 |
| 2011/0009211 | A1 | 1/2011 | Chao et al. | |
| 2011/0092311 | A1 | 4/2011 | DeShiell et al. | |
| 2011/0159986 | A1* | 6/2011 | Chao | A63B 53/0466 473/345 |
| 2012/0225735 | A1* | 9/2012 | Honea | A63B 53/0466 473/345 |
| 2014/0080632 | A1 | 3/2014 | Deshmukh et al. | |
| 2014/0080633 | A1 | 3/2014 | Bezilla et al. | |
| 2014/0256464 | A1 | 9/2014 | Chao et al. | |
| 2014/0283364 | A1 | 9/2014 | Chiang et al. | |
| 2014/0349780 | A1* | 11/2014 | Fossum | A63B 53/0466 473/345 |
| 2015/0000366 | A1 | 1/2015 | Lo | |
| 2015/0018119 | A1 | 1/2015 | Breier et al. | |
| 2015/0072801 | A1 | 3/2015 | Chang | |
| 2015/0148149 | A1* | 5/2015 | Beach | A63B 53/0466 473/349 |
| 2015/0190687 | A1 | 7/2015 | Clausen et al. | |
| 2016/0001140 | A1 | 1/2016 | Lo et al. | |
| 2016/0067563 | A1 | 3/2016 | Murphy et al. | |
| 2016/0175666 | A1 | 6/2016 | Chao et al. | |
| 2016/0279489 | A1 | 9/2016 | Seluga et al. | |
| 2016/0361607 | A1 | 12/2016 | Huang et al. | |
| 2016/0375326 | A1 | 12/2016 | Nunez et al. | |
| 2017/0095711 | A1 | 4/2017 | Ferguson et al. | |
| 2017/0246518 | A1 | 8/2017 | Tang et al. | |
| 2018/0001158 | A1* | 1/2018 | Mizutani | A63B 53/0466 |
| 2018/0056147 | A1 | 3/2018 | Ripp et al. | |
| 2018/0104548 | A1 | 4/2018 | Ripp et al. | |
| 2018/0111027 | A1 | 4/2018 | Funaki et al. | |
| 2018/0126228 | A1* | 5/2018 | Penney | A63B 60/00 |
| 2018/0133566 | A1 | 5/2018 | Kitagawa et al. | |
| 2018/0169485 | A1 | 6/2018 | Henrikson et al. | |
| 2018/0236315 | A1 | 8/2018 | Aguayo et al. | |
| 2018/0243616 | A1 | 8/2018 | Carlyle et al. | |
| 2018/0311545 | A1 | 11/2018 | Lambeth et al. | |
| 2018/0369657 | A1 | 12/2018 | Ban | |
| 2019/0009138 | A1 | 1/2019 | Aguayo et al. | |
| 2019/0022472 | A1* | 1/2019 | Del Rosario | A63B 53/0466 |
| 2019/0046844 | A1 | 2/2019 | Chao et al. | |
| 2019/0046845 | A1* | 2/2019 | Greensmith | A63B 53/06 |
| 2019/0046847 | A1 | 2/2019 | Stokke | |
| 2020/0038721 | A1 | 2/2020 | Greensmith et al. | |

FOREIGN PATENT DOCUMENTS

| | | |
|---|---|---|
| JP | 2003038690 | 2/2003 |
| JP | 2003275343 | 9/2003 |
| JP | 2005137940 | 6/2005 |
| JP | 2006006975 | 1/2006 |
| JP | 3762906 | 4/2006 |

* cited by examiner

| | Caster 1 | Caster 2 | Caster 3 | Caster 4 | Caster 5 | Caster 6 |
|---|---|---|---|---|---|---|
| Degree of complexity of cluster | 1 | 3 | 2 | 2 | 2 | 5 |
| A max (m) | 0.15 | 0.38 | 0.42 | 0.42 | 0.42 | 0.6 |
| A min (m) | NA | 0.28 | 0.24 | 0.24 | 0.24 | 0.3 |
| Major runner cross section | 21 mm, 23 mm | 22 mm, 30 mm | 22 mm, 22 mm | 26 mm | 33 mm, 33 mm | 20 mm, 45 mm |
| Main gate cross section | 22 mm, 21 mm | 23 mm, 20 mm | 23 mm, 20 mm | 23 mm, 20 mm | 23 mm, 20 mm | 22 mm, 30 mm |
| Runner cross sectional area ($m^2$) | 0.000483 | 0.00066 | 0.000209 | 0.000616 | 0.000471 | 0.0009 |
| Wet perimeter (m) | 0.088 | 0.104 | 0.066 | 0.067962 | 0.999000 | 0.13 |
| Gate cross sectional area ($m^2$)[02] | 0.000462 | 0.00092 | 0.00092 | 0.00092 | 0.00092 | 0.00132 |
| Interface getting ratio (%) runner-to-gate[03] | 104.55% | 71.74% | 22.72% | 86.93% | 51.24% | 68.16% |
| R (flow radius) of runner (m) | 0.0054 | 0.0063 | 0.0032 | 0.0070 | 0.0048 | 0.0059 |
| Sharp turn | 1 | 2 | 2 | 2 | 2 | 3 |
| Rotation (mm) | 505 | 370 | 380 | 380 | 380 | 340 |
| Shell preheat temp($^0$C) | 900 | 750 | 750 | 750 | 750 | 500 |
| Angular speed $\omega$ (rad/sec) | 52.88 | 36.75 | 39.79 | 39.79 | 35.79 | 35.60 |
| Pouring material (kg) | 9.3 | 39.2 | 35 | 32 | 32 | 72.2 |
| Casting pieces | 14 | 48 | 48 | 48 | 48 | 96 |
| Process loss(kg) | 3.9 | 6 | 7.5 | 7.5 | 7.5 | 10 |

FIG. 16

| | | | | | | |
|---|---|---|---|---|---|---|
| Actual available filling material (kg) | 5.4 | 33.2 | 27.5 | 24.5 | 24.5 | 62.2 |
| Material usage (kg/pc) (w/o process loss) | 0.664 | 0.817 | 0.729 | 0.667 | 0.667 | 0.752 |
| Material usage (kg/pc) (w/ process loss) | 0.386 | 0.692 | 0.573 | 0.510 | 0.510 | 0.648 |
| Process loss ratio | 41.9% | 15.3% | 21.4% | 23.4% | 23.4% | 13.9% |
| Velocity max (m/s) | 7.93 | 14.72 | 16.71 | 16.71 | 16.71 | 14.24 |
| Velocity min (m/s) | NA | 10.85 | 9.55 | 9.55 | 9.55 | 9.61 |
| Acceleration max ($m/s^2$) | 419.47 | 570.45 | 665.04 | 655.04 | 665.04 | 507.05 |
| Acceleration min ($m/s^3$) | NA | 420.33 | 380.02 | 380.02 | 380.02 | 342.26 |
| Force max (N1) | 161.80 | 394.56 | 381.01 | 339.45 | 339.45 | 328.53 |
| Force min (N1) | NA | 290.73 | 217.72 | 193.97 | 193.97 | 221.75 |
| Pressure max (Pa) | 334984.13 | 597821.56 | 1823027.72 | 551289.62 | 720076.71 | 365027.92 |
| Pressure min (Pa) | NA | 316010.94 | 236653.91 | 210837.12 | 210637.12 | 157995.81 |
| Kinetic energy max (J) | 12.13 | 74.97 | 80.01 | 71.28 | 71.23 | 65.71 |
| Density (MP) ($g/cm^2$) | 4.11 | 4.11 | 4.11 | 4.11 | 4.11 | 4.11 |
| Viscosity (MP) ($g/cm^2sec$) | 0.033 | 0.033 | 0.033 | 0.033 | 0.033 | 0.033 |
| Renumber max | 212075.72 | 455478.47 | 263556.77 | 582820.22 | 395456.52 | 491181.21 |
| Renumber min | NA | 342884.14 | 150681.01 | 333040.13 | 226548.68 | 331547.32 |
| Casting yield | 94% | 93% | 78% | 94% | 94% | 89% |

FIG. 17

GOLF CLUB HEADS

CROSS-REFERENCE TO RELATED APPLICATIONS

This application is a continuation of U.S. patent application Ser. No. 16/161,337, filed Oct. 16, 2018, which is a continuation-in-part of U.S. patent application Ser. No. 16/059,801 filed Aug. 9, 2018, which claims the benefit of U.S. Provisional Patent Application No. 62/543,778, filed Aug. 10, 2017, all of which are incorporated by reference herein in their entirety.

FIELD

This disclosure relates to golf club heads having cast components and related methods for manufacturing such golf club heads.

BACKGROUND

With the ever-increasing popularity and competitiveness of golf, substantial effort and resources are currently being expended to improve golf clubs. Much of the recent improvement activity has involved the combination of the use of new and increasingly more sophisticated materials in concert with advanced club-head engineering. For example, modern "wood-type" golf clubs (e.g., "drivers," "fairway woods," "rescues," and "utility or hybrid clubs"), with their sophisticated shafts and non-wooden club-heads, bear little resemblance to the "wood" drivers, low-loft long-irons, and higher numbered fairway woods used years ago. These modern wood-type clubs are generally called "metalwoods" or simply "woods."

The current ability to fashion metalwood club-heads of strong, light-weight metals and other materials has allowed the club-heads to be made hollow. Use of materials of high strength and high fracture toughness has also allowed club-head walls to be made thinner, which reduces total weight and allows increases in club-head size, compared to earlier club-heads without the swing speed penalty resulting from increased weight. Larger club-heads tend to have a larger face plate area and can also be made with high club-head inertia, thereby making the club-heads more "forgiving" than smaller club-heads. Characteristics such as size of the optimum impact location (also known as the "sweet spot") are determined by many variables including the shape, profile, size and thickness of the face plate as well as the location of the center of gravity (CG) of the club-head.

An exemplary metalwood golf club typically includes a shaft having a lower end to which the club-head is attached. Most modern versions of these club-heads are made, at least in part, of a light-weight but strong metal such as titanium alloy. In some cases, the club-head comprises a body to which a face plate (used interchangeably herein with the terms "face" or "face insert" or "striking plate" or "strike plate") is later attached, while in other cases the body and face place are cast together as a unitary structure, such that the face plate does not have to be later attached to the body. The face plate defines a front surface or strike face that actually contacts the golf ball.

Regarding the total mass of the metalwood club-head as the club-head's mass budget, at least some of the mass budget must be dedicated to providing adequate strength and structural support for the club-head. This is termed "structural" mass. Any mass remaining in the budget is called "discretionary" or "performance" mass, which can be distributed within the metalwood club-head to address performance issues, for example. Thus the ability to reduce the structural mass of the metalwood club-head without compromising strength and structural support provides the potential for increasing discretionary mass and hence improved club performance.

One opportunity to reduce the total mass of the club head is to lower the mass of the face plate by reducing its thickness; however opportunities to do this are somewhat limited given that the face absorbs the initial impact of the ball and thus has quite rigorous requirements on its physical and mechanical properties. Club manufacturers have used titanium and titanium alloys for face plate manufacture as well as whole club head manufacture, given their lightness and high strength. Typically for the club head given its relatively complex 3-D structure, casting processes have been used for its manufacture. Many such face plates are made by the investment casting process wherein an appropriate metal melt is cast into a preheated ceramic investment mold formed by the lost wax process. Investment casting has also been used to prepare the face plate either as a unitary structure cast with the rest of the club head body or as separately formed face plate which is then attached to the front of the club head body, usually by welding. Although widely used, investment casting of complex shaped components of such reactive materials can be characterized by relatively high costs and low yields. Low casting yields are attributable to several factors including surface or surface-connected void type defects and/or inadequate filling of certain mold cavity regions, especially thin mold cavity regions, and associated internal void, shrinkage and like defects.

To further compound the deficiencies of investment casting the face plate, club head manufacturers often also introduce curvature onto the face of the club to help compensate for directional problems caused by shots hit other than where the center of gravity is located. Thus rather than planar face plate manufacturers may wish to form the face with both a heel-to-toe convex curvature (referred to as "bulge") and a crown-to-sole convex curvature (referred to as "roll"). In addition manufacturers may also introduce variable face thickness profiles across the face plate. Varying the thickness of a faceplate may increase the size of a club head COR zone, commonly called the sweet spot of the golf club head, which, when striking a golf ball with the golf club head, allows a larger area of the face plate to deliver consistently high golf ball velocity and shot forgiveness. Also, varying the thickness of a faceplate can be advantageous in reducing the weight in the face region for reallocation to another area of the club head.

In order to make up for the deficiencies of investment casting these more complex face plate structures, manufacturers have turned to alternative methods of forming the face plate including laser cutting the face plate shape from a rolled titanium sheet followed by subsequent forging to impart any desired bulge and roll followed by a machining step on a lathe to introduce any desired face thickness profile. Disadvantages of these steps include the fact that three separate forming steps are needed and the machining process on a lathe to form variable thickness profiles is not only wasteful but also limits the profiles to circular shaped areas as a result of the circular motion of the lathe.

Thus it would be highly desirable to have club head face plates with sufficient physical properties to allow reduction in thickness to result in more available discretionary weight in a club head. It would also be desirable if the face plates were also able to exhibit any desired bulge and roll curvature in addition to any variable thickness profile having any shape—circular, oval, asymmetrical or otherwise. It would also be desirable if a simplified process for manufacture of such face plates could be employed which would result in face plate with the required thickness and physical strength properties which process would also result in a face plate with any desired bulge and roll and variable thickness profile while requiring a minimum of processing steps and minimizing any waste produced in the process. It would also be desirable if the club head body and the face could be cast at the same time from the same material as a single unitary body, rather than two pieces that must be later attached together. It would also be desirable if the cast face plate did not require chemical etching to remove or reduce the thickness of the alpha case to provide adequate durability properties for the face plate.

SUMMARY

Some golf club head bodies disclosed herein can be cast of 9-1-1 titanium with the face plate being cast as a unitary part of the body along the with crown, sole, skirt and hosel. Due to the 9-1-1 titanium material, the face plate and other portions of the body acquire less oxygen from the mold and can have a reduced alpha case thickness, resulting in greater ductility and durability. This can eliminate the need to reduce the alpha case thickness after casting using hydrofluoric acid or other dangerous chemical etchants. Casting methods can include preheating the casting mold to a lower than normal temperature and/or coating an inner surface of the mold, to further reduce the amount of oxygen transferred from the mold to the 9-1-1 titanium during casting.

In some embodiments, a wood-type golf club head body comprises a crown, a sole, skirt, a face plate, and a hosel; the body defines a hollow interior region; the body is cast substantially entirely of 9-1-1 titanium; and the body is cast as a single unitary casting, with the face plate being formed integrally with the crown, sole, skirt, and hosel. The body may comprise trace fluorine atoms as alloying impurities found in the titanium alloy, but due to the absence of etching the face with hydrofluoric acid after casting, the content of fluorine present in the body can be very low. In some embodiments, the face plate can have substantially no fluorine atoms, such as less than 1000 ppm, less than 500 ppm, less than 200 ppm, and or less than 100 ppm. In some embodiments, the body can have an alpha case thickness of 0.150 mm or less, 0.100 mm or less, and/or 0.070 mm or less.

Some exemplary methods comprise preparing a mold for casting and then casting a golf club head body substantially entirely of 9-1-1 titanium using the mold, wherein the cast body includes a crown, a sole, skirt, a face plate, and a hosel, wherein the cast body defines a hollow interior region; and wherein the body is cast as a single unitary casting, with the face plate being formed integrally with the crown, sole, skirt, and hosel during the casting. Some such methods do not include etching the face plate after the casting. In some methods, preparing the mold comprises preheating the mold such that the mold is at a temperature of 800 C or less, 700 C or less, 600 C or less, and/or 500 C or less, when the casting occurs.

Also disclosed herein are golf club head embodiments comprising a metallic cast cup forming a forward portion of the club head, including a hosel, a face portion, a forward portion of a crown, and a forward portion of a sole. A metallic rear ring can be formed separately from the cast cup and coupled to heel and toe portions of the cast cup to form a club head body, such that the metallic club head body defines a hollow interior region, a crown opening, and a sole opening. A composite crown insert can then be coupled to the crown opening. A sole insert made of composite, metal, or other material can be coupled to the sole opening. In some embodiments, there is no sole opening or sole insert. The cast cup and rear ring can be cast of a titanium alloy, and can be welded together to form the club head body. In some embodiments, the ring and cup are comprised of different metallic materials, such as two different titanium alloys, or a titanium allow and steel. The cast cup can include a face portion that has an intricate geometry to provide desirable performance properties. The face portion can have a twisted front surface and/or the rear surface of the face can have a geometry that provides an asymmetric variable thickness profile across the face. The rear surface of the face portion of the cast cup can be machined and/or otherwise modified before the rear ring is attached such that there is increased room to access the entire rear surface of the face with tools.

Also disclosed are methods of forming a wax cup from a wax cup frame and a separately formed wax face, using a wax welding process. Such a wax cup can then be used to create a mold for casting the metallic cup that forms the front portion of a golf club head. The two piece wax welding process can provide manufacturing, prototyping, and testing advantages.

Also disclosed are cast face plates, such as comprising titanium alloys, which have novel geometries.

The foregoing and other objects, features, and advantages of the disclosed technology will become more apparent from the following detailed description, which proceeds with reference to the accompanying figures.

BRIEF DESCRIPTION OF THE DRAWINGS

FIG. 16 is a table for casting data for titanium alloy obtained for six different casters.

FIG. 17 a continuation of the table of FIG. 16.

DETAILED DESCRIPTION

Figure 1:
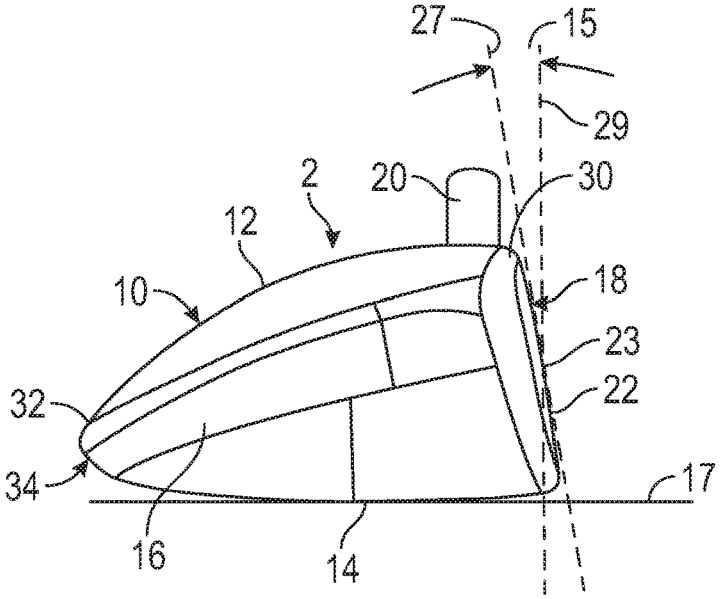
FIG. 1 is a side elevation view of a golf club head.
Figure 2:
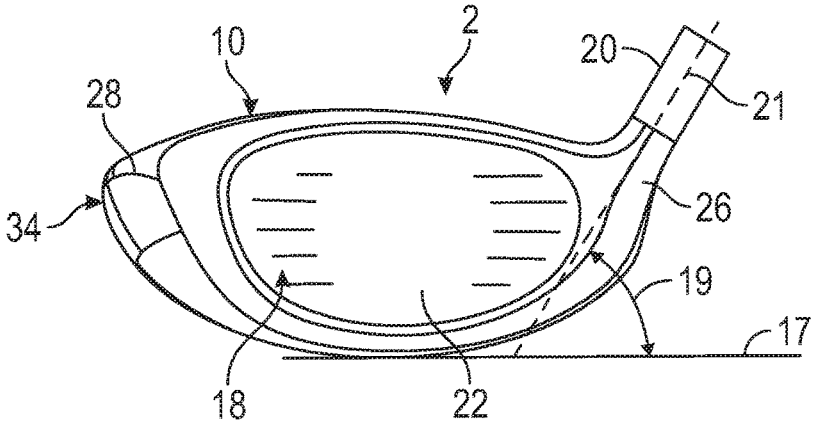
FIG. 2 is a front elevation view of the golf club head of FIG. 1.
Figure 3:
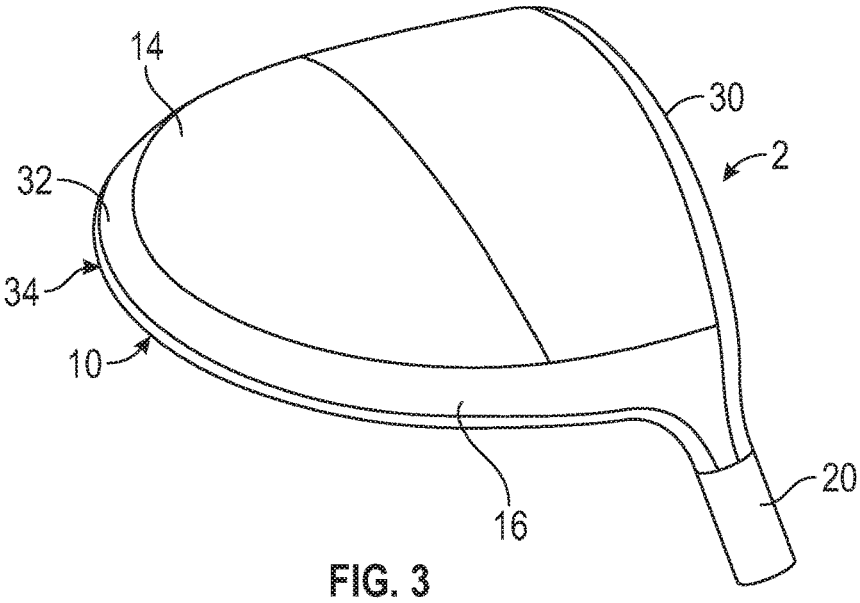
FIG. 3 is a bottom perspective view of the golf club head of FIG. 1.

The following describes embodiments of golf club heads for metalwood type golf clubs, including drivers, fairway woods, rescue clubs, utility clubs, hybrid clubs, and the like.

The inventive features disclosed herein include all novel and non-obvious features disclosed herein both alone and in combinations with any other features. As used herein, the phrase "and/or" means "and", "or", and both "and" and "or". As used herein, the singular forms "a," "an," and "the" refer to one or more than one, unless the context clearly dictates otherwise. As used herein, the term "includes" means "comprises."

The following also makes reference to the accompanying drawings which form a part hereof. The drawings illustrate specific embodiments, but other embodiments may be formed and structural changes may be made without departing from the intended scope of this disclosure. Directions and references (e.g., up, down, top, bottom, left, right, rearward, forward, heelward, toeward, etc.) may be used to facilitate discussion of the drawings but are not intended to be limiting. For example, certain terms may be used such as "up," "down,", "upper," "lower," "horizontal," "vertical," "left," "right," and the like. These terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same object. Accordingly, the following detailed description shall not be construed in a limiting sense and the scope of property rights sought shall be defined by the appended claims and their equivalents.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the herein-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

For reference, within this disclosure, reference to a "driver type golf club head" means any metalwood type golf club head intended to be used primarily with a tee. In general, driver type golf club heads have lofts of 15 degrees or less, and, more usually, of 12 degrees or less. Reference to a "fairway wood type golf club head" means any wood type golf club head intended to be used to strike a ball off the ground, while also being usable to strike a ball off a tee as well. In general, fairway wood type golf club heads have lofts of 15 degrees or greater, and, more usually, 16 degrees or greater. In general, fairway wood type golf club heads have a length from leading edge to trailing edge of 73-97 mm. Various definitions distinguish a fairway wood type golf club head from a hybrid type golf club head, which tends to resemble a fairway wood type golf club head but be of smaller length from leading edge to trailing edge. In general, hybrid type golf club heads are 38-73 mm in length from leading edge to trailing edge. Hybrid type golf club heads may also be distinguished from fairway wood type golf club heads by weight, by lie angle, by volume, and/or by shaft length. Driver type golf club heads of the current disclosure may be 15 degrees or less in various embodiments or 10.5 degrees or less in various embodiments. In various embodiments, fairway wood type golf club heads of the current disclosure may be from 13-26 degrees.

As illustrated in FIGS. 1-6, a wood-type (e.g., driver or fairway wood) golf club head, such as golf club head 2, can include a hollow body 10. The body 10 can include a crown 12, a sole 14, a skirt 16, and a face plate 18 (also referred to as a face or face portion) defining striking surface 22, while defining an interior cavity. The face plate 18 may be formed separately from the body and attached to an opening at the front of the body, or may be integrally formed as a unitary part of the body 10. The body 10 can include a hosel 20, which defines a hosel bore 24 adapted to receive a golf club shaft (see FIG. 6). The body 10 further includes a heel portion 26, a toe portion 28, a front portion 30, and a rear portion 32.

Figure 4:
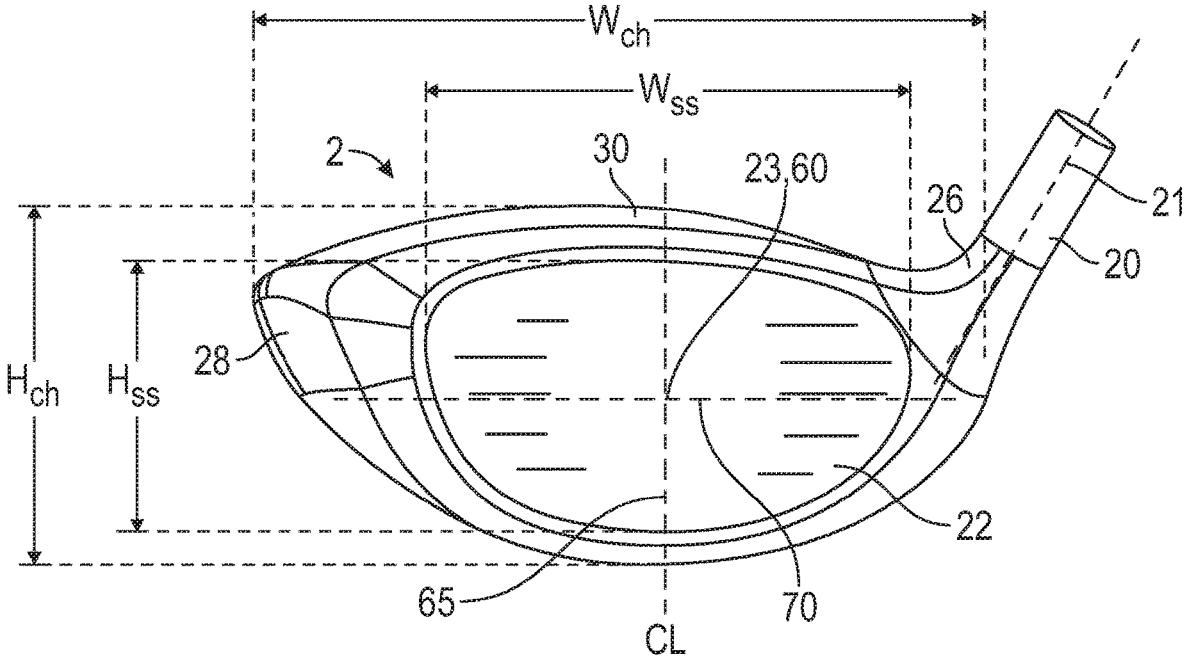
FIG. 4 is a front elevation view of the golf club head of FIG. 1 showing a golf club head origin coordinate system.
Figure 5:
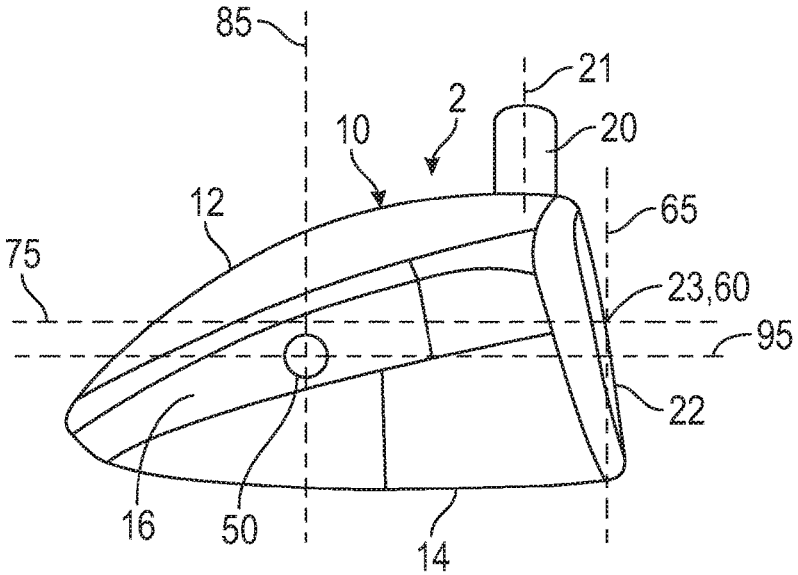
FIG. 5 is a side elevation view of the golf club head of FIG. 1 showing a center of gravity coordinate system.
Figure 6:
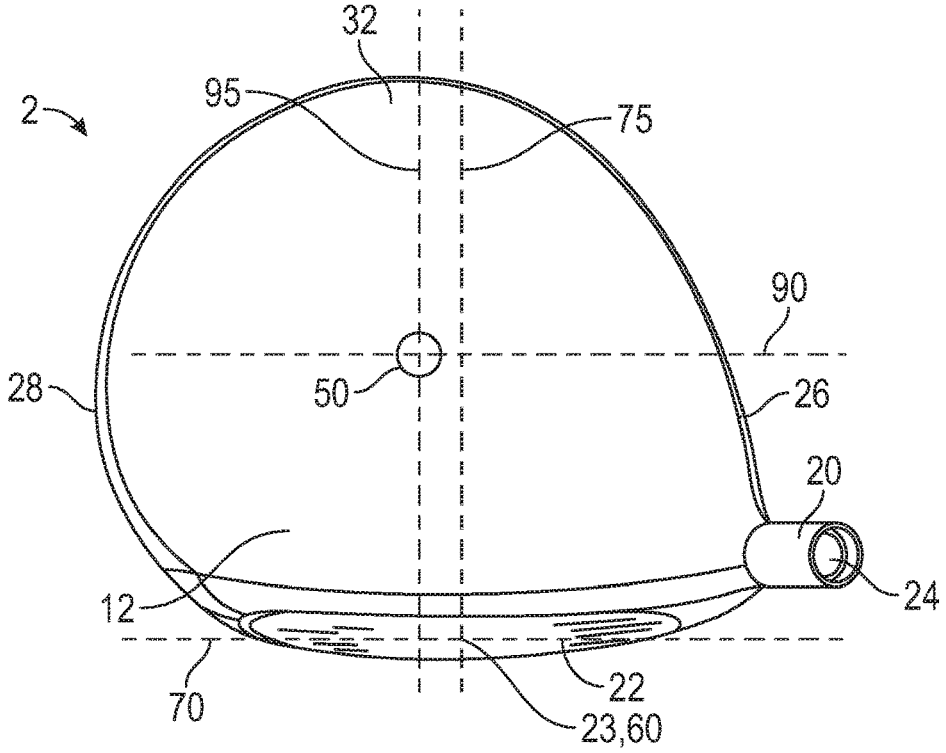
FIG. 6 is a top plan view of the golf club head of FIG. 1.

FIGS. 4-6 illustrate an ideal impact location/origin 23, 60, an origin x axis 70, an origin y axis 75, and origin z axis 65, a center of gravity 50 of the club head, a CG x axis 90, a CG y axis 95, and a CG z axis 85. These axes are horizontal or vertical while the club head is in the normal address position, as shown. The origin axes pass through the origin 60, and the CG axes pass through the CG 50.

The body may further include openings in the crown and/or sole that are overlaid or covered by inserts formed of lighter-weight material, such as composite materials. For example, the crown of the body can comprise a composite crown insert that covers a large portion of the area of the crown and has a lower density that the metal the body is made out of, thereby saving weight in the crown. Similarly, the sole can include one or more openings in the body that are covered by sole inserts. The sole insert can be made of composite material, metallic material, or other material. In embodiments where the body includes openings in the crown or sole, such openings can provide access to the inner cavity of the club head during manufacturing, especially where the face plate is formed as an integral part of the body during casting (and there is not a face opening in the body to provide access during manufacturing). The club heads disclosed herein in relation to FIGS. 20-36 provide examples of openings in the crown and sole that are overlaid or covered by inserts formed of lighter-weight material (e.g., composite materials). More information regarding openings in the body and related inserts can be found in U.S. Patent Publication 2018/0185719, published Jul. 5, 2018, and in U.S. Provisional Application No. 62/515,401, filed Jun. 5, 2017, both of which are incorporated by reference herein in their entireties.

In some embodiments, the club head can comprise adjustable weights, such as one or more weights movable along weight tracks formed in the sole and/or perimeter of the club head. Other exemplary weights can be adjusted by rotating the weights within threaded weight ports. Various ribs, struts, mass pads, and other structures can be included inside the body to provide reinforcement, adjust mass distribution and MOI properties, adjust acoustic properties, and/or for other reasons.

Wood-type club heads, such as the club head 2, have a volume, typically measured in cubic-centimeters ($cm^3$), equal to the volumetric displacement of the club head, assuming any apertures are sealed by a substantially planar surface. (See United States Golf Association "Procedure for Measuring the Club Head Size of Wood Clubs," Revision 1.0, Nov. 21, 2003). In the case of a driver, the golf club head can have a volume between approximately 250 $cm^3$ and approximately 600 $cm^3$, such as between approximately 300 $cm^3$ and approximately 500 $cm^3$, and can have a total mass between approximately 145 g and approximately 260 g. In the case of a fairway wood, the golf club head can have a volume between approximately 120 $cm^3$ and approximately 300 $cm^3$, and can have a total mass between approximately 115 g and approximately 260 g. In the case of a utility or hybrid club, the golf club head can have a volume between approximately 80 $cm^3$ and approximately 140 $cm^3$, and can have a total mass between approximately 105 g and approximately 280 g.

The sole 14 is defined as a lower portion of the club head 2 extending upwards from a lowest point of the club head when the club head is ideally positioned, i.e., at a proper address position relative to a golf ball on a level surface. In some implementations, the sole 14 extends approximately 50% to 60% of the distance from the lowest point of the club head to the crown 12, which in some instances, can be approximately 15 mm for a driver and between approximately 10 mm and 12 mm for a fairway wood.

Materials which may be used to construct the body 10, including the face plate 18, can include composite materials (e.g., carbon fiber reinforced polymeric materials), titanium or titanium alloys, steels or alloys of steel, magnesium alloys, copper alloys, nickel alloys, and/or any other metals or metal alloys suitable for golf club head construction. Other materials, such as paint, polymeric materials, ceramic materials, etc., can also be included in the body. In some embodiments, the body including the face plate can be made of a metallic material such as titanium or titanium alloys (including but not limited to 9-1-1 titanium, 6-4 titanium, 3-2.5, 6-4, SP700, 15-3-3-3, 10-2-3, or other alpha/near alpha, alpha-beta, and beta/near beta titanium alloys), or aluminum and aluminum alloys (including but not limited to 3000 series alloys, 5000 series alloys, 6000 series alloys, such as 6061-T6, and 7000 series alloys, such as 7075), Ti Grade 9 (Ti-3Al-2.5V) having a chemical composition of ≤3.5-2.5% Al; ≤3.0-2.0% V; ≤0.02% N; ≤0.013% H; ≤0.12 Fe.

Aspects of Investment Casting

Injection molding is used to form sacrificial "initial" patterns (e.g., made of casting "wax") of the desired castings. A suitable injection die can be made of aluminum, or other suitable metal or metal alloy, or other material, e.g., by a computer-controlled machining process using a casting master. CNC (computer numerical control) machining can be used to form the intricacies of the mold cavity in the die. The cavity dimensions are established so as to compensate for linear and volumetric shrinkage of the casting wax encountered during casting of the initial pattern and also to compensate for any similar shrinkage phenomena expected to be encountered during actual metal casting performed later using an investment-casting "shell" formed from the initial pattern.

Usually, a group of initial patterns is assembled together and attached to a central wax sprue to form a casting "cluster." Each initial pattern in the cluster forms a respective mold cavity in the casting shell formed later around the cluster. The central wax sprue defines the locations and configurations of runner channels and gates for routing molten metal, introduced into the sprue, to the mold cavities in the casting shell. The runner channels can include one or more filters (made, e.g., of ceramic) for enhancing smooth laminar flow of molten metal into and in the casting shell and for preventing entry of any dross, that may be trapped in the mold, into the shell cavities.

The casting shell is constructed by immersing the casting cluster into a liquid ceramic slurry, followed by immersion in a bed of refractory particles. This immersion sequence is repeated as required to build up a sufficient wall thickness of ceramic material around the casting cluster, thereby forming an investment-casting shell. An exemplary immersion sequence includes six dips of the casting cluster in liquid ceramic slurry and five dips in the bed of refractory particles, yielding an investment-casting shell comprising alternating layers of ceramic slurry and refractory material. The first two layers of refractory material desirably comprise fine (300 mesh) zirconium oxide particles, and the third to fifth layers of refractory material can comprise coarser (200 mesh to 35 mesh) aluminum oxide particles. Each layer is dried under controlled temperature (25±5° C.) and relative humidity (50±5%) before applying the subsequent layer.

The investment-casting shell is placed in a sealed steam autoclave in which the pressure is rapidly increased to 7-10 kg/cm$^2$. Under such a condition, the wax in the shell is melted out using injected steam. The shell is then baked in an oven in which the temperature is ramped up to 1000-1300° C. to remove residual wax and to increase the strength of the shell. The shell is now ready for use in investment casting.

After the club-head is designed and the initial pattern is made, the manufacturing effort is shifted to a metal caster. To make the investment-casting shell, the metal caster first configures the cluster comprising multiple initial patterns for individual club-heads. Configuring the cluster also involves configuring the metal-delivery system (gates and runners for later delivery of molten metal). After completing these tasks, the caster tools up to fabricate the casting shells.

Figure 12:
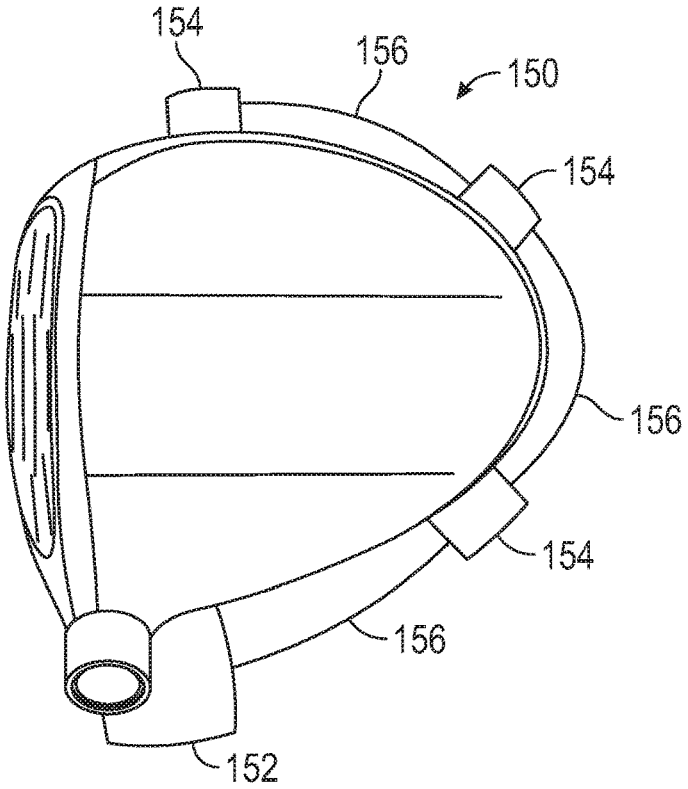
FIG. 12 is a top view of an exemplary initial pattern for a wood-type club head, showing a main gate, assistant gates, and flow channels.

An important aspect of configuring the cluster is determining the locations at which to place the gates. A mold cavity for an individual club-head usually has one main gate, through which molten metal flows into the mold cavity. Additional auxiliary ("assistant") gates can be connected to the main gate by flow channels. During investment casting using such a shell, the molten metal flows into each of the mold cavities through the respective main gates, through the flow channels, and through the auxiliary gates. This manner of flow requires that the mold for forming the initial pattern of a club-head also define the main gate and any assistant gates. After molding the wax initial pattern of the club-head, the initial pattern is removed from the mold, and the locations of flow channels are defined by "gluing" (using the same wax) pieces of wax between the gates. Reference is made to FIG. 12, which depicts an initial pattern 150 for a metal-wood clubhead. Shown are the main gate 152 and three assistant gates 154. Flow channels 156 interconnect the assistant gates 154 and main gate 152 to one another.

Multiple initial patterns for respective club-heads are then assembled into the cluster, which includes attaching the individual main gates to "ligaments." The ligaments include the sprue and runners of the cluster. A "receptor," usually made of graphite or the like, is placed at the center of the cluster where it later will be used to receive the molten metal and direct the metal to the runners. The receptor desirably has a "funnel" configuration to aid entry-flow of molten metal. Additional braces (made of, e.g., graphite) may be added to reinforce the cluster structure.

Usually, the overall wax-cluster is sufficiently large (especially if the furnace chamber that will be used for forming the shell is large) to allow pieces of wax to be "glued" to individual branches of the cluster first, followed by ceramic coating of the individual branches separately before the branches are assembled together into the cluster. Then, after assembling together the branches, the cluster is transferred to the shell-casting chamber.

Figure 13:
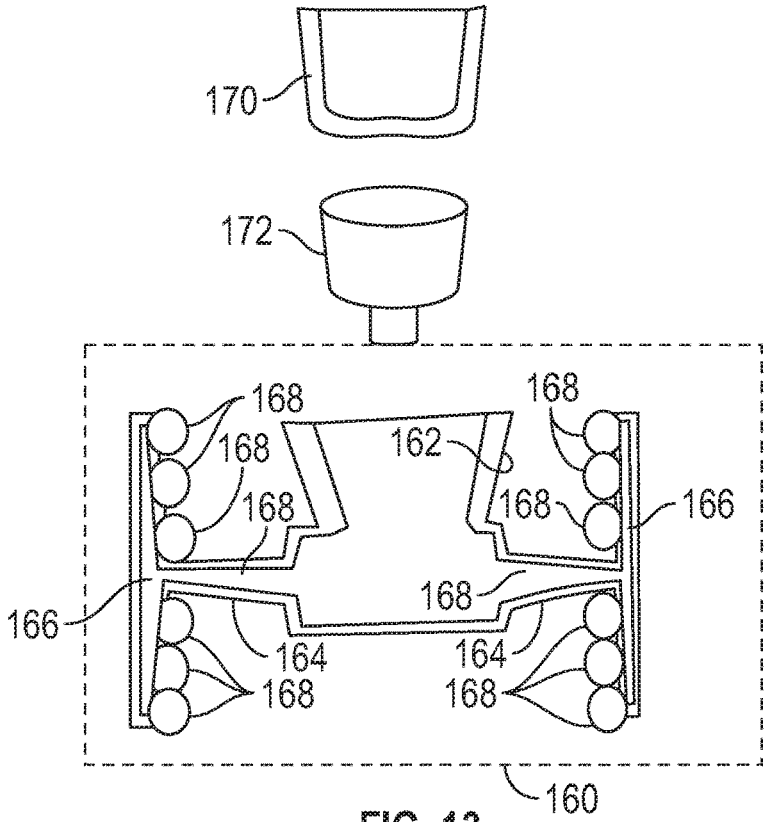
FIG. 13 is a schematic depiction of a casting cluster comprising multiple mold cavities.
Figure 14:
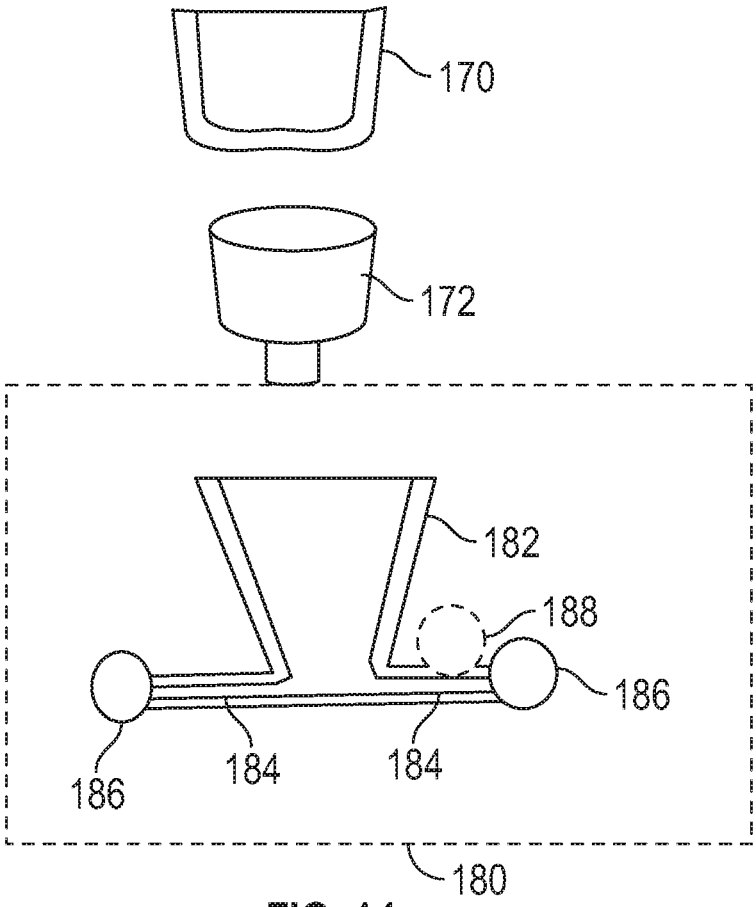
FIG. 14 is a schematic depiction of another casting cluster comprising multiple mold cavities.

Two exemplary clusters are shown in FIGS. 13 and 14, respectively. In FIG. 13, the depicted cluster 160 comprises a graphite receptor 162, a graphite cross-spoke 164, runners 166, and mold cavities 168. Each mold cavity 168 is for a respective club-head. Molten metal in a crucible 170 is poured into the cluster 160 using a pouring cup 172, which directs the molten metal into the receptor 162, into the branches 166, and then into the mold cavities 168. In FIG. 14, the depicted cluster 80 comprises a receptor 182 coupled to shell runners 184. Mold cavities are of two types in this configuration, "straight-feed" cavities 186 and "side feed" cavities 188. Molten metal in a crucible 170 is poured into the cluster 180 using a pouring cup 172, which directs the molten metal into the receptor 182, into the shell runners 184, and then into the mold cavities 186, 188.

The reinforced wax cluster is then coated with multiple layers of slurry and ceramic powders, with drying being performed between coats. After forming all the layers, the resulting investment-casting shell is autoclaved to melt the wax inside it (the ceramic and graphite portions are not melted). After removing the wax from the shell, the shell is sintered (fired), which substantially increases its mechanical strength. If the shell will be used in a relatively small metalcasting furnace (e.g., capable of holding a cluster of only one branch), the shell can now be used for investment casting. If the shell will be used in a relatively large metal-casting furnace, the shell can be assembled with other shell branches to form a large, multi-branched cluster.

Modern investment casting of metal alloys is usually performed while rotating the casting shell in a centrifugal manner to harness and exploit the force generated by the $\omega^2 r$ acceleration of the shell undergoing such motion, where $\omega$ is the angular velocity of the shell and r is the radius of the angular motion. This rotation is performed using a turntable situated inside a casting chamber under a sub atmospheric pressure. The force generated by the $\omega^2 r$ acceleration of the shell urges flow of the molten metal into the mold cavities without leaving voids. The investment-casting shell (including its constituent clusters and runners) is generally assembled outside the casting chamber and heated to a pre-set temperature before being placed as an integral unit on the turntable in the chamber. After mounting the shell to the turntable, the casting chamber is sealed and evacuated to a pre-set sub atmospheric-pressure ("vacuum") level. As the chamber is being evacuated, the molten alloy for casting is prepared, and the turntable commences rotating. When the molten metal is ready for pouring into the shell, the casting chamber is at the proper vacuum level, the casting shell is at a suitable temperature, and the turntable is spinning at the desired angular velocity. Thus, the molten metal is poured into the receptor of the casting shell and flows throughout the shell to fill the mold cavities in the shell.

As molten metal flows into the shell cavity and makes contact with the cavity surface, the high temperature environment (from both the molten metal and the preheated shell) encourages diffusion of elements, such as oxygen, in the shell material. Although titanium casting is always carried out under the sub atmospheric-pressure (vacuum) and oxygen is not available in the ambient environment, oxygen can still be found in the shell (as the shell consists of multiple layers of "oxides"). Introducing oxygen to the molten titanium causes the formation of an oxygen-rich layer, the alpha-case, on the surface of the titanium object to be cast. Typically, the thickness of the alpha-case is on the order of 1-4% of the thickness of the object.

As the alpha-case is "enriched" with oxygen, it is brittle (oxygen is one of the most effective elements of increasing the strength of titanium alloys, but while the strength is increased the ductility is greatly reduced) and can easily crack upon loading. To reduce the propensity of forming alpha-case the diffusion rate of oxygen needs to be reduced, and to reduce the diffusion rate the temperature needs to be reduced. However, it is impossible to reduce the temperature of the molten titanium. Therefore, reducing the temperature of the pre-heated shell is one way of reducing the diffusion rate of oxygen, thus reducing the formation of the alpha-case.

Typically, before transferring to the casting furnace a casting shell will be heated (called pre-heating) to aid the flow of molten titanium. The higher the pre-heat temperature of the shell, the easier the flow of titanium. This is essential for thin-wall titanium casting and the pre-heat temperature can be as high as 1100-1200 C. On the other hand, such high temperatures tend to produce thick alpha-case layers (towards the higher end of the 1-4% wall thickness range). Therefore, the pre-heat temperature of a casting shell can be lowered if the formation of alpha-case is a concern. Typically, the pre-heat temperature of a casting shell is lower than 1000 C or, preferably, lower than 900 C for non-flow-critical titanium castings where formation of alpha-case is undesirable.

Cluster Casting Methods

Figure 15:
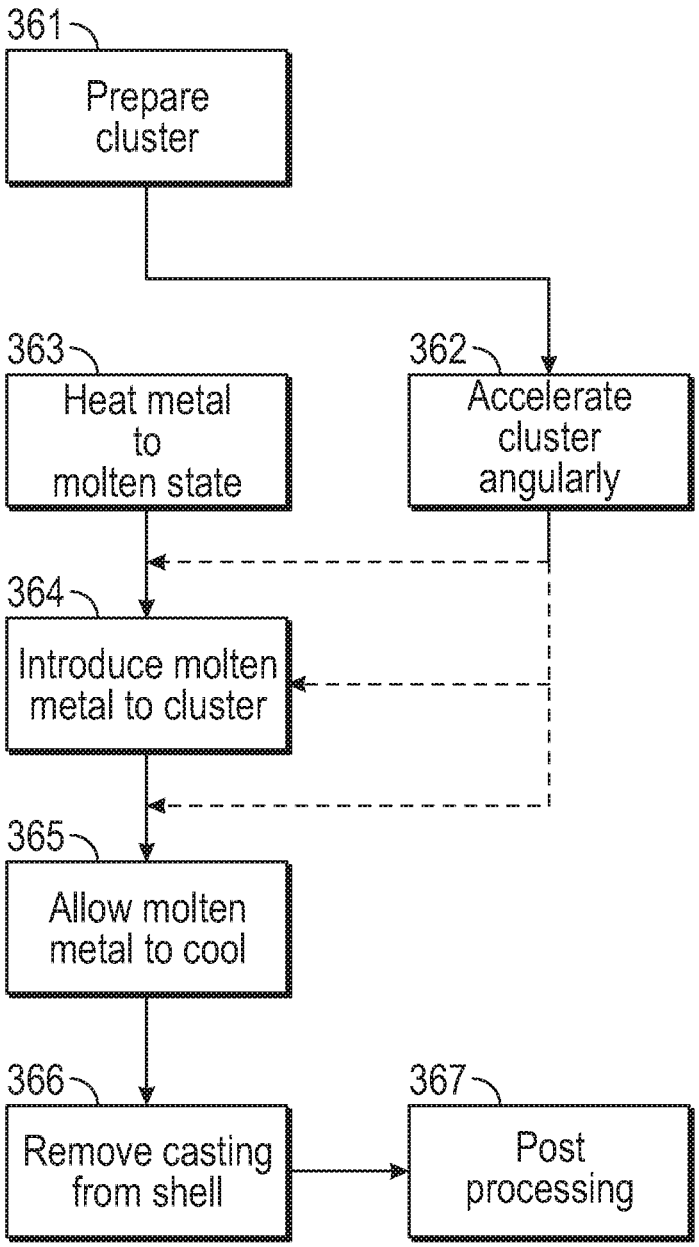
FIG. 15 is a work flow diagram indicating a method for casting golf club heads.

As seen with reference to FIG. 15, a method of manufacturing golf club heads involves preparing a cluster as disclosed elsewhere in this disclosure as shown with reference to step 361. In various embodiments, the step of preparing a cluster may include a preheat step as disclosed elsewhere herein. One aspect of the current disclosure is that cluster preheat may be lower than needed for traditional investment casting techniques. For example, with traditional investment casting techniques, preheat may be on the order of 1000 C-1400 C; with centrifugal casting of the current disclosure, temperatures of preheat may be less than 1,000 C in some embodiments; less than 800 C in some embodiments; or about 500 C or less in some embodiments. In some embodiments, no preheat is needed, and casting may occur with the shell at room temperature. When the cluster is prepared, it may be accelerated angularly in accord with step 362. Metal may be by heated to molten state concurrent with cluster preparation and/or cluster acceleration, or may be an intermediate step. However, metal may be heated to molten state in accord with step 363. Molten metal is introduced to the cluster in accord with step 364. As indicated by the broken line leading from step 362 to step 364, the cluster may be angularly accelerated before, after, or concurrently with the introduction of molten metal to the cluster. Molten metal is allowed to cool in accord with step 365. The cluster casting is removed from the cluster shell in step 366, and post-processing occurs in accord with step 367 and beyond.

In some embodiments, step 363 includes heating metal to molten state. In various embodiments, heating temperatures may be higher or lower depending on application. In some embodiments, step 362 includes accelerating the cluster angularly to an angular velocity, e.g., about 360 revolutions per minute. In various embodiments, angular speeds may range from 250-450 revolutions per minute. In various embodiments, angular speeds as low as 150 rpm and as high as 600 rpm may be suitable.

Because of lower casting temperatures, the step of allowing molten metal to cool in the mold cluster includes a reduced waiting time as compared to traditional investment-casting processes. The result is improved yield and better cycle times. In various traditional investment casting methods that rely on gravity, casting of only 6-8 maximum parts was possible. Using centrifugal casting, 18-25 parts or more may be cast in one cycle, thereby increasing production capacity for a single casting cycle. Additionally, yield per gram of pour is also increased. For traditional investment casting methods, a certain mass of metal is used to cast a certain number golf club heads. With spin casting techniques of the current disclosure, the same mass of metal can be used to produce more golf club heads. Improvements and honing of the techniques in the current disclosure can reduce this mass of metal/per head even further. Reduced cycle times can also be present depending on particular methodology. Additionally, the methods described herein lead to reduced tooling and capital expenditure required for the same production demand. As such, methods described herein reduce cost and improve production quality.

Additionally, casting according to the method described herein leads to a savings in material and achieve greater throughput because material can be more easily flowed to a greater number of heads given the increased acceleration and, thereby, force applied to the casting. Finally, alloys that typically are manufactured using other methods may be more easily cast to similar geometries.

Gating and Cluster Configurations

Configuring the gates and the cluster(s) involves consideration of multiple factors. These include (but are not necessarily limited to): (a) the dimensional limitations of the casting chamber of the metal-casting furnace, (b) handling requirements, particularly during the slurry-dipping steps that form the investment-casting shell, (c) achieving an optimal flow pattern of the molten metal in the investment-casting shell, (d) providing the cluster(s) of the investment-casting shell with at least minimum strength required for them to withstand rotational motion during metal casting, (e) achieving a balance of minimum resistance to flow of molten metal into the mold cavities (by providing the runners with sufficiently large cross-sections) versus achieving minimum waste of metal (e.g., by providing the runners with small cross-sections), and (f) achieving a mechanical balance of the cluster(s) about a central axis of the casting shell. Item (e) can be important because, after casting, any metal remaining in the runners does not form product but rather may be "contaminated" (a portion of which is usually recycled). These configurational factors are coupled with metal-casting parameters such as shell-preheat temperature and time, vacuum level in the metal-casting chamber, and the angular velocity of the turntable to produce actual casting results. As club-head walls are made increasingly thinner, careful selection and balance of these parameters are essential to produce adequate investment-casting results.

Details of investment casting as performed at metal casters tend to be proprietary. But, experiments at various titanium casters have in the past revealed some consistencies and some general trends. For example, a particular club-head (having a volume of 460 $cm^3$, a crown thickness of 0.6 mm, and a sole thickness of 0.8 mm) was fabricated at each of six titanium casters (having respective metal-casting furnaces ranging from 10 kg to 80 kg capacity), producing the data tabulated in FIGS. 16 and 17. The parameters listed in FIGS. 16 and 17 include the following:

"R max" is the maximum radius of the cluster

"R min" is the minimum radius of the cluster

"Wet perimeter" is the total perimeter of the runner

"R (flow radius)" is the cross-sectional area/wet perimeter of the runner

"Sharp turn" is a 90-degree or greater turn in the runner system

"Process loss ratio" is the ratio of process loss to pouring material

"Velocity max" is the velocity at the maximum radius

"Velocity min" is the velocity at the minimum radius

"Acceleration max" is the acceleration at the maximum radius

"Acceleration min" is the acceleration at the minimum radius

"Force max" is the force at the maximum radius (note that this is an approximation of the magnitude of force being applied to the molten metal at a gate. Due to each particular cluster design, the true force is almost always lower than the calculated value, with more complex clusters exhibiting greater reduction of the force.)

"Force min" is the force at the minimum radius (note that this is an approximation of the magnitude of force being applied to the molten metal at the gate. Due to each particular cluster design, the true force is almost always lower than the calculated value, with more complex clusters exhibiting greater reduction of the force.)

"Pressure max" is the pressure of molten metal in the runner at maximum radius (=Force max/Runner cross-sectional area)

"Pressure min" is the pressure of molten metal in the runner at minimum radius (=Force min/Runner cross-sectional area)

"Kinetic energy max" is the kinetic energy of molten metal at the maximum radius "Density" is the density of molten metal (titanium alloy) at the melting point of 1650 C.

"Viscosity" is the viscosity of molten titanium at 1650 C

"Re number max" is the Reynolds number for pipe flow at maximum radius

"Re number min" is defined consistently as Re number max, but at a minimum radius.

Minimum Force Requirement

FIGS. 16 and 17 provide a table of data that indicates that at least a minimum force (and thus at least a minimum pressure) should be applied to the molten metal entering the casting shell for each cluster to achieve a good casting yield. The force applied to the molten metal is generated in part by the mass of actual molten metal entering the mold cavities in the cluster and by the centrifugal force produced by the rotating turntable of the casting furnace. A reduced minimum force is desirable because a lower force generally allows a reduction in the amount, per club-head, of molten metal necessary for casting. However, other factors tend to indicate increasing this force, including: thinner wall sections in the item being cast, more complex clusters (and thus more complex flow patterns of the molten metal), reduced shell-preheat temperatures (resulting in a greater loss of thermal energy from the molten metal as it flows into the investment-casting shell), and substandard shell qualities such as rough mold-cavity walls and the like. The data in FIGS. 16 and 17 indicate that the minimum force required for casting a titanium-alloy club-head, of which at least a portion of the wall is 0.6 mm thick, is approximately 160 Nt. Caster 1 achieved this minimum force.

From the minimum-force requirement can be derived a lower threshold of the amount of molten metal necessary for pouring into the shell. Excluding unavoidable pouring losses, the best metal usage (as achieved by caster 1) was 386 g (0.386 kg) for club-heads each having a mass of approximately 200 g (including gate and some runner). This is equivalent to a material-usage ratio of 200/386=52 percent. The accelerations (max) applied to the investment-casting shell by the casters 2-6 were all higher than the acceleration applied by caster 1, but more molten metal was needed by each of casters 2-6 to produce respective casting yields that were equivalent to that achieved by caster 1.

Figure 18:
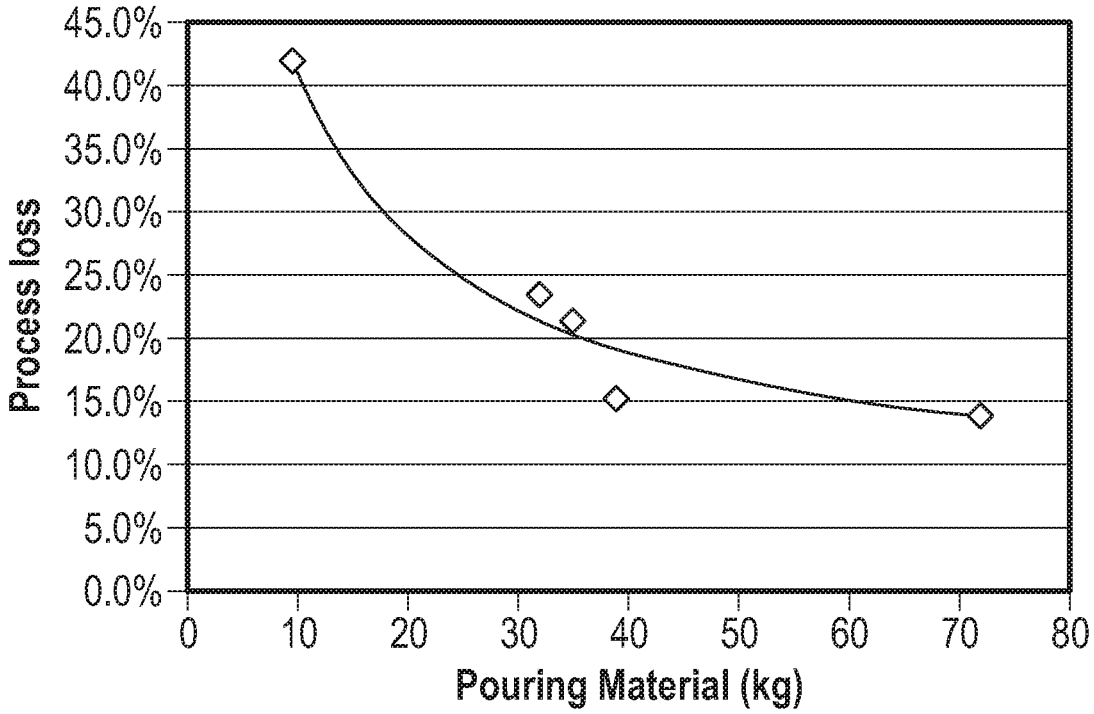
FIG. 18 is a plot of process loss versus mass of pouring material (molten metal), for titanium alloy the latter being indicative of casting-furnace size for the various casters.

Some process loss (splashing, cooled metal adhering to side walls of the crucible and coup supplying the liquid titanium alloy, revert cleaning loss, and the like) is unavoidable. Process loss imposes an upper limit to the efficiency that can be achieved by smaller casting furnaces. i.e., the percentage of process loss increases rapidly with decreases in furnace size, as illustrated in FIG. 18.

On the other hand, smaller casting furnaces advantageously have simpler operation and maintenance requirements. Other advantages of smaller furnaces are: (a) they tend to process smaller and simpler clusters of mold cavities, (b) smaller clusters tend to have separate respective runners feeding each mold cavity, which provides better interface-gating ratios for entry of molten metal into the mold cavities, (c) the furnaces are more easily and more rapidly preheated prior to casting, (d) the furnaces offer a potentially higher achievable shell-preheat temperature, and (e) smaller clusters tend to have shorter runners, which have lower Reynolds numbers and thus pose reduced potentials for disruptive turbulent flow. While larger casting furnaces tend not to have these advantages, smaller casting furnaces tend to have more unavoidable process loss of molten metal per mold cavity than do larger furnaces.

In view of the above, the cost-effective casting systems (furnaces, clusters, yields, net material costs) appear to include medium-sized systems, so long as appropriate cluster- and gate-design considerations are incorporated into configurations of the investment-casting shells used in such furnaces. This can be seen from comparing casters 1, 4, and 5. The overall usages of material (without considering process losses) by these three casters are very close (664-667 g/cavity). Material usage (considering process loss) by caster 1 is 386 g, while that of casters 4 and 5 is 510 g. Thus, whereas casters 4 and 5 could still improve, it appears that caster 1 has reached its limit in this regard.

Flow-Field Considerations

At least the minimum threshold force applied to molten metal entering the investment-casting shell can be achieved by either changing the mass or increasing the velocity of the molten metal entering the shell, typically by decreasing one and increasing the other. There is a realistic limit to the degree to which the mass of "pour material" (molten metal) can be reduced. As the mass of pour material is reduced, correspondingly more acceleration is necessary to generate sufficient force to move the molten metal effectively into the investment-casting shell. But, increasing the acceleration increases the probability of creating turbulent flow of the molten metal entering the shell. Turbulent flow is undesirable because it disrupts the flow pattern of the molten metal. A disrupted flow pattern can require even greater force to "push" the metal though the main gate into the mold cavities.

The Reynolds number can be easily modified by changing the shape and/or dimensions of the runner(s). For example, changing R (flow radius) will affect the Reynolds number directly. The smaller R (flow radius) will result in less minimum force (the two almost having a reciprocal relationship). Hence, an advantageous consideration is first to reduce the Reynolds number to maintain a steady flow field of the molten metal, and then satisfy the requirement of minimum force by adjusting the amount of pour material.

Other Factors

One additional factors is preheating the investment-casting shell before introducing the molten metal to it. Caster 1 achieved 94% yield with the smallest Reynolds number and the minimum amount of pour material (and thus the lowest force) in part because caster 1 had the highest shell-preheat temperature. Another factor is the complexity of the cluster(s). Evaluating a complex cluster is very difficult, and the high Reynolds numbers usually exhibited by such clusters are not the only variable to be controlled to reduce disruptive turbulent flow of molten metal in such clusters. For example, the number of "sharp" turns (90-degree turns or greater) in runners and mold cavities of the cluster is also a factor. In regard to FIGS. 16 and 17, the investment-casting shell used by caster 1 has one sharp turn (and another less-sharp turn), whereas the shell used by caster 6 has three sharp turns. It is possible that caster 6 needs to rotate its shell at a higher angular velocity just to overcome the flow resistance posed by these sharp turns. But, this would not alleviate disrupted flow patterns posed by the sharp turns. Hence, investment-casting shells comprising simpler cluster (s) (with fewer sharp turns to allow more "natural" flow routes of molten metal) are desired.

Another factor is matching the runner and gates. The interface gating ratio for caster 1 is the closest to 100% (indicating optimal gating), compared to the substantially inferior data from the other casters. The "worst" was caster 3, whose investment-casting shell had a Reynolds number almost as low as that of caster 1, but caster 3 achieved a yield of only 78%, due to a poor interface gating ratio (approximately 23%). The low interface gating ratio exhibited by the shell of caster 3 increased the difficulty of determining whether the cause of caster 3's low yield was insufficient pour material to fill the gates or the occurrence of "two-phase flow-liquid and vacancy." In any event, the overall cross-sectional areas of runners and gates may be kept as nearly equal (and constant) to each other as possible to achieve constant flow velocity of liquid metal throughout the shell at any moment during pouring. For thin-walled titanium alloy castings, this principle applies especially to the interfaces between the runner and the main gates, where the interface gating ratio should be no less than unity (1.0).

Yet another factor is the cross-sectional shape of the runner. Comparing casters 4 and 5, and casters 2 and 5, triangular-section runners appeared to produce lower Reynolds numbers than rounded or rectangular runners. Although using triangular-section runners can cause problems with interface gating ratio (as metal flows from such a runner into a rectilinear-section or round-section gate), the significant reduction in Reynolds numbers achieved using triangular-section runners is worth pursuing as the difference in pour material used by casters 2 and 5 indicates (39 kg versus 32 kg).

Figure 19:
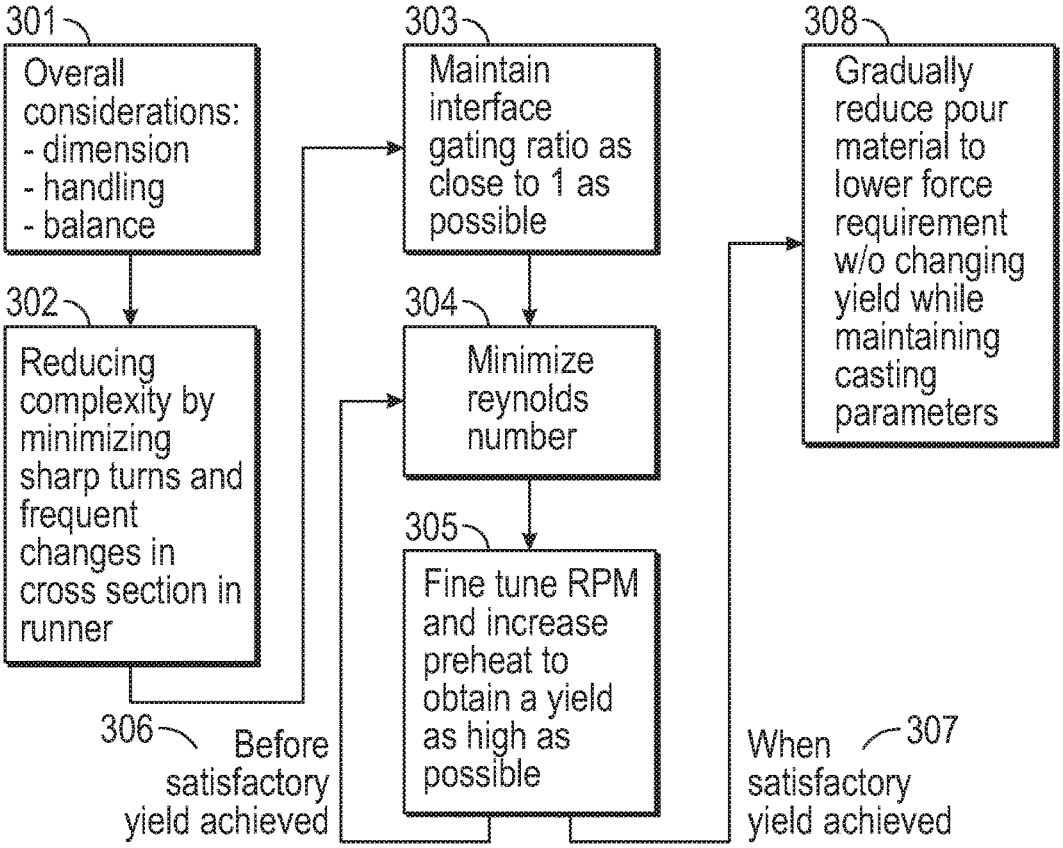
FIG. 19 is a flow chart of an embodiment of a method for configuring a casting cluster.

A flow-chart for configuring a cluster of an investment-casting shell is shown in FIG. 19. In a first step 301, overall considerations of the intended cluster are made such as dimensions, handling, and balance. Next, the complexity of the cluster is reduced by minimizing sharp turns and any unnecessary (certainly any frequent) changes in runner cross-section (step 302). The interface gating ratio is maintained as close as possible to unity (step 303). Also, the Reynolds number is minimized as much as practicable (step 304). The angular velocity (RPM) of the turntable is fine-tuned and the shell pre-heat temperature is increased to produce the highest possible product yield (step 305). Iteration (306) of steps 304, 305 is usually required to achieve a satisfactory yield. In step 308, after a satisfactory yield is achieved (307), the mass of pour material (molten metal) is gradually reduced to reduce the force required to urge flow of molten metal throughout the cluster, but without decreasing product yield and while maintaining other casting parameters.

More information regarding investment casting methods and devices for casting thin-walled club heads using titanium alloys and other materials can be found in U.S. Pat. No. 7,513,296, issued Apr. 7, 2009, and in U.S. Publication No. 2016/0175666, published Jun. 23, 2016, both of which are incorporated by reference herein in their entireties. While these incorporated references disclose methods and systems for casting club head bodies without the face plate included (face plate is later attached to body), the same or similar methods and systems can be used, with the same or similar benefits and advantages, to cast the herein disclosed club head bodies where the face in an integrally cast part of the body, not formed separately and later attached to the body.

More information regarding coatings on molds for casting titanium alloys, and methods for producing molds having a calcium oxide face coat for use in casting titanium alloys, can be found in U.S. Pat. No. 5,766,329, issued Jun. 16, 1998, which is incorporated by reference herein in its entirety.

Club Heads Comprising Cast Titanium Alloy Body/Face

Compared to titanium golf club faces formed for sheet machining or forging processes, cast faces can have the advantage of lower cost and complete freedom of design. However, golf club faces cast from conventional titanium alloys, such as 6-4 Ti, need to be chemically etched to remove the alpha case on one or both sides so that the faces are durable. Such etching requires application of hydrofluoric (HF) acid, a chemical etchant that is difficult to handle, extremely harmful to humans and other materials, an environmental contaminant, and expensive.

Faces cast from titanium alloys comprising aluminum (e.g., 8.5-9.5% Al), vanadium (e.g., 0.9-1.3% V), and molybdenum (e.g., 0.8-1.1% Mo), optionally with other minor alloying elements and impurities, herein collectively referred to a "9-1-1 Ti", can have less significant alpha case, which renders HF acid etching unnecessary or at least less necessary compared to faces made from conventional 6-4 Ti and other titanium alloys.

Further, 9-1-1 Ti can have minimum mechanical properties of 820 MPa yield strength, 958 MPa tensile strength, and 10.2% elongation. These minimum properties can be significantly superior to typical cast titanium alloys, such as 6-4 Ti, which can have minimum mechanical properties of 812 MPa yield strength, 936 MPa tensile strength, and ~6% elongation.

Golf club heads that are cast including the face as an integral part of the body (e.g., cast at the same time as a single cast object) can provide superior structural properties compared to club heads where the face is formed separately and later attached (e.g., welded or bolted) to a front opening in the club head body. However, the advantages of having an integrally cast Ti face are mitigated by the need to remove the alpha case on the surface of cast Ti faces.

With the herein disclosed club heads comprising an integrally cast 9-1-1 Ti face and body unit, the drawback of having to remove the alpha case can be eliminated, or at least substantially reduced. For a cast 9-1-1 Ti face, using a conventional mold pre-heat temperature of 1000 C or more, the thickness of the alpha case can be about 0.15 mm or less, or about 0.20 mm or less, or about 0.30 mm or less, such as between 0.10 mm and 0.30 mm in some embodiments, whereas for a cast 6-4 Ti face the thickness of the alpha case can be greater than 0.15 mm, or greater than 0.20 mm, or greater than 0.30 mm, such as from about 0.25 mm to about 0.30 mm in some examples.

In some cases, the reduced thickness of the alpha case for 9-1-1 Ti face plates (e.g., 0.15 mm or less) may not be thin enough to provide sufficient durability needed for a face plate and to avoid needing to etch away some of the alpha case with a harsh chemical etchant, such as HF acid. In such cases, the pre-heat temperature of the mold can be lowered (such as to less than 800 C, less than 700 C, less than 600 C, and/or less than or equal to 500 C) prior to pouring the molten titanium alloy into the mold. This can further reduce the amount of oxygen transferred from the mold to the cast titanium alloy, resulting in a thinner alpha case (e.g., less than 0.15 mm, less than 0.10 mm, and/or less than 0.07 mm). This provides better ductility and durability for the cast body/face unit, which is especially important for the face plate.

The thinner alpha case in cast 9-1-1 Ti faces helps provide enhanced durability, such that the face is durable enough that the removal of part of the alpha case from the face via chemical etching is not needed. Thus, hydrofluoric acid etching can be eliminated from the manufacturing process when the body and face are unitarily cast using 9-1-1 Ti, especially when using molds with lower pre-heat temperatures. This can simplify the manufacturing process, reduce cost, reduce safety risks and operation hazards, and eliminate the possibility of environmental contamination by HF acid. Further, because HF acid is not introduced to the metal, the body/face, or even the whole club head, can comprise very little or substantially no fluorine atoms, which can be defined as less than 1000 ppm, less than 500 ppm, less than 200 ppm, and or less than 100 ppm, wherein the fluorine atoms present are due to impurities in the metal material used to cast the body.

Variable Face Thickness and Bulge & Roll Properties of Faces

In certain embodiments, a variable thickness face profile may be implemented on the face plate, for example as is described in U.S. patent application Ser. No. 12/006,060 and U.S. Pat. Nos. 6,997,820; 6,800,038; 6,824,475; 7,731,603; and 8,801,541; the entire contents of each of which are incorporated herein by reference. Varying the thickness of a face plate may increase the size of a club head COR zone, commonly called the sweet spot of the golf club head, which, when striking a golf ball with the golf club head, allows a larger area of the face plate to deliver consistently high golf ball velocity and shot forgiveness. Also, varying the thickness of a faceplate can be advantageous in reducing the weight in the face region for re-allocation to another area of the club head. For example, as shown in FIG. 9 face plate 18 has a thickness t defined between the exterior surface 22 and the interior surface 40 facing the interior cavity of the golf club head. The face plate 18 can include a central portion 42 positioned adjacent the ideal impact location 23 on the external surface 22. The central portion 42 can have thickness that is similar to the thickness at the perimeter of the face plate, or slightly greater or less. The face plate 18 also can include a diverging portion 44 extending radially outward from the central portion 42, which may be elliptical. The interior surface 40 may be symmetrical about one or more axes and/or may be unsymmetrical about one or more axes. The thickness t of the diverging portion 44 increases in a direction radially outward from the central portion 42. The face plate 18 includes a converging portion 46 extending from the diverging portion 44 via a transition portion 48. The thickness t of the converging portion 46 substantially decreases with radially outward position from the transition portion 48. In certain instances, the transition portion 48 is an apex between the diverging and converging portions 44, 46. In other implementations, the transition portion 48 extends radially outward from the diverging portion 44 and has a substantially constant thickness t (see FIGS. 7-9).

Figure 7:
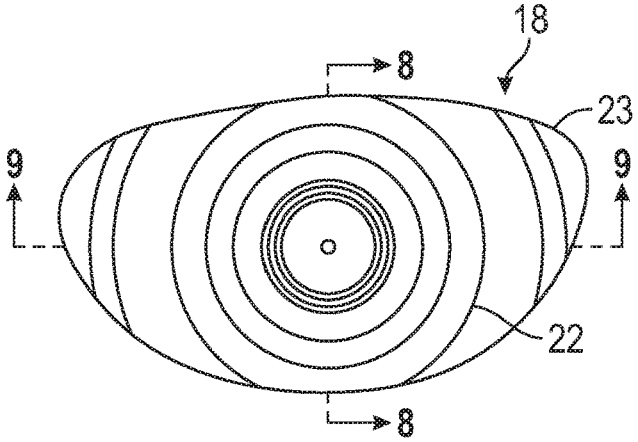
FIG. 7 is a rear elevation view of an exemplary face plate having variable thickness.
Figure 8:
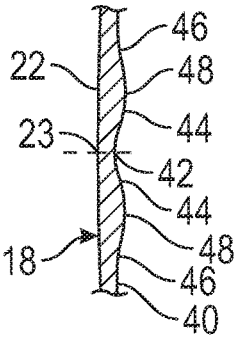
FIG. 8 is a cross-sectional side view of the face plate of FIG. 7 taken along the line 8-8 of FIG. 7.
Figure 9:
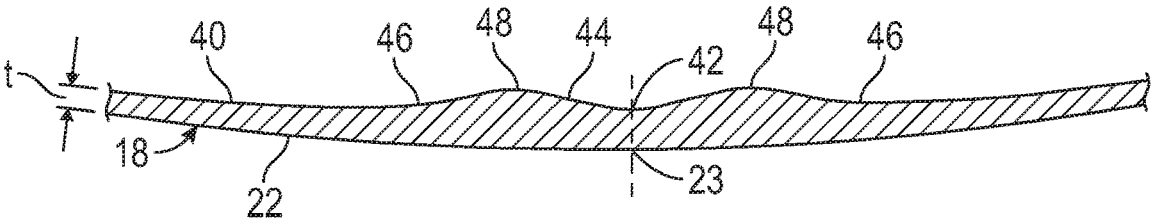
FIG. 9 is a cross-sectional side view of the face plate of FIG. 7 taken along the line 9-9 of FIG. 7.

In some embodiments, the cross-sectional profile of the face plate 18 along any axes extending perpendicular to the face plate at the ideal impact location 23 is substantially similar as in FIGS. 7-9. In other embodiments, the cross-sectional profile can vary, e.g., is non-symmetric. For example, in certain implementations, the cross-sectional profile of the face plate 18 along the head origin z-axis might include central, transition; diverging and converging portions as described above (see FIGS. 7-9). However, the cross-sectional profile of the face plate 18 along the head origin x-axis can include a second diverging portion extending radially from the converging portion 46 and coupled to the converging portion via a transition portion. In alternative embodiments, the cross-sectional profile of the face plate 18 along the head origin z-axis can include a second diverging portion extending radially from the converging portion and coupled to the converging portion, as described above with regard to variation along the head origin x-axis.

In some embodiments of a golf club head having a face plate with a protrusion, the maximum face plate thickness is greater than about 4.8 mm, and the minimum face plate thickness is less than about 2.3 mm. In certain embodiments, the maximum face plate thickness is between about 5 mm and about 5.4 mm and the minimum face plate thickness is between about 1.8 mm and about 2.2 mm. In yet more particular embodiments, the maximum face plate thickness is about 5.2 mm and the minimum face plate thickness is about 2 mm. The face thickness should have a thickness change of at least 25% over the face (thickest portion compared to thinnest) in order to save weight and achieve a higher ball speed on off-center hits.

In some embodiments of a golf club head having a face plate with a protrusion and a thin sole construction or a thin skirt construction, the maximum face plate thickness is greater than about 3.0 mm and the minimum face plate thickness is less than about 3.0 mm. In certain embodiments, the maximum face plate thickness is between about 3.0 mm and about 4.0 mm, between about 4.0 mm and about 5.0 mm, between about 5.0 mm and about 6.0 mm or greater than about 6.0 mm, and the minimum face plate thickness is between about 2.5 mm and about 3.0 mm, between about 2.0 mm and about 2.5 mm, between about 1.5 mm and about 2.0 mm or less than about 1.5 mm.

Figure 10:
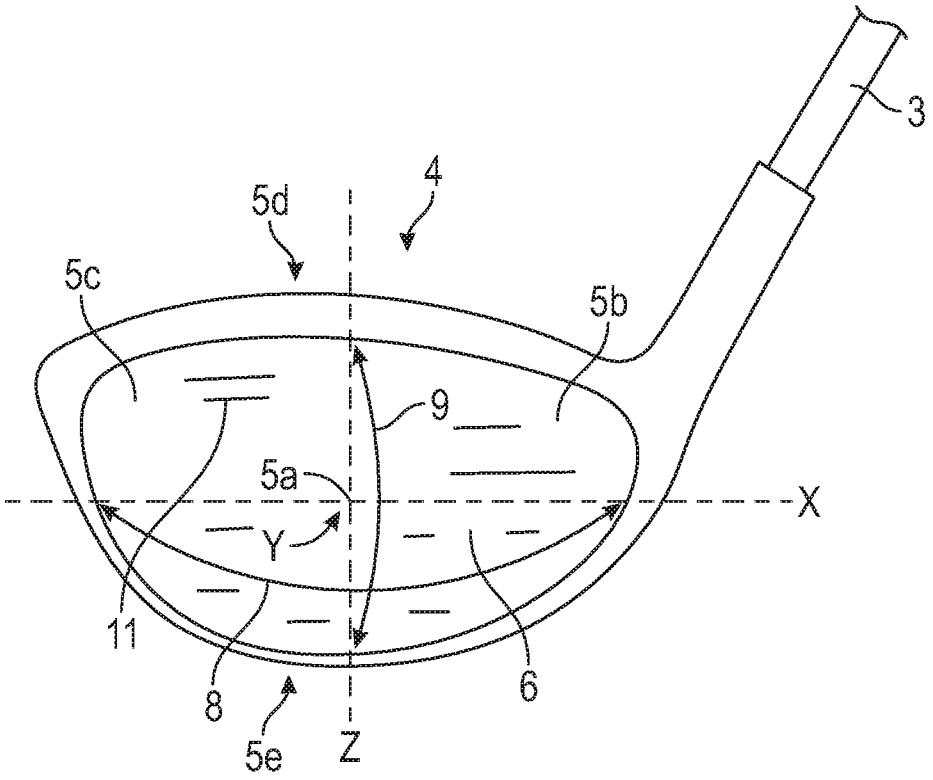
FIG. 10 is a front elevation view of the golf club heads of the present invention showing the bulge and roll measurement system.
Figure 11:
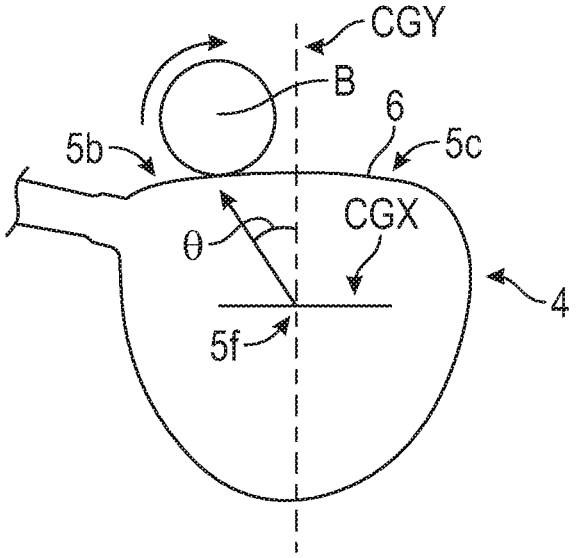
FIG. 11 is an illustration of the golf club head striking a golf ball on the heelward side of the golf club head.

FIGS. 10 and 11 show a golf club head 4 with a shaft 3. The club head 4 includes a center face 5*a*, a heel 5*b*, a toe 5*c*, a crown 5*d*, and a sole 5*e*. The club head 4 further comprises a club face 6 including a curvature from the heel 5*b* to the toe 5*c* commonly called a bulge 8. The club face 6 also includes a curvature from the crown 5*d* to the sole 5*e* commonly called a roll 9. In at least one embodiment, the combination of curvatures may provide a club face 6 with a substantially toroidal shape, or a shape similar to a section of a toroid. The club face 6 further includes an X-axis X which extends horizontally through the center face 5*a* from the heel 5*b* to the toe 5*c*, a Z-axis Z which extends vertically through the center face 5*a* from the crown 5*d* to the sole 5*e*, and a Y-axis Y which extends horizontally through the center face and into the page in FIG. 10. The X-axis X, Y-axis Y, and Z-axis Z are mutually orthogonal to one another.

As shown in FIG. 11, the club head 4 additionally has a center of gravity (CG) 5*f* which is internal to the club head. The club head 4 has a CG X-axis, a CG Y-axis, and a CG Z-axis which are mutually orthogonal to one another and pass through the CG 5*f* to define a CG coordinate system. The CG X-axis and CG Y-axis lie in a horizontal plane parallel to a flat ground surface. The CG Z-axis lies in a vertical plane orthogonal to a flat ground surface. In one embodiment the CG Y-axis may coincide with the Y-axis Y, but in most embodiments the axes do not coincide.

FIG. 11 is an exaggerated depiction of the club head 4 striking a golf ball B on the heel 5*b* of the club head. This imparts a clockwise spin to the golf ball B which causes the golf ball to curve to the right during flight. As discussed above, striking the golf ball B on the heel 5*b* of the club head 4 will cause the golf ball to leave the club head 4 at an angle Θ relative to the CG Y-axis of the club head 4. It will be understood that the angle Θ merely depicts a general angle at which the ball will leave the club head and is not intended to depict or imply the actual angle relative to the centerline, or the point from which that angle would be measured. Angle Θ further illustrates that a ball struck on the heel of the club will initially travel on a flight path to the left of the centerline.

The method used to obtain the values in the present disclosure is the optical comparator method. Referring back to FIG. 10, the club face 6 includes a series of score lines 11 which traverse the width of the club face generally along the X-axis X of the club head 4. In the optical comparator method, the club head 4 is mounted face down and generally horizontal on a V-block mounted on an optical comparator. The club head 4 is oriented such that the score lines 11 are generally parallel with the X-axis of the optical comparator. More precise orientation steps may also be used. Measurements are then taken at the geometric center point 5*a* on the club face. Further measurements are then taken 20 millimeters away from the geometric center point 5*a* of the club face 6 on either side of the geometric center point 5*a* and along the X-axis X of the club head, and 30 millimeters away from the geometric center point of the club face on either side of the center point and along the X-axis X of the club head. An arc is fit through these five measure points, for example by using the radius function on the machine. This arc corresponds to the circumference of a circle with a given radius. This measurement of radius is what is meant by the bulge radius.

To measure the roll, the club head 4 is rotated by 90 degrees such that the Z-axis Z of the club head is generally parallel to the X-axis of the machine. Measurements are taken at the geometric center point 5*a* of the club face. Further measurements are then taken 15 millimeters away from the geometric center point 5*a* and along the Z-axis Z of the club face 6 on either side of the center point 5*a*, and 20 millimeters away from the geometric center point and along the Z-axis of the club face on either side of the center point. An arc is fit through these five measurement points. This arc corresponds to the circumference of a circle with a given radius. This measurement of radius is what is meant by the roll radius.

Curvature is defined as 1/R wherein R is the radius of the circle which corresponds to the measurement arc of the bulge or the roll. As an example, a bulge with a curvature of 0.020 $cm^{-1}$ corresponds to a bulge measured by a bulge measurement arc which is part of a circle with a radius of 50 cm. A roll with a curvature of 0.050 $cm^{-1}$ corresponds to a roll measured by a roll measurement arc which is part of a circle with a radius of 20 cm.

In some embodiments, the face plates of the disclosed club heads can have the following properties:

i) the roll curvature is between about 0.033 $cm^{-1}$ and about 0.066 $cm^{-1}$, and the bulge curvature is greater than 0 $cm^{-1}$ and less than about 0.027 $cm^{-1}$; and ii) the inverse of the bulge curvature is greater than the inverse of the roll curvature by at least 7.62 cm; and/or iii) the ratio of the bulge curvature divided by the roll curvature, Ro is greater than about 0.28 and less than about 0.75.

Use of vacuum die casting to produce the club heads described herein results in improved quality and reduced scrap. In addition rejections due to high porosity are virtually eliminated as are rejections after any secondary processing. An excellent surface quality is produced while increasing product density and strength are increased and thus making possible larger, thinner, and more complex, castings. From a processing standpoint, less casting pressure is required, and tool life and mold life are extended. Also waste of the metal or alloy due to flash is reduced or eliminated.

By utilizing a vacuum die casting process, it has been surprisingly found that the titanium bodies and face plates of the disclosed club heads exhibit much smaller grain size than is typically observed for analogous titanium objects made by investment casting, with grains of about 100 μm (micrometers) in size versus about 750 μm grain size for investment cast titanium face plates. More specifically, the titanium bodies/face plates disclosed herein can have a grain size of less than about 400 μm, preferably less than about 300 μm, more preferably less than about 200 μm and even more preferably less than about 150 μm, and most preferably less than about 120 μm.

The titanium bodies/face plates disclosed herein can also exhibit much lower porosity than is typically observed for an analogous separately formed titanium face plate made by investment casting. More specifically, the titanium face plates disclosed herein can have a porosity of less than 1% preferably less than 0.5% more preferably less than 0.1%.

The titanium bodies/face plates disclosed herein can also exhibit much higher yield strength, as measured by ASTM E8, than is typically observed for an analogous titanium face plate made by investment casting.

The titanium face plates disclosed here can also exhibit similar fracture toughness to that typically observed for an analogous titanium face plates made by investment casting, and higher than an analogous face plate made from a wrought mill-annealed product.

The titanium face plates disclosed herein can also exhibit ductility as measured by the percent elongation reported in a tensile test which is defined as the maximum elongation of the gage length divided by the original gage length of from about 10% to about 15%.

The titanium face plates disclosed herein can also exhibit a Young's Modulus of 100 GPa+/−10%, preferably +/−5% and more preferably +/−2% as measured by ASTM E-111.

The titanium face plates disclosed herein can also exhibit an Ultimate Tensile Strength of 970 MPa+/−10%, preferably +/−5% and more preferably +/−2% as measured by ASTM E8.

Combination of the various properties described above allows fabrication of metalwood titanium club heads having titanium face plates that can be 10% thinner than the analogous face plates made by conventional investment casting while maintaining as good if not better strength properties.

In addition to the strength properties of the golf club heads of the present invention, in certain embodiments, the shape and dimensions of the golf club head may be formed so as to produce an aerodynamic shape as according to U.S. Patent Publication No. 2013/0123040 A1, filed on Dec. 18, 2012 to Willett et al., the entire contents of which are incorporated by reference herein. The aerodynamics of golf club heads are also discussed in detail in U.S. Pat. Nos. 8,777,773; 8,088,021; 8,540,586; 8,858,359; 8,597,137; 8,771,101; 8,083,609; 8,550,936; 8,602,909; and 8,734,269; the teachings of which are incorporated by reference herein in their entirety.

In addition to the strength properties of the aft body, and the aerodynamic properties of the club head, another set of properties of the club head which must be controlled are the acoustical properties or the sound that a golf club head emits when it strikes a golf ball. At club head/golf ball impact, a club striking face is deformed so that vibrational modes of the club head associated with the club crown, sole, or striking face are excited. The geometry of most golf clubs is complex, consisting of surfaces having a variety of curvatures, thicknesses, and materials, and precise calculation of club head modes may be difficult. Club head modes can be calculated using computer-aided simulation tools. For the club heads of the present invention the acoustic signal produced with ball/club impact can be evaluated as described in in copending U.S. application Ser. No. 13/842,011 filed on Mar. 15, 2013, the entire contents of which are incorporated by reference herein.

In certain embodiments of the present invention the golf club head may be attached to the shaft via a removable head-shaft connection assembly as described in more detail in U.S. Pat. No. 8,303,431 issued on Nov. 6, 2012, the entire contents of which are incorporated by reference herein. Further in certain embodiments, the golf club head may also incorporate features that provide the golf club heads and/or golf clubs with the ability not only to replaceably connect the shaft to the head but also to adjust the loft and/or the lie angle of the club by employing a removable head-shaft connection assembly. Such an adjustable lie/loft connection assembly is described in more detail in U.S. Pat. No. 8,025,587 issuing on Sep. 27, 2011, U.S. Pat. No. 8,235,831 issued on Aug. 7, 2012, U.S. Pat. No. 8,337,319 issued on Dec. 25, 2012, as well as copending US Publication No. 2011/0312437A1 filed on Jun. 22, 2011, US Publication No. 2012/0258818 A1 filed on Jun. 20, 2012, US Publication No. 2012/0122601A1 filed on Dec. 29, 2011, US Publication No. 2012/0071264 A1 filed on Mar. 22, 2011 as well as copending U.S. application Ser. No. 13/686,677 filed on Nov. 27, 2012, the entire contents of which patents, publications and applications are incorporated in their entirety by reference herein.

In certain embodiments the golf club head may feature an adjustable mechanism provided on the sole portion to "decouple" the relationship between face angle and hosel/shaft loft, to allow for separate adjustment of square loft and face angle of a golf club. For example, some embodiments of the golf club head may include an adjustable sole portion that can be adjusted relative to the club head body to raise and lower the rear end of the club head relative to the ground. Further detail concerning the adjustable sole portion is provided in U.S. Pat. No. 8,337,319 issued on Dec. 25, 2012, U.S. Patent Publication Nos. US2011/0152000 A1 filed on Dec. 23, 2009, US2011/0312437 filed on Jun. 22, 2011, US2012/0122601A1 filed on Dec. 29, 2011 and copending U.S. application Ser. No. 13/686,677 filed on Nov. 27, 2012, the entire contents of each of which are incorporated herein by reference.

In some embodiments movable weights can be adjusted by the manufacturer and/or the user to adjust the position of the center of gravity of the club to give the desired performance characteristics can be used in the golf club head. This feature is described in more detail in the following U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, and 7,410,425, the entire contents of each of which are incorporated by reference in their entirety herein.

According to some embodiments of the golf club heads described herein, the golf club head may also include a slidably repositionable weight positioned in the sole and/or skirt portion of the club head. Among other advantages, a slidably repositionable weight facilitates the ability of the end user of the golf club to adjust the location of the CG of the club head over a range of locations relating to the position of the repositionable weight. Further detail concerning the slidably repositionable weight feature is provided in more detail in U.S. Pat. Nos. 7,775,905 and 8,444,505 and U.S. patent application Ser. No. 13/898,313 filed on May 20, 2013 and U.S. patent application Ser. No. 14/047,880 filed on Oct. 7, 2013, the entire contents of each of which are hereby incorporated by reference herein as well the contents of paragraphs [430] to [470] and FIGS. 93-101 of US Patent Publication No. 2014/0080622 corresponding to U.S. patent application Ser. No. 13/956,046 filed on Jul. 31, 2013 as well as copending U.S. Patent Application Nos. 62/020,972 filed on Jul. 3, 2014 and 62/065/552 filed on Oct. 17, 2014, the contents of each of which are hereby incorporated by reference herein.

According to some embodiments of the golf club heads described herein, the golf club head may also include a coefficient of restitution feature which defines a gap in the body of the club, for example located on the sole portion and proximate the face. Such coefficient of restitution features are described more fully in U.S. patent application Ser. No. 12/791,025, filed Jun. 1, 2010, and U.S. Ser. No. 13/338,197, filed Dec. 27, 2011 and U.S. Ser. No. 13/839,727, filed Mar. 15, 2013 (US Publication No. 2014/0274457A1) and U.S. Ser. No. 14/457,883 filed Aug. 12, 2014 and U.S. Ser. No. 14/573,701 filed Dec. 17, 2014, the entire contents of each of which are incorporated by reference herein in their entirety.

Additional Exemplary Club Heads

FIGS. 20-36D illustrate another exemplary wood-type golf club head 200, which can include any combination of the features disclosed herein. For example, the club head body 202 and face 270 can be cast as a unitary structure from titanium alloys, as discussed herein. The head 200 includes a raised sole construction (see benefits discussed in US 2018/0185719), and also includes two weight tracks 214, 216 with slidably adjustable weights assemblies 210, 212. The head 200 further comprises both a crown insert 206 and a sole insert 208 (see exploded views in FIGS. 21 and 22), which inserts can be constructed from various lightweight materials having multiple layers of fiber reinforcement arranged in desired orientation patters (see further details in US 2018/0185719).

The head 200 comprises a body 202, an adjustable head-shaft connection assembly 204, the crown insert 206 attached to the upper portion of the body, the sole insert 208 mounted inside the body on top of the lower portion of the body, the front weight assembly 210 slidably mounted in the front weight track 214, and the rear weight assembly 212 slidably mounted in the rear weight track 216. The head 200 includes a front sit pad, or ground contact surface, 226 between the front track 214 and the face 270, and a rear sit pad, or ground contact surface, 224 at the rear of the body to the heel side of the rear track 216, with the rest of the sole elevated above the ground when in the normal address position.

Figure 22:
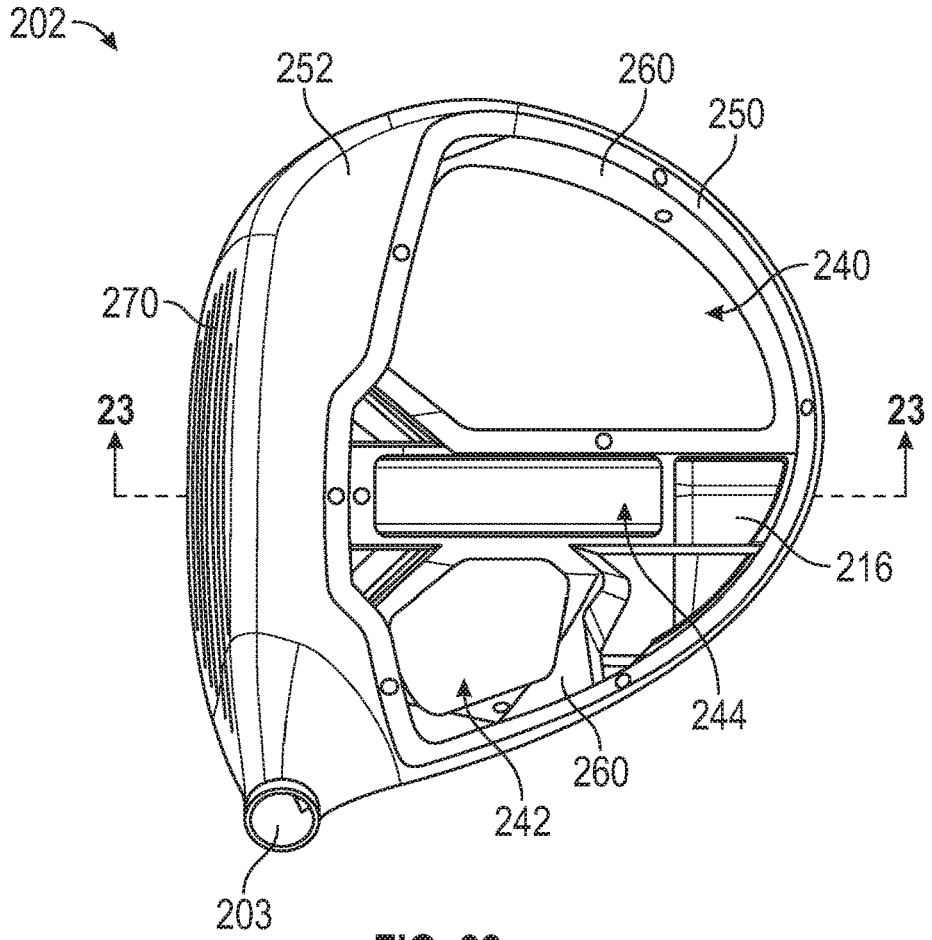
FIG. 22 is a top view of the body of the golf club head of FIG. 20.
Figure 23:
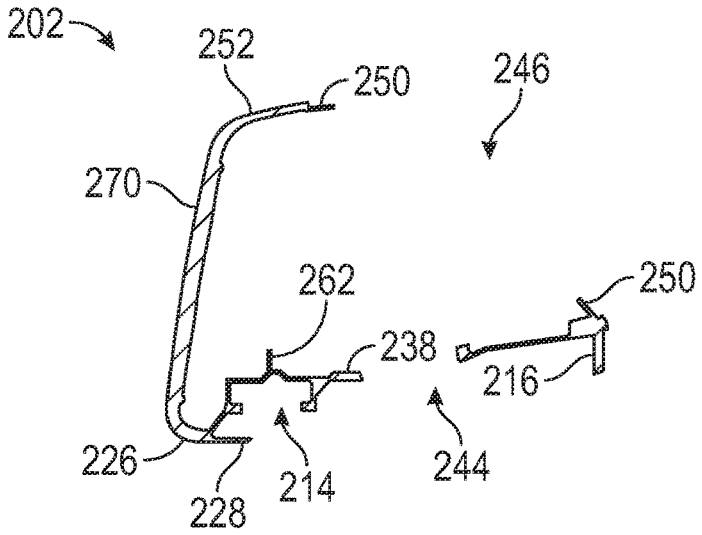
FIG. 23 is a cross-sectional view of the body taken along line 23-23 in FIG. 22.
Figure 24:
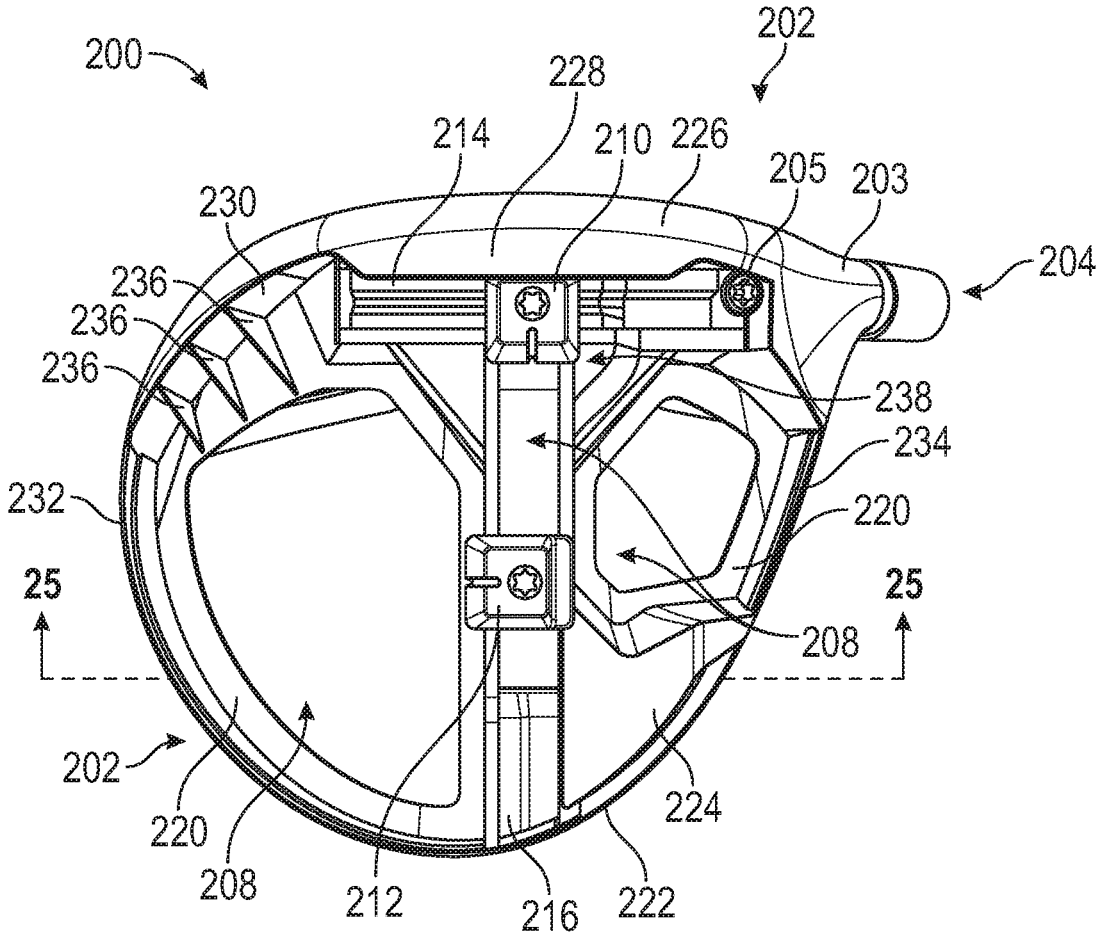
FIG. 24 is a bottom view of the golf club head of FIG. 20.
Figure 25:
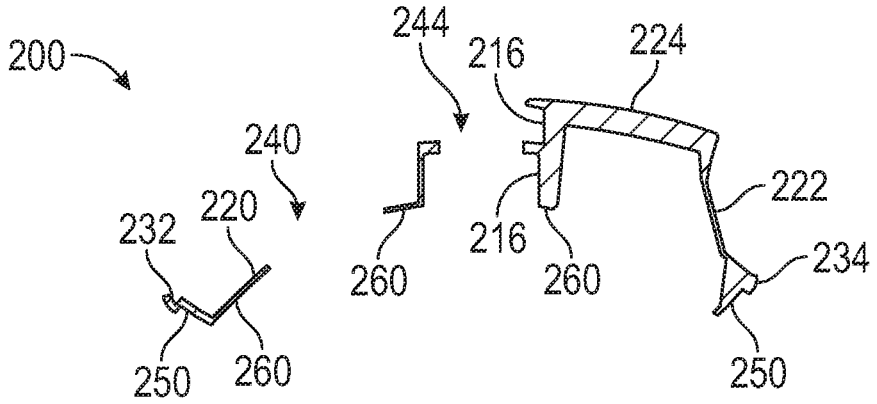
FIG. 25 is a cross-sectional view taken along line 25-25 in FIG. 24.
Figure 27:
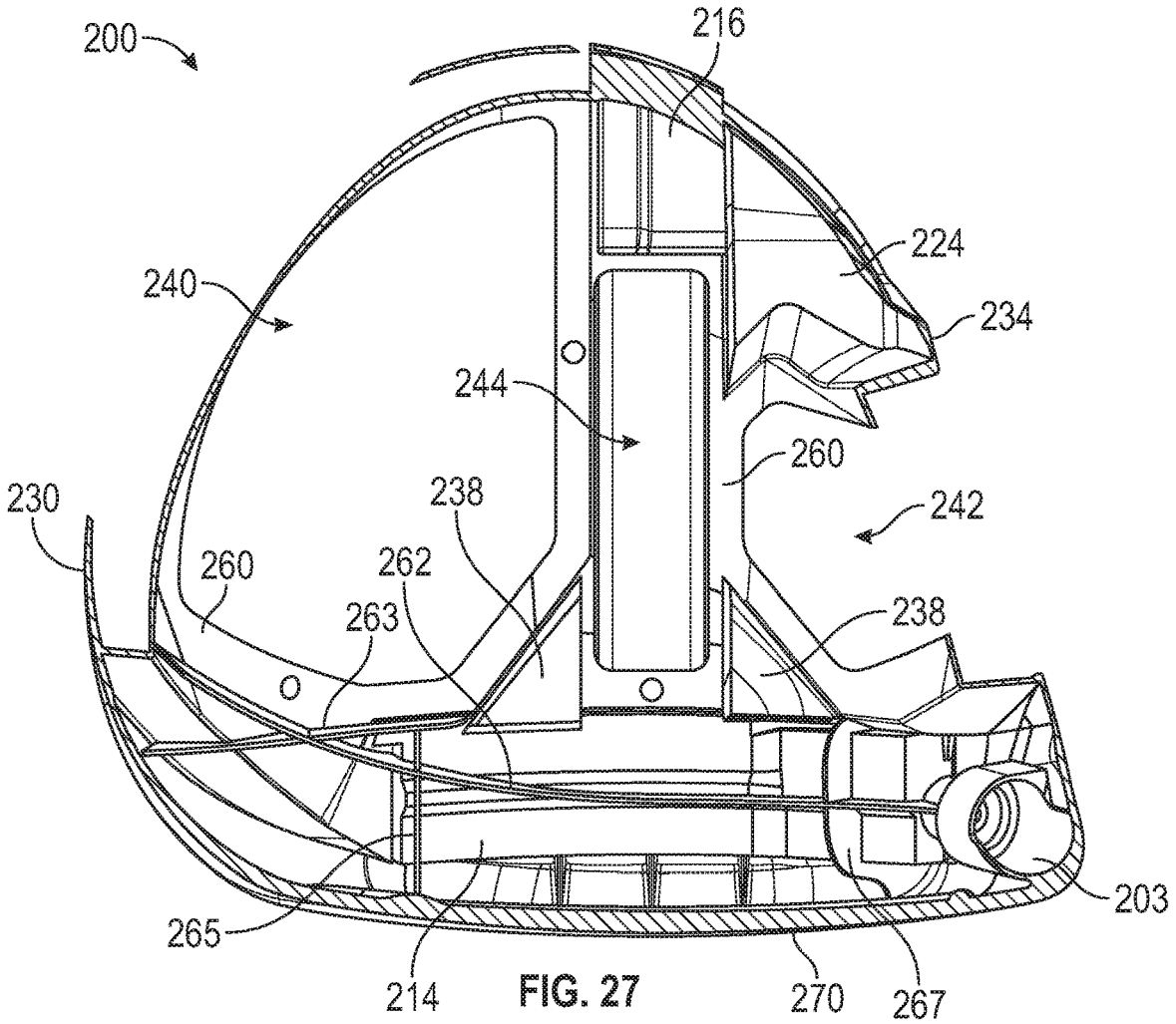
FIG. 27 is a cross-sectional top-down view of a lower portion of the body of FIG. 22.
Figure 28:
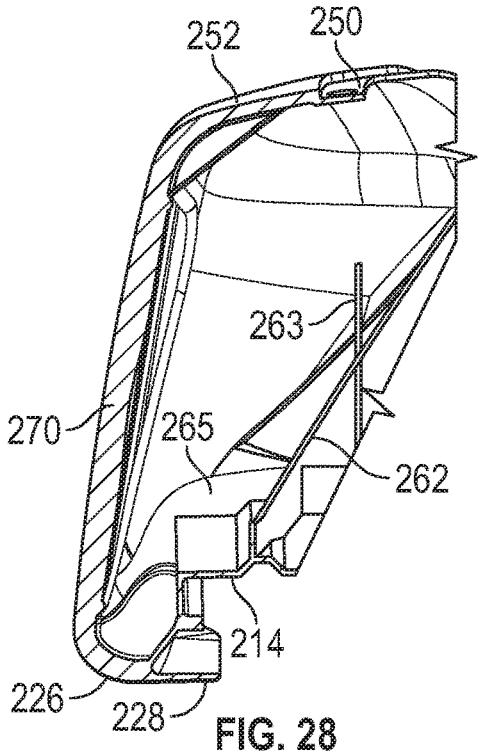
FIG. 28 is a cross-sectional side view of a toe portion of the body of FIG. 22.

The head 200 has a raised sole that is defined by a combination of the body 202 and the sole insert 208. As shown in FIGS. 22 and 27, for example, the lower portion of the body 202 include a toe-side opening 240, a heel-side opening 242, and a rear track opening 244, all of which are covered by the sole insert 208. The rear weight track 216 is positioned below the sole insert 208.

Figure 20:
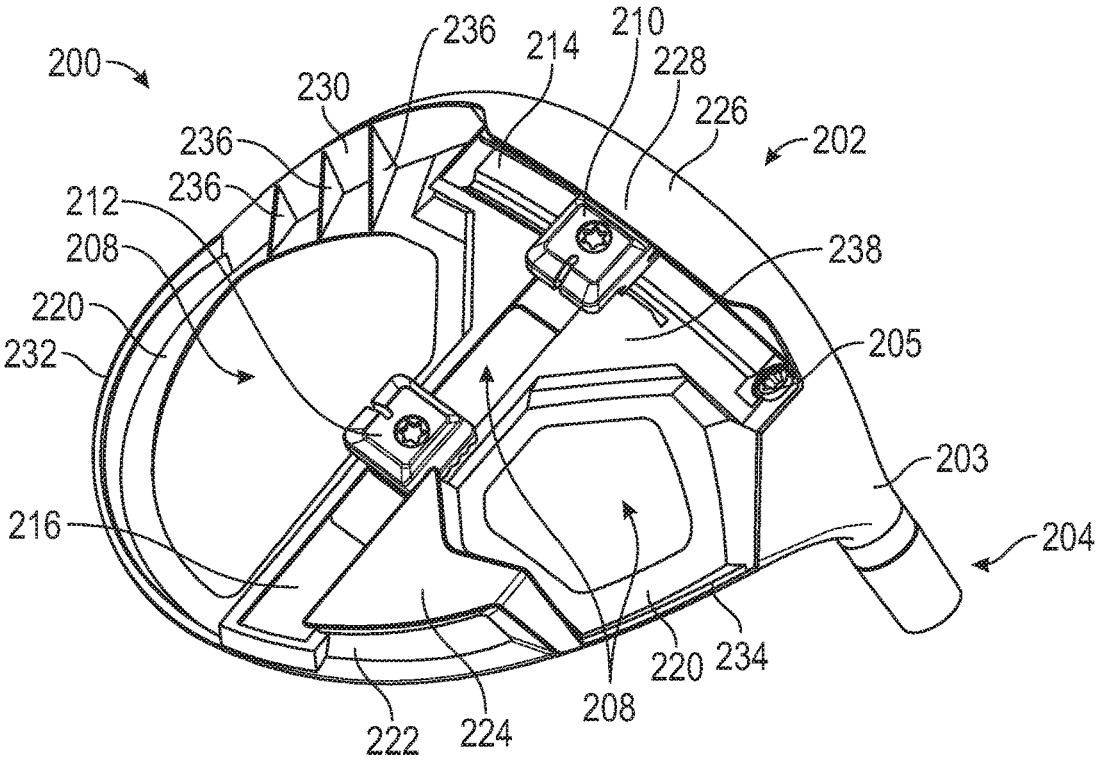
FIG. 20 is a bottom perspective view of yet another exemplary golf club head disclosed herein.
Figure 26:
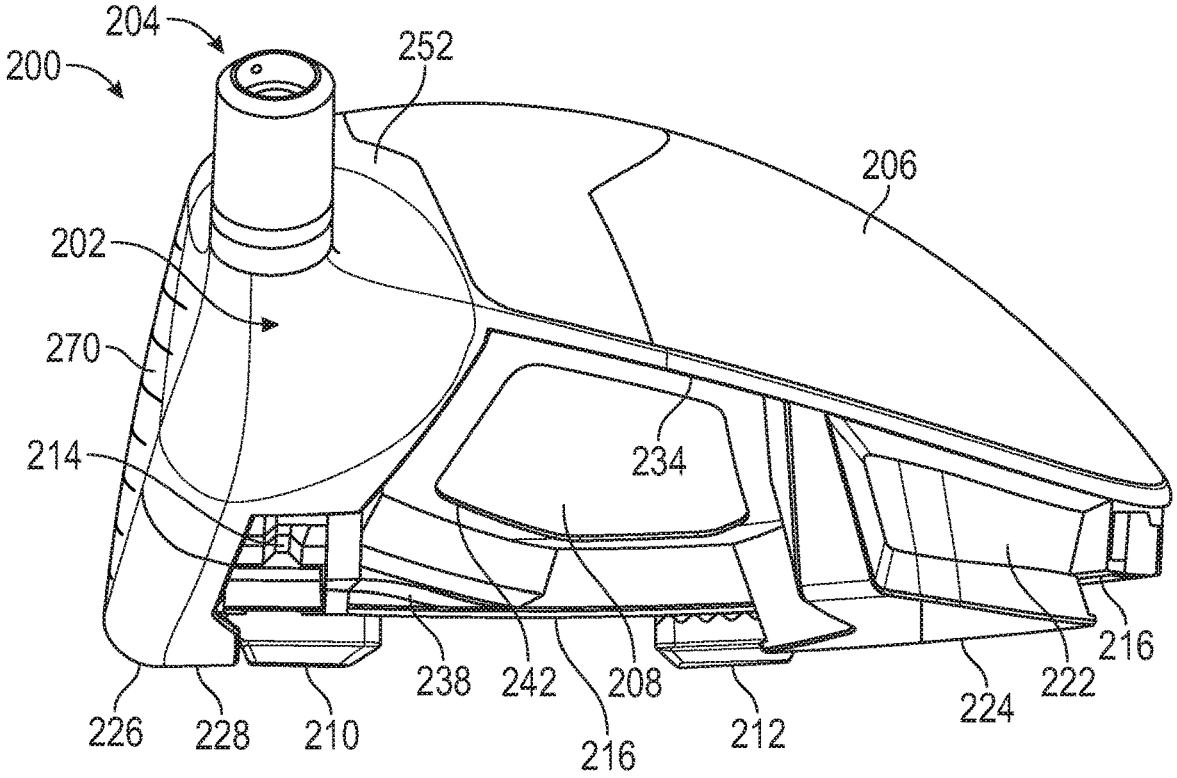
FIG. 26 is a heel side view of the golf club head of FIG. 20.
Figure 26A:
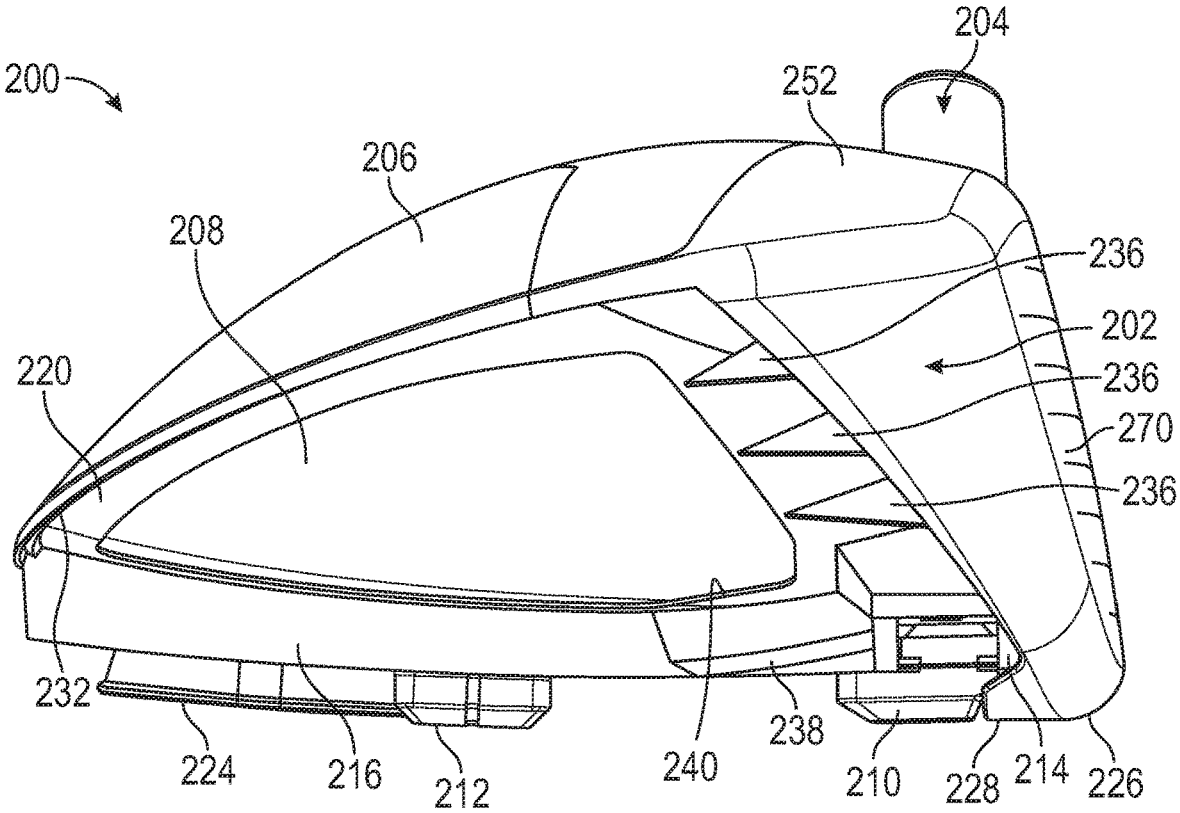
FIG. 26A is a toe side view of the golf club head of FIG. 20.

The head 200 also includes a toe-side cantilevered ledge 232 extending around the perimeter from the rear weight track 216 or rear sit pad 224 around to toe region adjacent the face, where the ledge 232 joins with a toe portion 230 of the body that extends toeward from the front sit pad 226. One or more optional ribs 236 can join the toe portion 230 to the raised sole adjacent a forward end of the toe-side opening 240 in the body. Three such triangular ribs are illustrated in FIG. 20 and FIG. 26A.

The head 200 also includes a heel-side cantilevered ledge 234 that extends from near the hosel region rearward to the rear sit pad 224 or to the rear end of the rear weight track 216. In some embodiments, the two cantilevered ledges 232 and 234 can meet and/or form a continuous ledge that extends around the rear of the head. The rear sit pad 224 can optionally include a recessed rear portion 222 (as shown in FIG. 26).

The lower portion of the body 202 that forms part of the sole can include various features, thickness variations, ribs, etc, to provide enhanced rigidity where desired and weight saving when rigidity is less desired. The body can include thicker regions 238, for example, near the intersection of the two weight tracks 214, 216. The body can also include thin ledges or seats 260 around the openings 240, 242, with the ledges 260 configured to receive and mate with sole insert 208. The lower surfaces of the body can also include various internal ribs to enhance rigidity and acoustics, such as ribs 262, 263, 265, and 267 shown in FIGS. 27 and 28.

Figure 21:
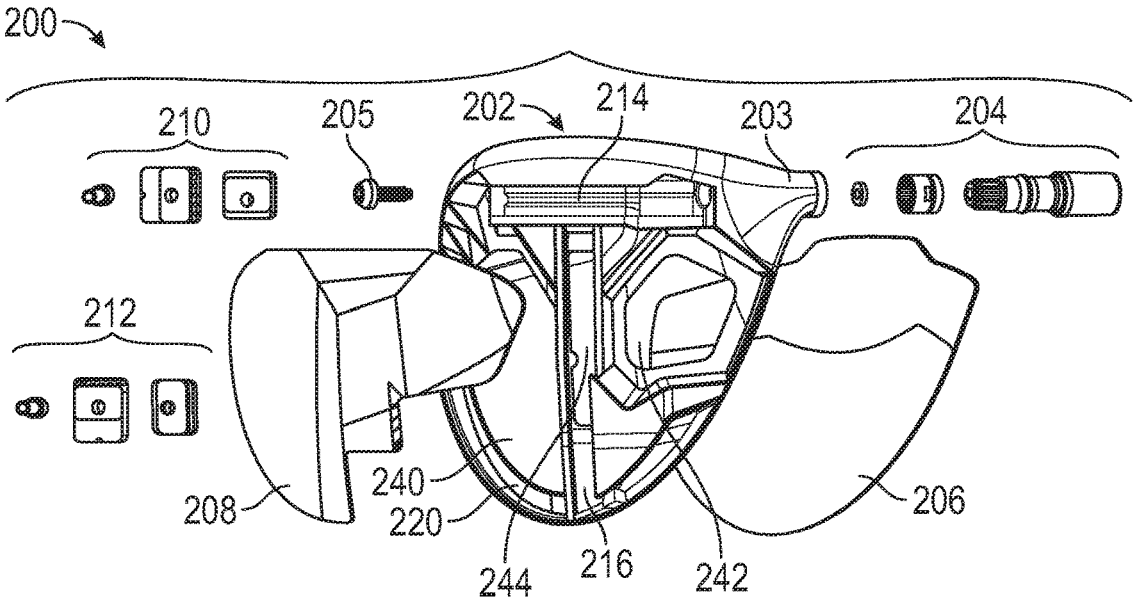
FIG. 21 is an exploded bottom perspective view of the golf club head of FIG. 20.
Figure 21A:
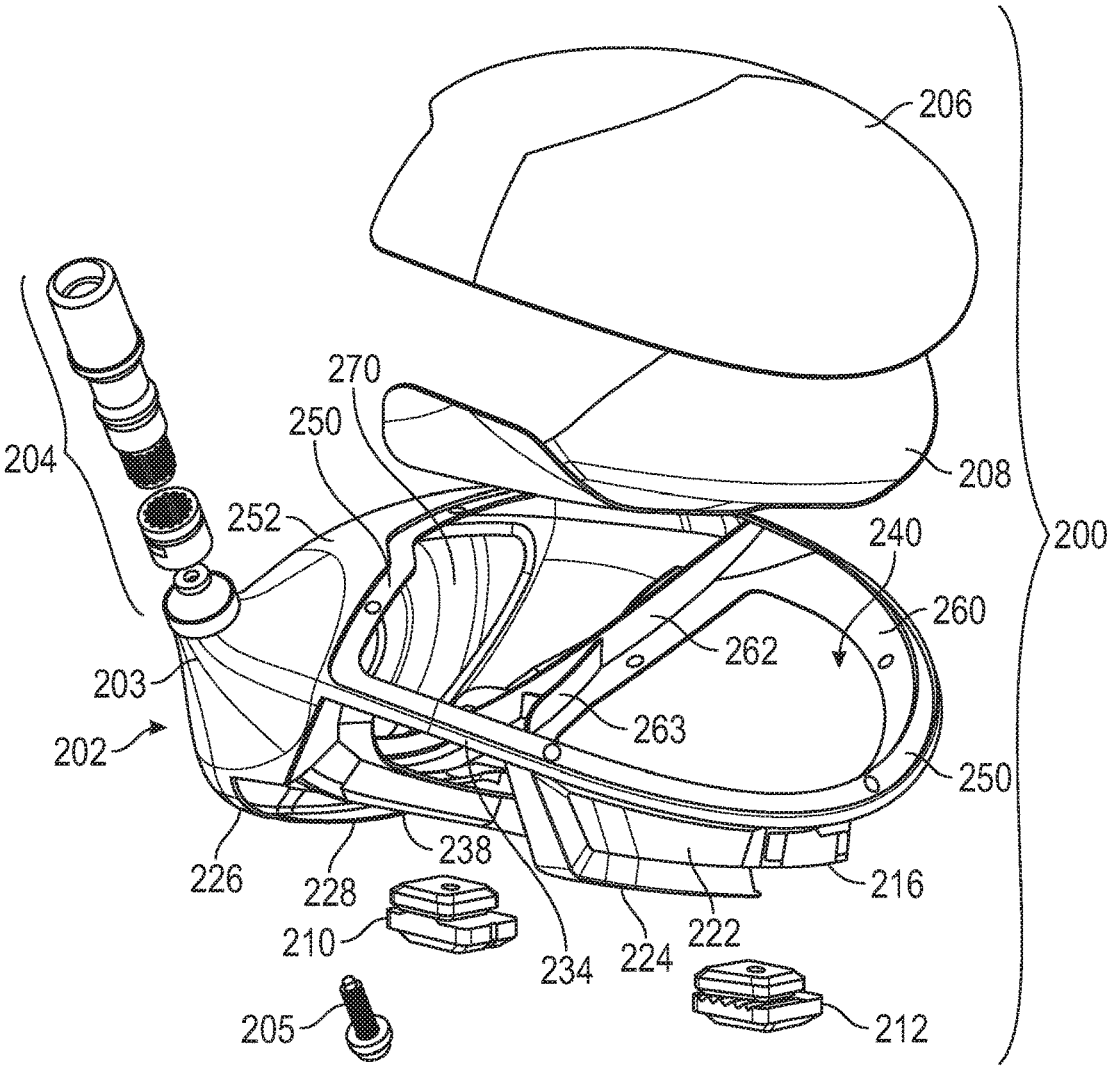
FIG. 21A is an exploded side perspective view of the golf club head of FIG. 20.

The upper portion of the body can also include various features, thickness variations, ribs, etc, to provide enhanced rigidity where desired and weight saving when rigidity is less desired. For example, the body includes a thinner seat region 250 around the upper opening to receive the crown insert 206. As shown in FIG. 21A, the seats 250 and 260 for the crown and sole inserts can be close to each other, even sharing a common edge, around the outer perimeter of the body.

Figure 36C:
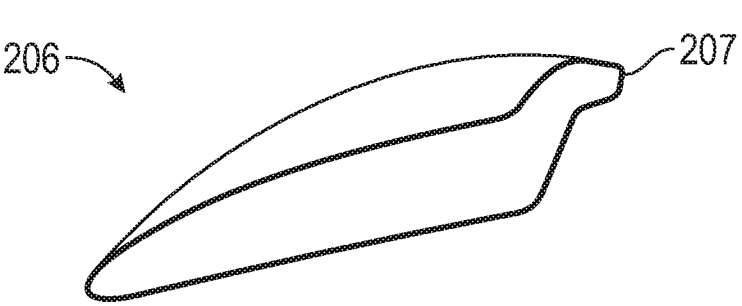
FIG. 36C is a side view of the crown portion of the golf club head of FIG. 20.
Figure 36D:
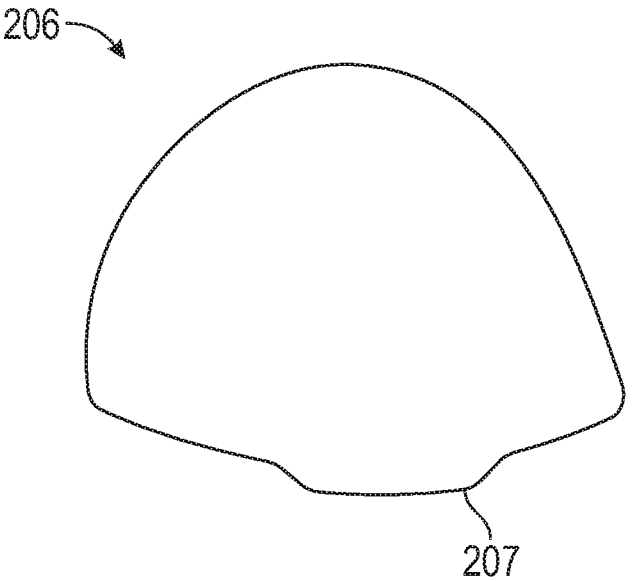
FIG. 36D is a top view of the crown portion of the golf club head of FIG. 20.
Figure 36A:
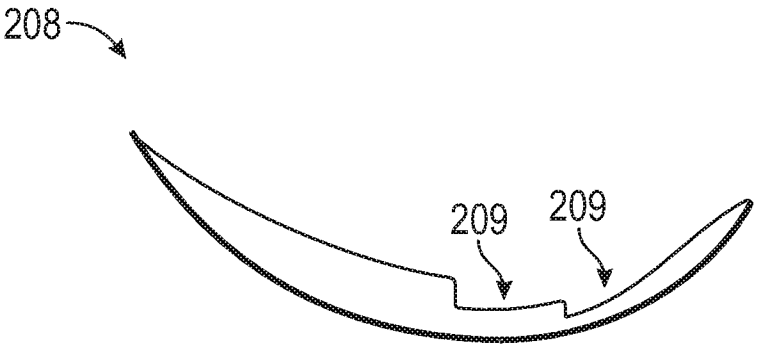
FIG. 36A is a front side view of the sole portion of the golf club head of FIG. 20.
Figure 36B:
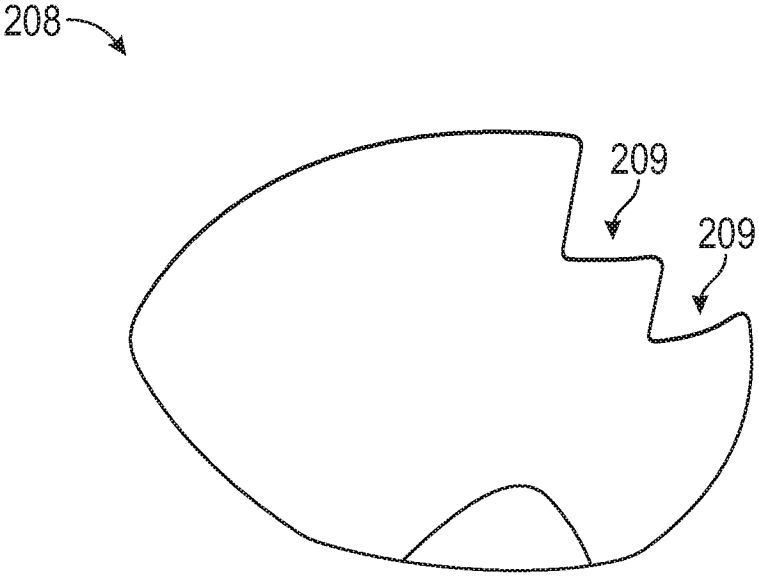
FIG. 36B is a bottom view of the sole portion of the golf club head of FIG. 20.

FIGS. 35A-D show top views of the head 200 in various states with the crown and sole inserts in place and/or removed. FIGS. 36A-D show the crown and sole inserts in more detail. As shown in FIGS. 36A and 36B, the sole insert 208 can have an irregular shape with a concave upper surface and convex lower surface. The sole insert 208 can also include notches 209 at the rear-heel end to accommodate fitting around the rear sit pad 224 area, where enhanced rigidity is needed due to ground contact forces. In various embodiments, the sole insert can cover at least about 50% of the surface area of the sole, at least about 60% of the surface area of the sole, at least about 70% of the surface area of the sole, or at least about 80% of the surface area of the sole. In another embodiment, the sole insert covers about 50% to 80% of the surface area of the sole. The sole insert contributes to a club head structure that is sufficiently strong and stiff to withstand the large dynamic loads imposed thereon, while remaining relatively lightweight to free up discretionary mass that can be allocated strategically elsewhere within the club head.

The sole insert 208 has a geometry and size selected to at least cover the openings 240, 242, 244 in the bottom of the body, and can be secured to the frame by adhesion or other secure fastening technique. In some embodiments, the ledges 260 may be provided with indentations to receive matching protrusions or bumps on the underside of the sole insert to further secure and align the sole insert on the frame.

Like the sole, the crown also has an opening 246 that reduces the mass of the body 202, and more significantly, reduces the mass of the crown, a region of the head where increased mass has the greatest impact on raising (undesirably) the CG of the head. Along the periphery of the opening 246, the frame includes a recessed ledge 250 to seat and support the crown insert 206. The crown insert 206 (see FIGS. 36C and 36D) has a geometry and size compatible with the crown opening 246 and is secured to the body by adhesion or other secure fastening technique so as to cover the opening 246. The ledge 260 may be provided with indentations along its length to receive matching protrusions or bumps on the underside of the crown insert to further secure and align the crown insert on the body. The crown insert may also include a forward projection 207 that extends in to the forward crown portion 252 of the body.

In various embodiments, the ledges of the body that receive the crown and sole inserts (e.g. ledges 250 and 260) may be made from the same metal material (e.g., titanium alloy) as the body and, therefore, can add significant mass to the golf club head. In some embodiments, in order to control the mass contribution of the ledge to the golf club head, the width of the ledges can be adjusted to achieve a desired mass contribution. In some embodiments, if the ledges add too much mass to the golf club head, it can take away from the decreased weight benefits of a sole and crown inserts, which can be made from a lighter materials (e.g., carbon fiber or graphite composites and/or polymeric materials). In some embodiments, the width of the ledges may range from about 3 mm to about 8 mm, preferably from about 4 mm to about 7 mm, and more preferably from about 4.5 mm to about 5.5 mm. In some embodiments, the width of the ledges may be at least four times as wide as a thickness of the respective insert. In some embodiments, the thickness of the ledges may range from about 0.4 mm to about 1 mm, preferably from about 0.5 mm to about 0.8 mm, and more preferably from about 0.6 mm to about 0.7 mm. In some embodiments, the thickness of the ledges may range from about 0.5 mm to about 1.75 mm, preferably from about 0.7 mm to about 1.2 mm, and more preferably from about 0.8 mm to about 1.1 mm. Although the ledges may extend or run along the entire interface boundary between the respective insert and the body, in alternative embodiments, the ledges may extend only partially along the interface boundaries.

The periphery of crown opening 246 can be proximate to and closely track the periphery of the crown on the toe-, rear-, and heel-sides of the head 200. In contrast, the face-side of the crown opening 246 can be spaced farther from the face 270 region of the head. In this way, the head can have additional frame mass and reinforcement in the crown area 252 just rearward of the face 270. This area and other areas adjacent to the face along the toe, heel and sole support the face and are subject to the relatively higher impact loads and stresses due to ball strikes on the face. As described elsewhere herein, the frame may be made of a wide range of materials, including high strength titanium, titanium alloys, and/or other metals. The opening 246 can have a notch at the front side which matingly corresponds to the crown insert projection 207 to help align and seat the crown insert on the body.

The front and rear weight tracks 214, 216 are located in the sole of the club head and define tracks for mounting two-piece slidable weight assemblies 210, 212, respectively, which may be fastened to the weight tracks by fastening means such as screws. The weight assemblies can take forms other than as shown in FIG. 21A, can be mounted in other ways, and can take the form of a single piece design or multi-piece design. The weight tracks allows the weight assemblies to be loosened for slidable adjustment along the tracks and then tightened in place to adjust the effective CG and MOI characteristics of the club head. For example, by shifting the club head's CG forward or rearward via the rear weight assembly 212, or heelward or toeward via the front weight assembly 210, the performance characteristics of the club head can be modified to affect the flight of the golf ball, especially spin characteristics of the golf ball. In other embodiments, the front weight track 214 can instead be a front channel without a movable weight.

The sole of the body 202 preferably is integrally formed with the front weight track 214 extending generally parallel to and near the face of the club head and generally perpendicular to the rear weight track 216, which extends rearward from near the middle of the front track toward the rear of the head.

In the illustrated embodiments, the weight tracks each only include one weight assembly. In other embodiments, two or more weight assemblies can be mounted in either or both of the weight tracks to provide alternative mass distribution capabilities for the club head.

By adjusting the CG heelward or toeward via the front weight track 214, the performance characteristics of the club head can be modified to affect the flight of the ball, especially the ball's tendency to draw or fade and/or to counter the ball's tendency to slice or hook. By adjusting the CG forward or rearward via the rear weight track 216, the performance characteristics of the club head can be modified to affect the flight of the ball, especially the ball's tendency to move upwardly or resist falling during flight due to backspin. The use of two weights assemblies in wither track can allow for alternative adjustment and interplay between the two weights. For example, with respect to the front track 214, two independently adjustable weight assemblies can be positioned fully on the toe side, fully on the heel side, spaced apart a maximum distance with one weight fully on the toe side and the other fully on the heel side, positioned together in the middle of the weight track, or in other weight location patterns. With a single weight assembly in a track, as illustrated, the weight adjustment options are more limited but the effective CG of the head still can be adjusted along a continuum, such as heelward or toeward or in a neutral position with the weight centered in the front weight track.

Figure 29:
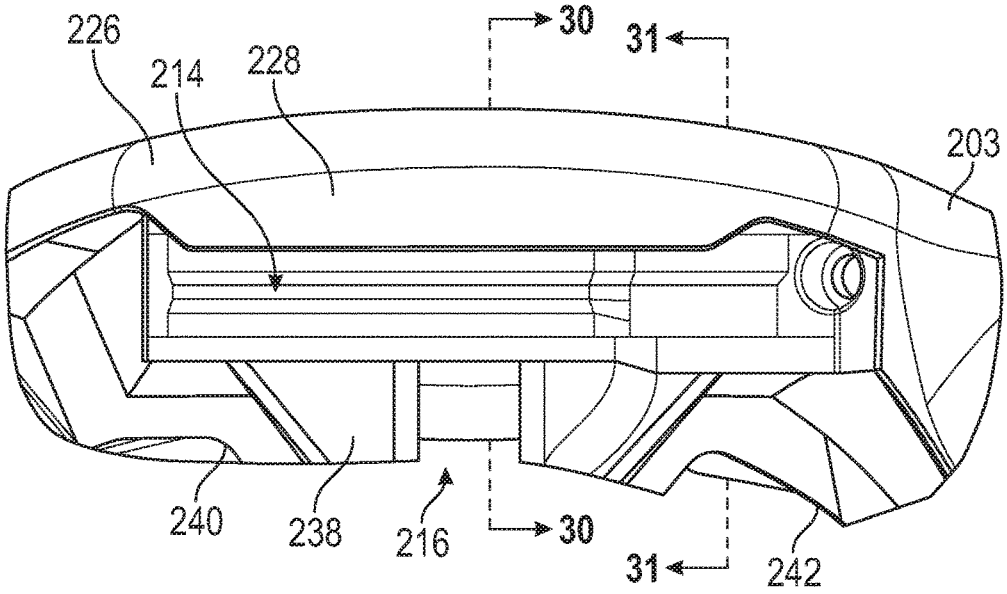
FIG. 29 is a bottom view of a front portion of the sole of the body of FIG. 22.
Figure 30:
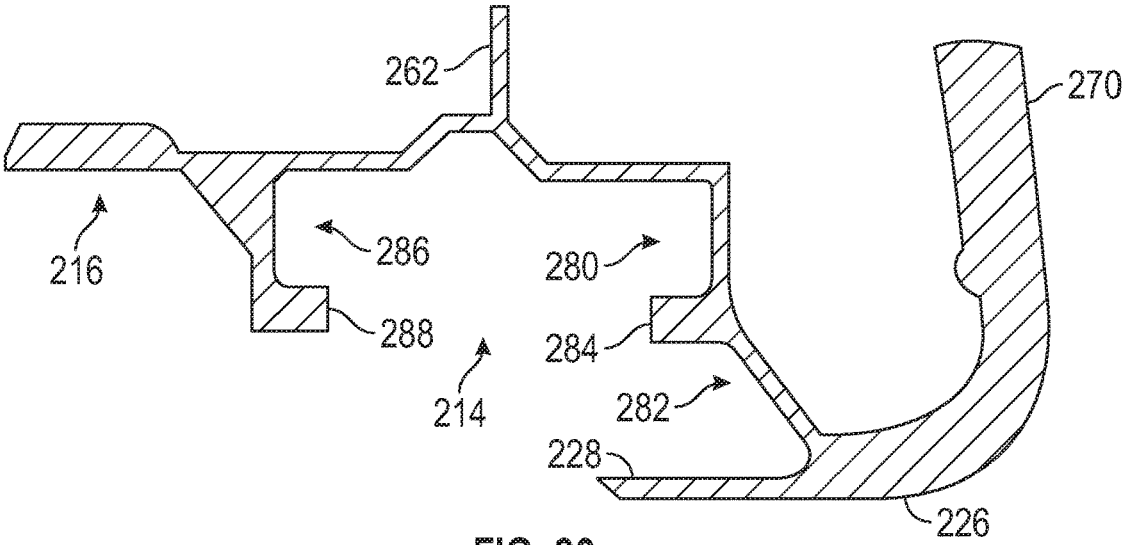
FIG. 30 is an enlarged detail cross-section view of a side-to-side weight track taken generally along line 30-30 of FIG. 29.
Figure 31:
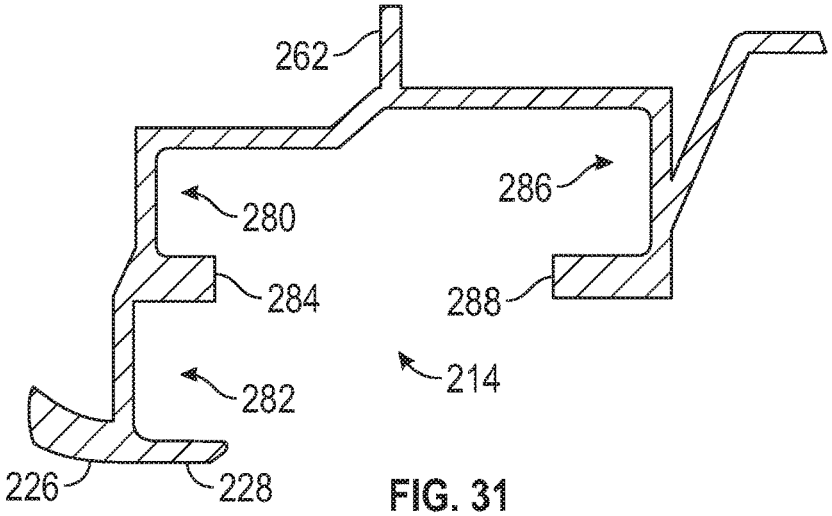
FIG. 31 is another enlarged detail cross-section view of the side-to-side weight track taken generally along line 31-31 of FIG. 29.
Figure 32:
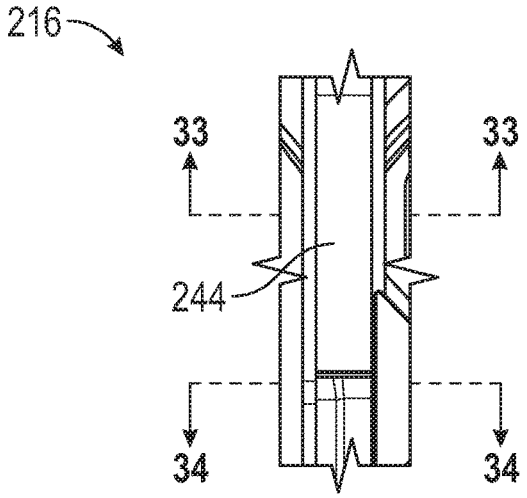
FIG. 32 is a bottom view of a portion of the sole of the body of FIG. 22 including a front-to-rear weight track.
Figure 33:
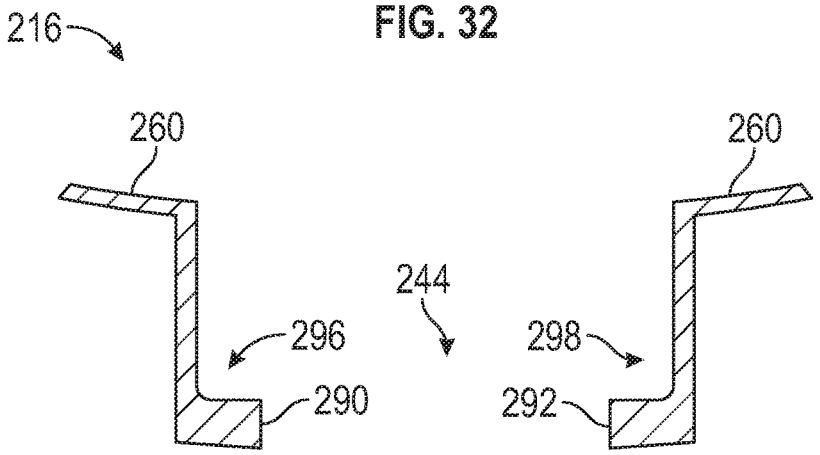
FIG. 33 is an enlarged detail cross-section view of the front-to-rear weight track taken generally along line 33-33 of FIG. 32.
Figure 34:
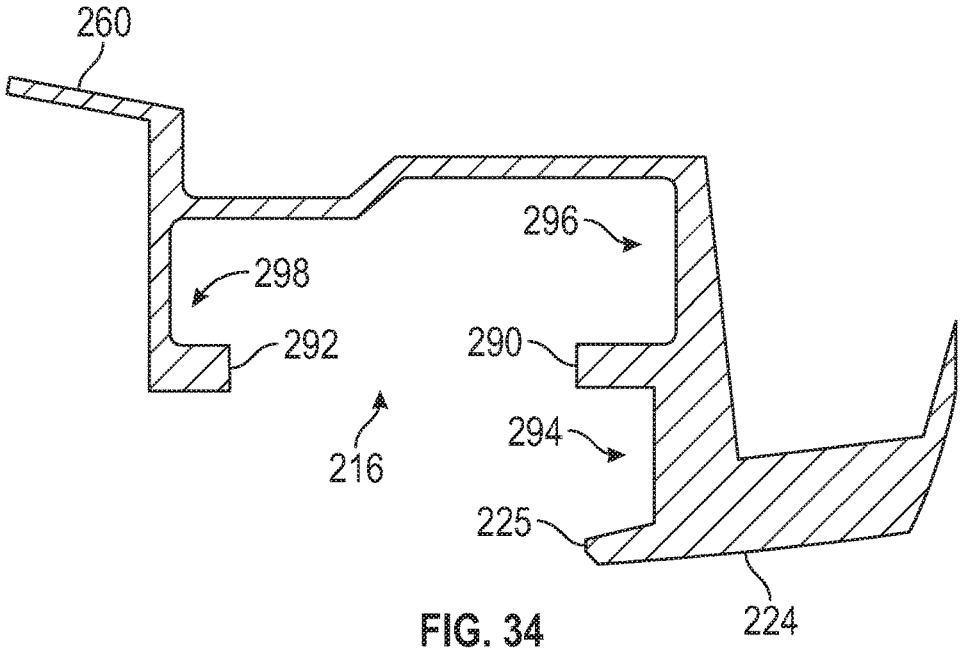
FIG. 34 is another enlarged detail cross-section view of the front-to-rear weight track taken generally along line 34-34 of FIG. 32.
Figure 35C:
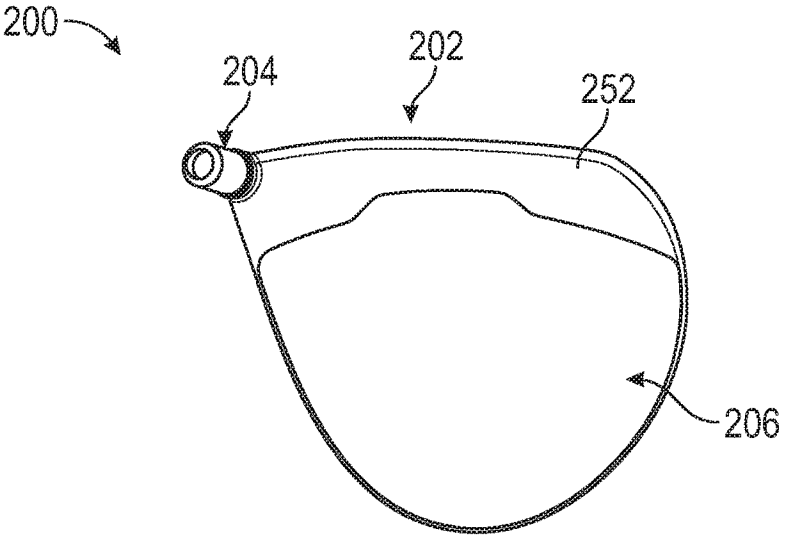
FIG. 35C is a top view of the golf club head of FIG. 20 with the crown portion in place.
Figure 35D:
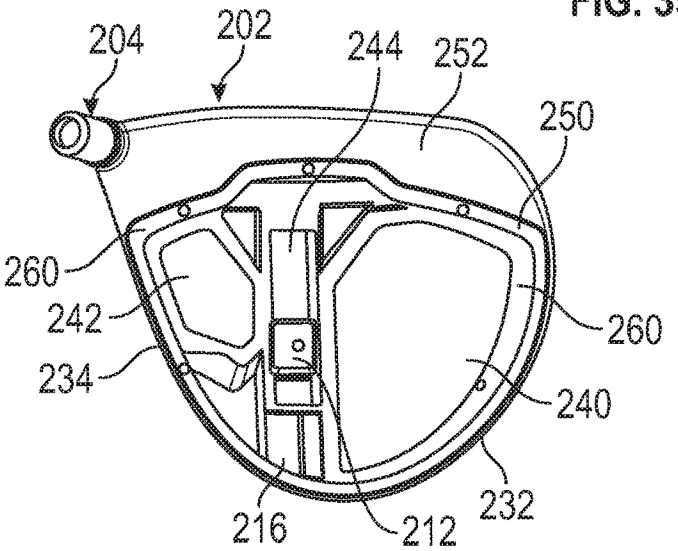
FIG. 35D is a top view of the golf club head of FIG. 20 with both the crown portion and the sole portion removed.
Figure 35A:
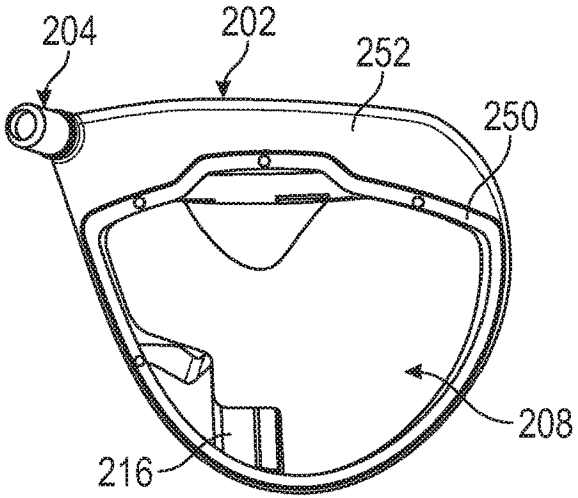
FIG. 35A is a top view of the golf club head of FIG. 20 with a crown portion removed, showing a sole portion positioned in the body.
Figure 35B:
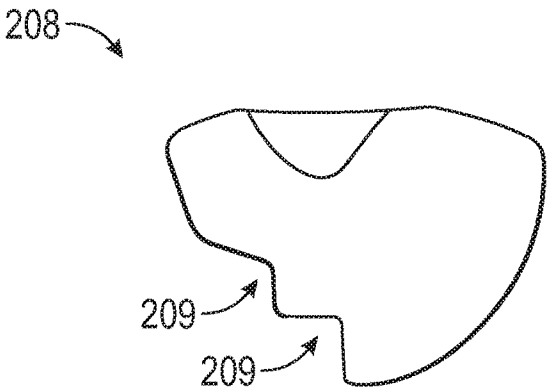
FIG. 35B is a top view of the sole portion of the golf club head of FIG. 20.

As shown in FIGS. 29-34, each of the weight tracks 214, 216 preferably has a recess, which may be generally rectangular in shape, to provide a recessed track to seat and guide the weight as it adjustably slides along the track. Each track includes one or more peripheral rails or ledges to define an elongate channel preferably having a width dimension less than the width of the weight placed in the channel. For example, as shown in FIGS. 29 and 30, the front track 214 includes opposing peripheral rails 288 and 284 and, as shown in FIGS. 33 and 34, the rear track 216 includes opposing peripheral rails 290 and 292. In this way, the weights can slide in the weight track while the rails prevent them from passing out of the tracks. At the same time, the channels between the ledges permit the screws of the weight assemblies to pass through the center of the outer weight elements, through the channels, and then into threaded engagement with the inner weight elements. The ledges serve to provide tracks or rails on which the joined weight assemblies freely slide while effectively preventing the weight assemblies from inadvertently slipping out of the tracks, even when loosened. In the front track 214, the inner weight member of the assembly 210 sits above the rails 284 and 288 in inner recesses 280 and 286, while the outer weight member is partially seated in recess 282 between the forward rail 284 and the overhanging lip 228 of the front sit pad 226 (FIGS. 30, 31). In the rear track 216, the inner weight member of the assembly 212 sits above the rails 290 and 292 in inner recesses 296 and 298, while the outer weight member can be partially seated in recess 294 between the heel-side rail 290 and an overhanding lip 225 of the rear sit pad 224.

The weight assemblies can be adjusted by loosening the screws and moving the weights to a desired location along the tracks, then the screws can be tightened to secure them in place. The weights assemblies can also be swapped out and replaced by other weight assemblies having different masses to provide further mass adjustment options. If a second or third weight is added to the weight track, many additional weight location and distribution options are available for additional fine tuning of the head's effective CG location in the heel-toe direction and the front-rear direction, and combinations thereof. This also provides great range of adjust of the club head's MOI properties.

Either or both of the weight assemblies 210, 212 can comprise a three piece assembly including an inner weight member, an outer weight member, and a fastener coupling the two weight members together. The assemblies can clamp onto front, back, or side ledges of the weight tracks by tightening the fastener such that the inner member contacts the inner side the ledge and the outer weight member contacts the outer side of the ledge, with enough clamping force to hold the assembly stationary relative to the body throughout a round of golf. The weight members and the assemblies can be shaped and/or configured to be inserted into the weight track by inserting the inner weight member into the inner channel past the ledge(s) at a usable portion of the weight track, as opposed to inserting the inner weight at an enlarged opening at one end of the weight track where the weight assembly is not configured to be secured in place. This can allow for elimination of such a wider, non-functional opening at the end of the track, and allow the track to be shorter or to have a longer functional ledge width over which the weight assembly can be secured. To allow the inner weight member to be inserted into the track in the middle of the track (for example) past the ledge, the inner weight member can be inserted at an angle that is not perpendicular to the ledge, e.g., an angled insertion. The weight member can be inserted at an angle and gradually rotated into the inner channel to allow insertion past the clamping ledge. In some embodiments, the inner weight member can have a rounded, oval, oblong, arcuate, curved, or otherwise specifically shaped structure to better allow the weight member to insert into the channel past the ledge at a useable portion of the track.

In the golf club heads of the present disclosure, the ability to adjust the relative positions and masses of the slidably adjusted weights and/or threadably adjustable weights, coupled with the weight saving achieved by titanium alloys material use and incorporation of the light-weight crown insert and/or sole insert, further coupled with the discretionary mass provided by the raised sole configurations, can allow for a large range of variation of a number properties of the club-head all of which affect the ultimate club-head performance including the position of the CG of the club-head, MOI values of the club head, acoustic properties of the club head, aesthetic appearance and subjective feel properties of the club head, and/or other properties.

In certain embodiments, the front weight track and the rear weight track have certain track widths. The track widths may be measured, for example, as the horizontal distance between a first track wall and a second track wall that are generally parallel to each other on opposite sides of the inner portion of the track that receives the inner weight member of the weight assembly. With reference to FIGS. 29-31, the width of the front track 214 can be the horizontal distance between opposing walls of the inner recesses 280 and 286. With reference to FIGS. 32-34, the width of the rear track 216 can be the horizontal distance between opposing walls of the inner recesses 296 and 298. For both the front track and the rear track, the track widths may be between about 5 mm and about 20 mm, such as between about 10 mm and about 18 mm, or such as between about 12 mm and about 16 mm. According to some embodiments, the depth of the tracks (i.e., the vertical distance between the uppermost inner wall in the track and an imaginary plane containing the regions of the sole adjacent the outermost lateral edges of the track) may be between about 6 mm and about 20 mm, such as between about 8 mm and about 18 mm, or such as between about 10 mm and about 16 mm. For the front track 214, the depth of the track can be the vertical distance from the inner surface of the overhanging lip 228 to the upper surface of the inner recess 280 (FIG. 30). For the rear track 216, the depth of the track can be the vertical distance from the inner surface of the overhanging lip 225 to the upper surface of the inner recess 296 (FIG. 34).

Additionally, both the front track and rear track have a certain track length. Track length may be measured as the horizontal distance between the opposing longitudinal end walls of the track. For both the front track and the rear track, their track lengths may be between about 30 mm and about 120 mm, such as between about 50 mm and about 100 mm, or such as between about 60 mm and about 90 mm. Additionally, or alternatively, the length of the front track may be represented as a percentage of the striking face length. For example, the front track may be between about 30% and about 100% of the striking face length, such as between about 50% and about 90%, or such as between about 60% and about 80% mm of the striking face length.

The track depth, width, and length properties described above can also analogously also be applied to the front channel 36 of the club head 10.

In FIGS. 30 and 34, it can be seen that the lips 228, 225 of the front and rear sit pads extend over or overhang the respective weight tracks, restricting the track openings and helping retain the weight(s) within the tracks.

Referring to FIG. 34, the sole area on the rear sit pad 224 on the heel side of the rear track 216 is lower than the sole area on the toe side (bottom of ledge 292) by a significant vertical distance when the head is in the address position relative to a ground plane. This can be thought of as the head having a "dropped sole" or "raised sole" construction with a portion of the sole positioned lower (e.g., on the heel side) relative to another portion of the sole (e.g., on the toe side). Put another way, a portion of the sole (e.g., most of the sole except for the rear sit pad 224) is raised relative to another portion of the sole (e.g., the rear sit pad). The same also applies at the front track 214 where the front sit pad 226 and its lip 228 are significantly lower than the rear side of the front track (as shown in FIG. 30), in the normal address position.

In one embodiment, the vertical distance between the level of the ground contact surfaces of the sit pads and the adjacent surfaces of the raised sole portions may be in the range of about 2-12 mm, preferably about 3-9 mm, more preferably about 4-7 mm, and most preferably about 4.5-6.5 mm. In one example, the vertical distance is about 5.5 mm.

FIGS. 37-48 illustrate another exemplary golf club head 400 that has a face portion integrally cast as a single unit with a forward portion of the club head body, forming a cup-shaped unit (referred to herein as cup 402) that includes the face portion, hosel, and forward portions of crown, sole, toe, and heel. However, a rear portion of the body (referred to herein as ring 404) is formed separately and later attached to the cup 402 to form the club head body. The combination of the cup 402 and ring 404 is referred to herein as the body of the club head 400. A crown insert 406 and a sole insert 408 can then be attached to the body to form the club head 400. In some embodiments, there is no sole opening or sole insert, and the rear ring fully encloses the sole. In some embodiments, the sole insert is comprised of metallic material, composite material, and/or other materials.

Figure 37:
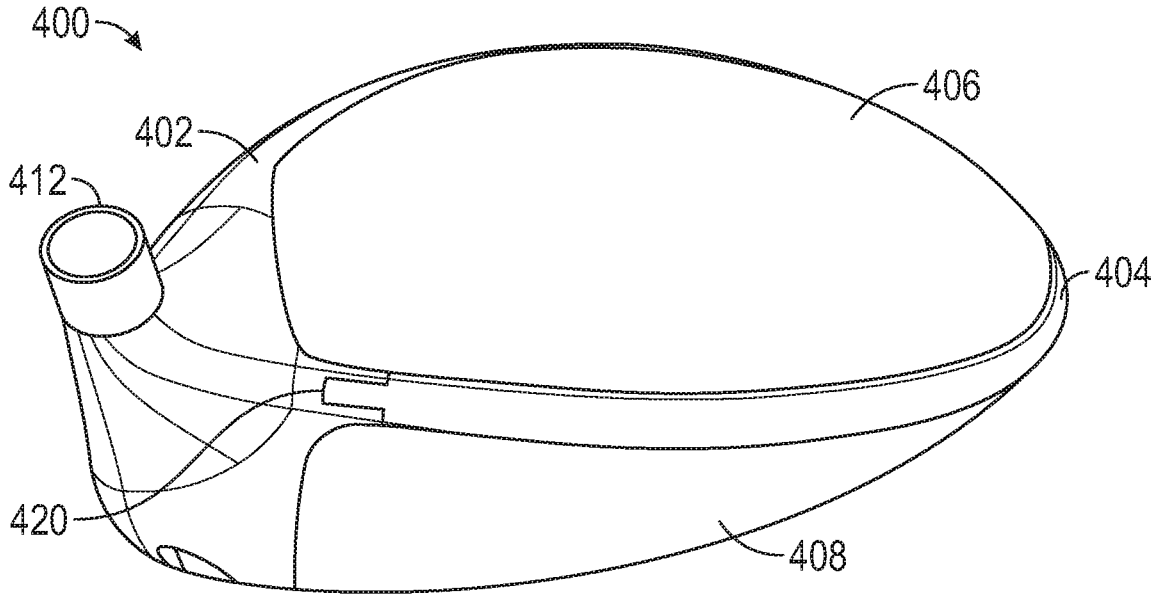
FIG. 37 is a perspective view of another exemplary golf club head.
Figure 38:
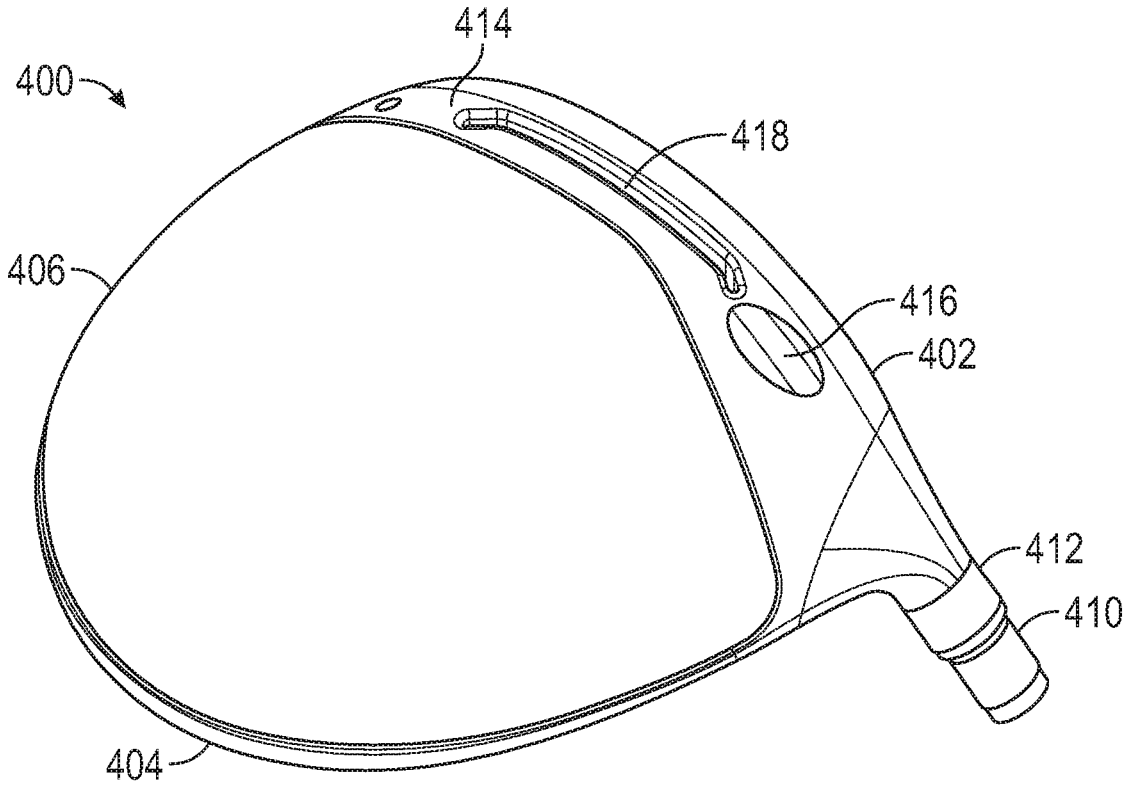
FIG. 38 is a different perspective view of the club head of FIG. 37, with a head-shaft connection assembly.

FIGS. 37 and 38 show the assembled club head 400, comprising the cup 402, ring 404, crown insert 406, and sole insert 408. A head-shaft connection assembly 410 can be coupled to the hosel 412. The cup 402 and ring 404 can comprise metallic materials, such as titanium alloys or steel, while the inserts 406 and 408 can comprise less dense materials, such as carbon fiber reinforced composite materials. Any of the other materials disclosed herein can also be used in the club head 400. The cup and ring may be comprised of the same material (e.g., the same titanium alloy), or the ring can be comprised of a different material than the cup (e.g., steel ring and titanium alloy cup, or two different titanium alloys).

Figure 39:
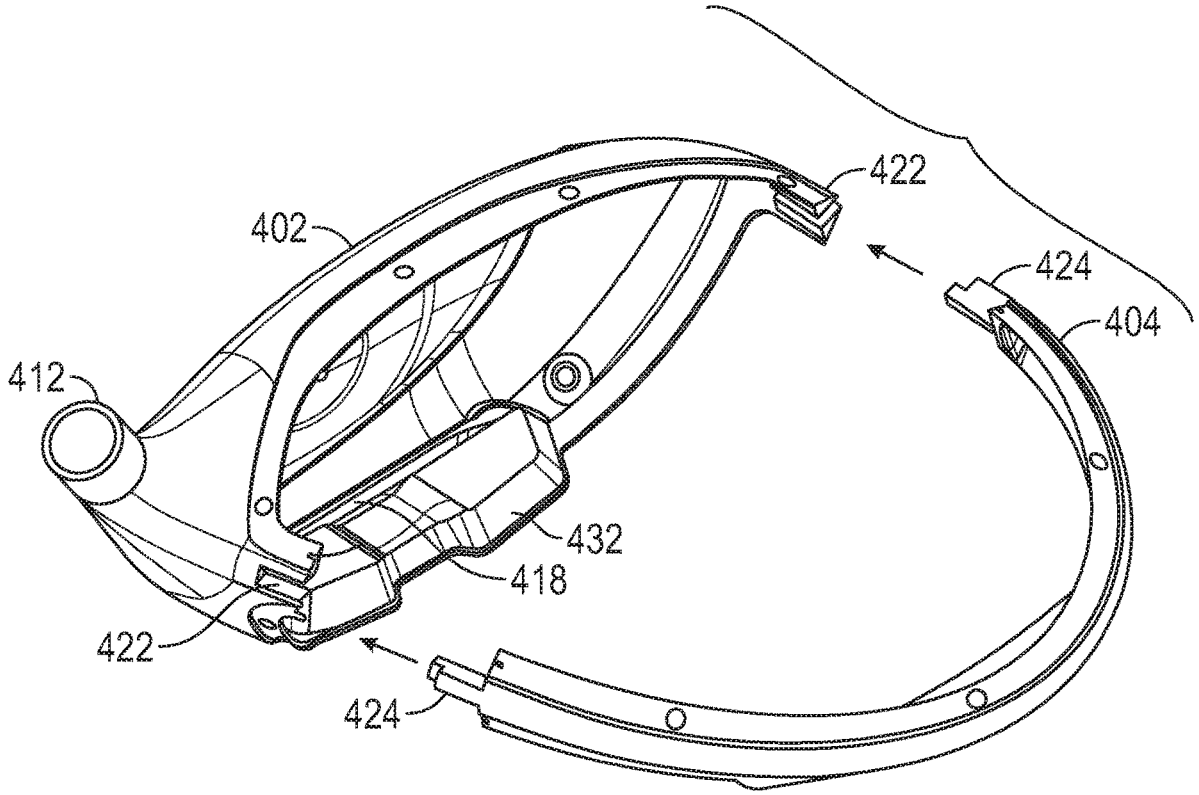
FIG. 39 shows how the body of the club head of FIG. 37 is formed from two pieces attached together.
Figure 40:
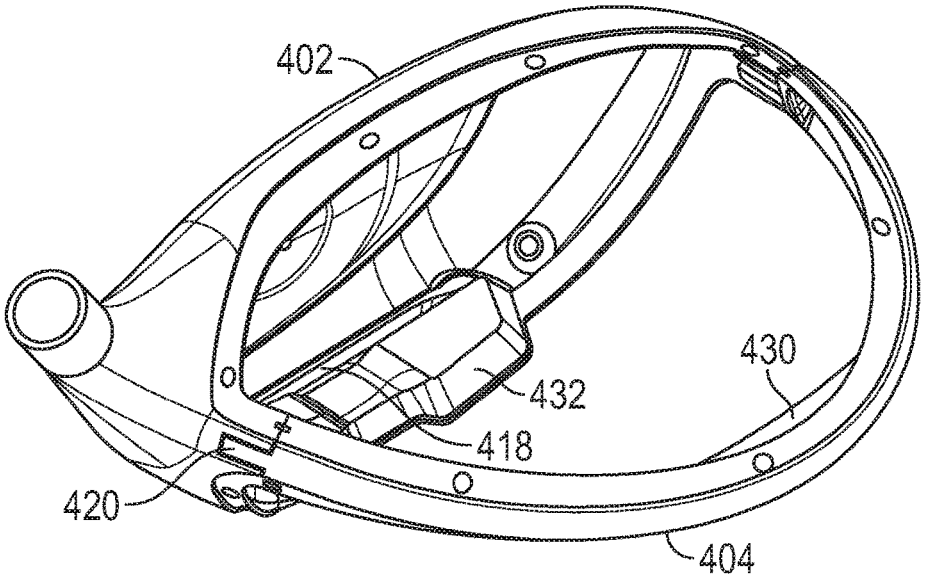
FIG. 40 shows the body of FIG. 39 in an assembled state.

FIGS. 39 and 40 illustrate how the ring 404 is coupled to the cup 402 at toe and heel joints 420, forming an annular body having an upper crown opening and a lower sole opening. The ring 404 can include forward extending toe and heel engagement ends 424 that mate with rearward extending toe and heel engagement ends 422 of the cup 402 to form the joints 420. In the example illustrated, the ring has male projections that mate with female notches in the cup. However, these joints can be reversed with male projections on the cup and female notches in the ring. In other embodiments, any other suitable engagement geometry can be used in the joints 420 to couple the ring to the cup. The joints 420 can be formed via any suitable means, such as welding, brazing, adhesives, mechanical fasteners, etc.

In some embodiments, it the joints 420 can be located a sufficient distance from the strike face to avoid potential failures due to the severe impacts undergone by the golf club when striking a golf ball. For example, in some embodiments, the joints 420 can be spaced at least 20 mm, at least 30 mm, at least 40 mm, at least 50 mm, at least 60 mm, and/or from 20 mm to 70 mm rearward of a center face of the club head as measured along a y-axis (front-to-back direction).

Figure 41:
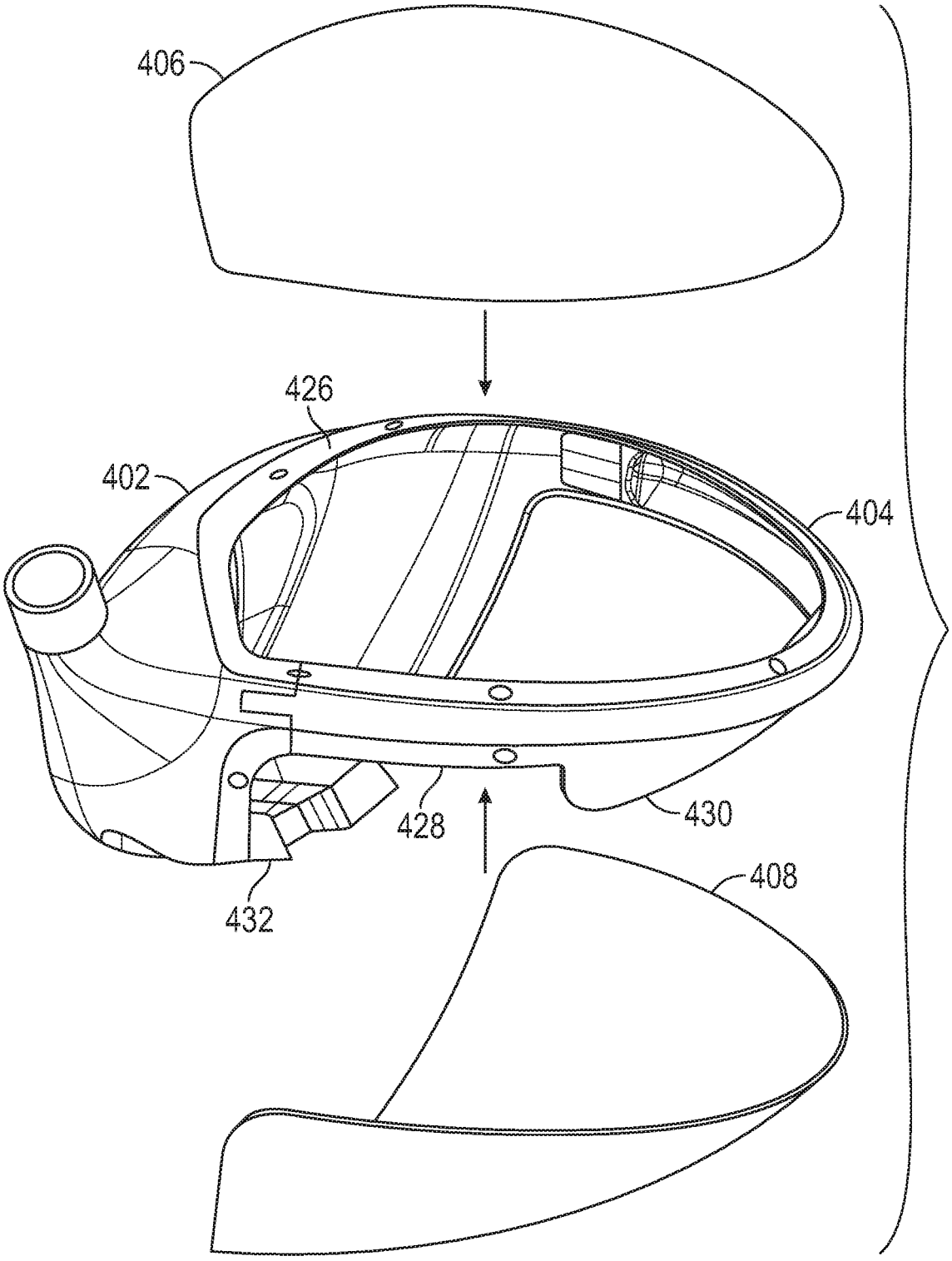
FIG. 41 shows how a crown insert and a sole insert are assembled with the body of FIG. 40.

FIG. 41 shows how the inserts 406 and 408 can be joined with the body to cover the crown opening and sole opening and enclose the internal cavity of the club head. The crown insert 406 can be coupled to a crown ledge 426 of the body extending around the crown opening, while the sole insert 408 can be coupled to a sole ledge 428 of the body extending around the sole opening. The ledges 426 and 428 can be formed from a combination of a both the cup 402 and the ring 404, with the cup including the forward portions of the ledges and the ring including the rear portions of the ledges. The ledges 426 and 428 can be offset inwardly from the surrounding outer surfaces, such that there is room to receive the inserts with the outer surfaces of the inserts being even or flush with the surrounding outer surfaces of the cup/ring body. The ring 404 can also include a projection 430 extending downwardly and forwardly from the rear of the ring and forming part of sole ledge 428 to help support the sole insert 408 and provide increased rigidity.

Figure 47:
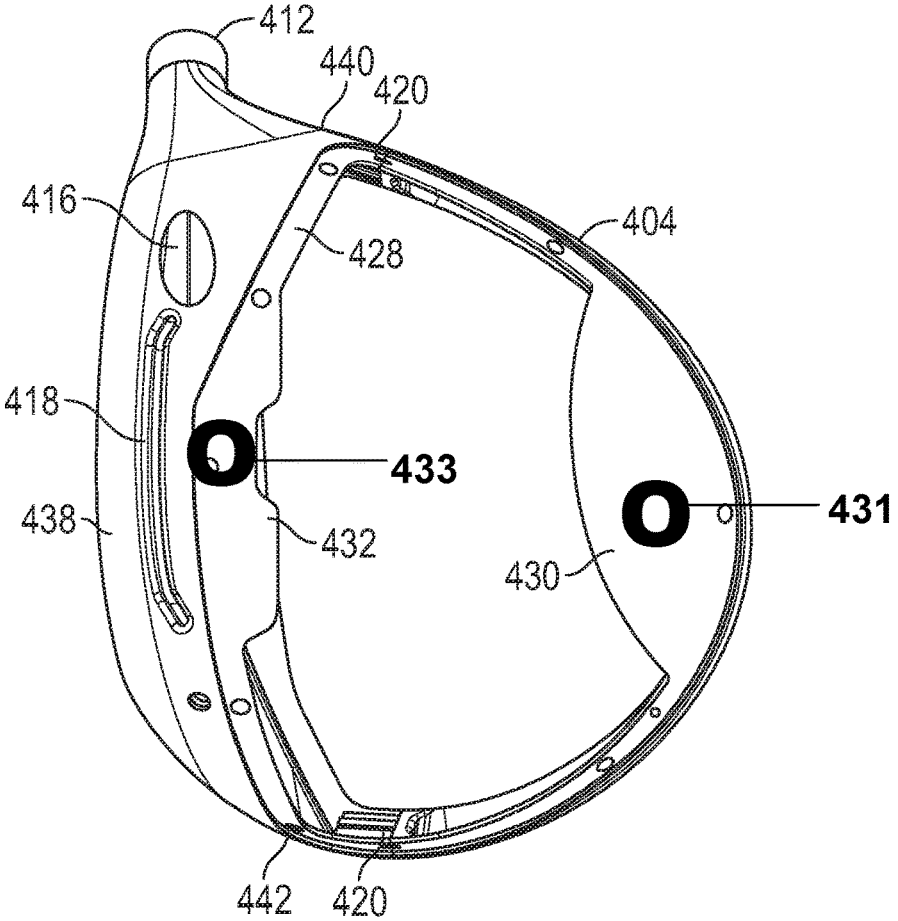
FIG. 47 is a bottom view of the body.

In some embodiments, the ring 404 can include a mass pad having increased thickness, such as in the projections 430 or elsewhere, to provide rear weighting for the golf club and move the center of mass rearward and increase MOI about the z and x axes. Such rear weighting can also be accomplished with an added weight member coupled to the rear ring, such as a removable, swappable, and/or adjustable weight member coupled to the rear part of the ring. For example, the projection 430 or other part of the ring 404 can include an opening, such as a threaded opening, a track, or other weight member receiving feature. FIG. 47 shows an example of two weight ports 431 and 433 that can receive such adjustable weight members. Two or more weight members can also be coupled to the rear ring at the same time. The mass pad or weight member(s) can comprise a relatively more dense material, such as tungsten or steel.

In some embodiments, the cup 402 can include a mass pad, such as the mass pad 432 shown in the drawings, at the bottom sole region to lower the center or mass and/or move the center of mass forward. In some embodiments, the cup 402 can include one or more added weight members coupled to the sole portion of the cup, such as in or near the mass pad 432 and/or rearward of the slot 418, such as one or more removable, swappable, and/or adjustable weight members coupled to the cup. For example, the mass pad 432 or other part of the cup 402 can include one or more openings, such as a threaded opening, a track, or other weight member receiving feature. Two or more weight members can also be coupled to the cup at the same time. The weight member(s) can comprise a relatively more dense material that the cast cup material, such as tungsten or steel. In some embodiments, the cup and the ring can have matching weight ports that can allow for swapping weight members between the rear ring locations and the lower cup locations, providing adjustability options to change the mass properties of the club head. In some such examples, a group of swappable weights can be provided with the club head, such as including a 1-3 g weight and a 8-15 g weight, which can be coupled to a weight port in the rear ring or to a weight port in the sole portion of the cup, which can allow for a higher MOI (heavier weight in rear) or lower spin (heavier weight in the low-forward location), or other combinations and mass properties.

Figure 44:
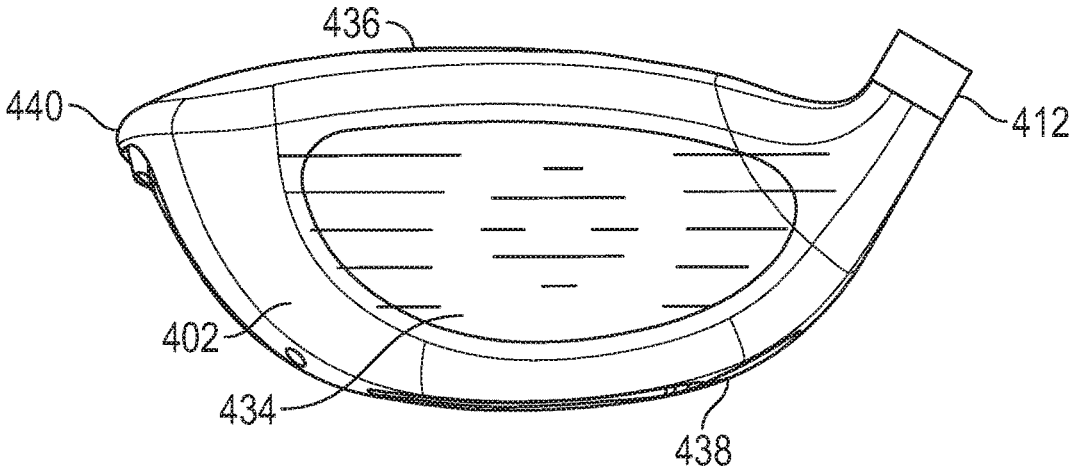
FIG. 44 is a front elevation view of the body.
Figure 45:
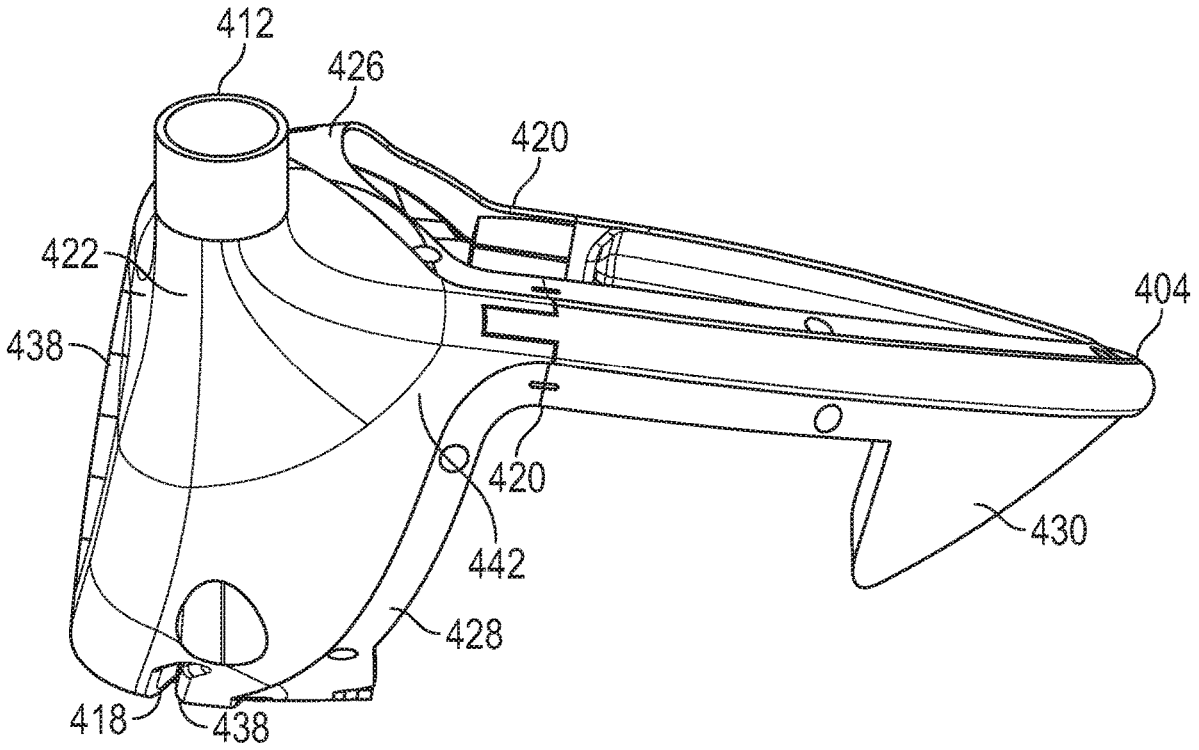
FIG. 45 is a heel side elevation view of the body.
Figure 46:
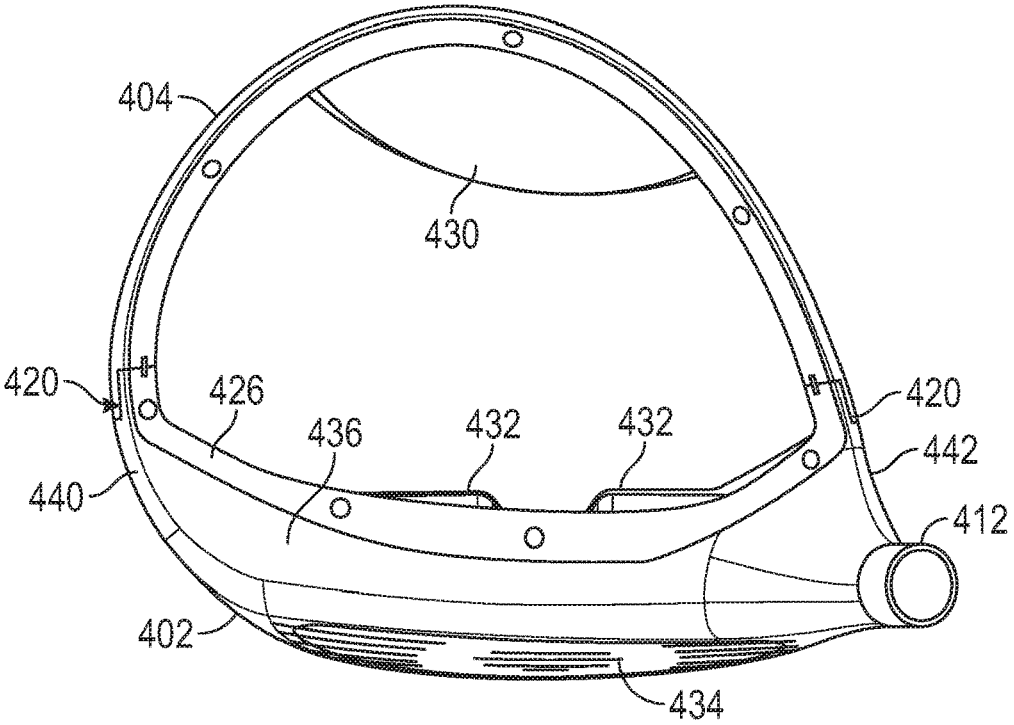
FIG. 46 is a top plan view of the body.

FIGS. 44-47 show the body formed by the joined cup 402 and 404 in more detail from several perspectives, without the inserts 406 and 408. FIG. 44 is a front elevation view, showing the integral face 434. FIG. 45 is a heel side view. FIG. 46 is a top view, showing a forward crown portion 436, forward toe portion 440, and forward heel portion 442 that are part of the cup 402, as well as the toe and heel joints 420 and the crown ledge 426 that receives the crown insert 406. FIG. 47 is a bottom view, showing a forward sole portion 438 that includes a sole slot 418 extending into the interior cavity of the club head, as well as the ledge 428 that receives the sole insert 408. Also shown in FIG. 47 are an exemplary rear weight port 431 located in the ring projection 430 and an exemplary sole weight port located in cup 402 rearward of the slot 418 in the region of the mass pad 433. In other embodiments, such weight ports can be located in other parts of the cup or ring, such as in the very rear of the ring, and there can be more than two of such weight ports. The weight ports can be threaded and can receive adjustable weight members, allowing for adjustability of the center of mass and MOI properties of the club head.

Figure 42:
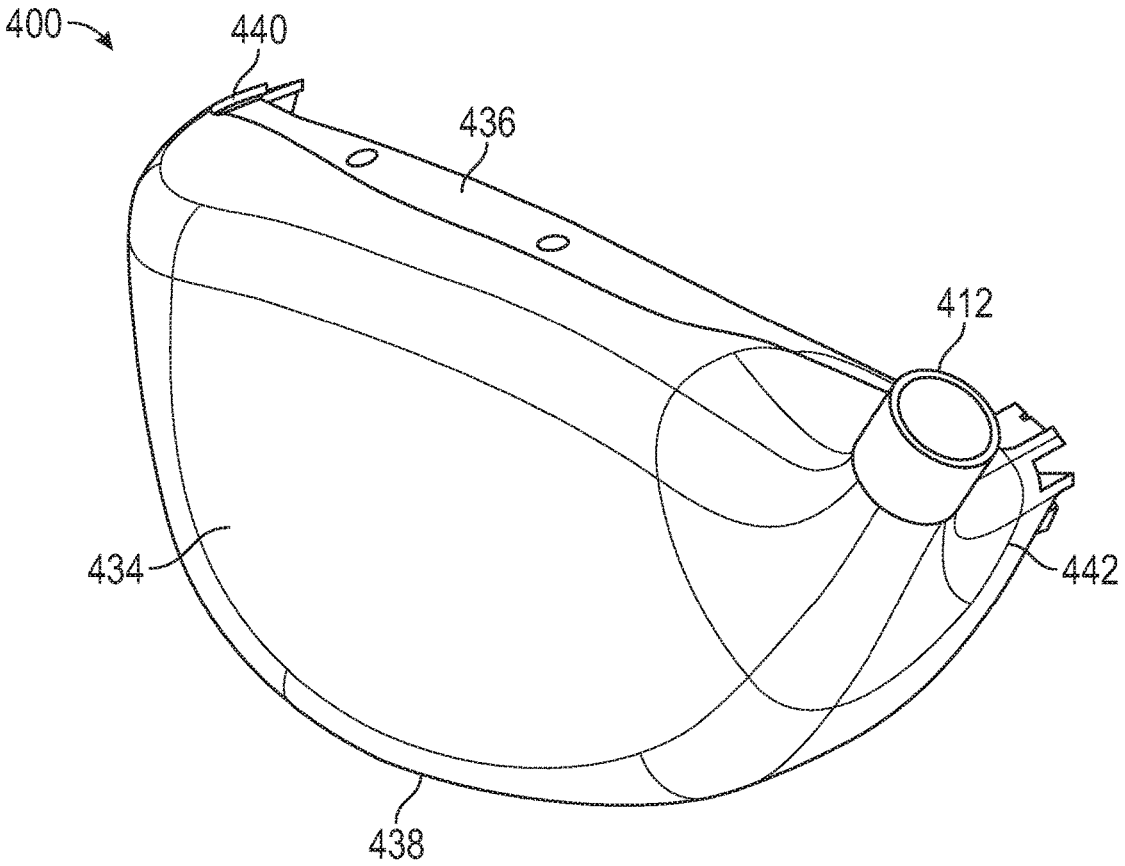
FIG. 42 shows the front of a cup face portion of the body.
Figure 43:
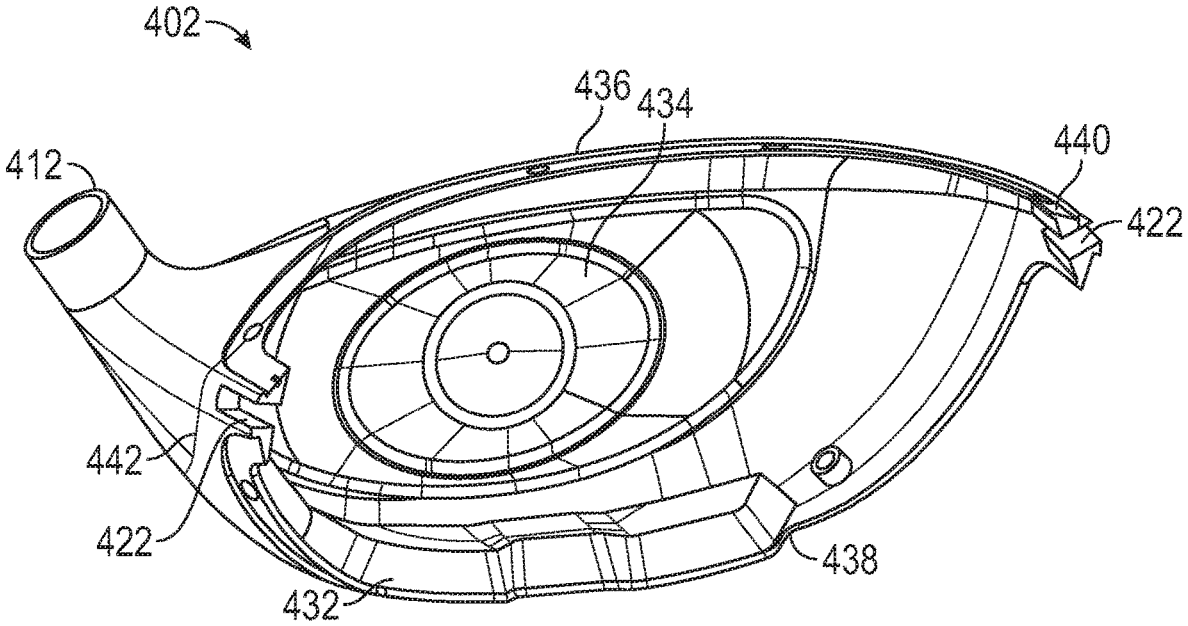
FIG. 43 shows the rear of the cup face portion of the body.

The cup 402 is illustrated in more detail in FIGS. 42 and 43. The rear surface of the face 434 is shown in FIG. 43. As described elsewhere herein, the rear of the face 434 can be formed having a variety of complex shapes and thickness profiles, and can be easily accessed from the rear for machining, etching, material removal, and/or other post-casting processing, before the ring 404 is attached to the cup 402. FIG. 43 also shows a mass pad 432 on sole portion 438 of the cup. The mass pad 432 can comprise a thickened portion of the sole having increased mass, which significantly affects the overall mass properties of the club head. The mass pad 432 can have a central notch with more mass to the toe side and heel side of the center, for enhanced mass and MOI properties. More information regarding the mass pad 432, alternative mass pads geometries and embodiments, and related properties can be found in U.S. Pub. 2018/0126228, published May 10, 2018, which is incorporated by referenced herein in its entirety.

Figure 48:
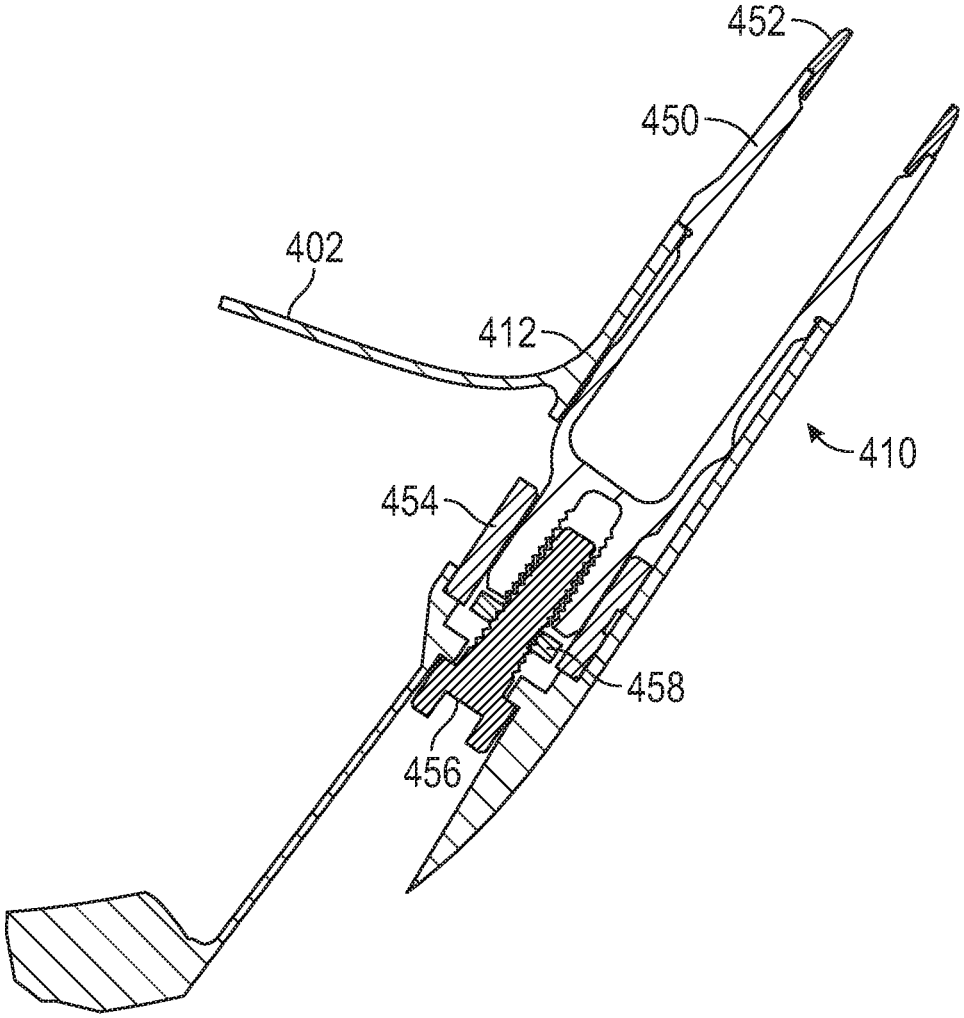
FIG. 48 is a cross-section view of the head-shaft connection assembly.

FIG. 48 illustrates the head-shaft connection assembly 410, which allows for the hosel 412 of head 400 to be coupled to a shaft in a plurality of selectable orientations, allowing for adjustment of loft angle, lie angle, and/or face angle of the assembled golf club in the normal address position. The assembly 410 can comprise various components, such as sleeve 450, ferrule 452, hosel insert 454, fastener 456, and washer 458 shown in FIG. 48. More information regarding adjustable head-shaft connection assemblies can be found in U.S. Pat. No. 9,033,821 issued May 19, 2015, which is incorporated by reference herein in its entirety.

Figure 49:
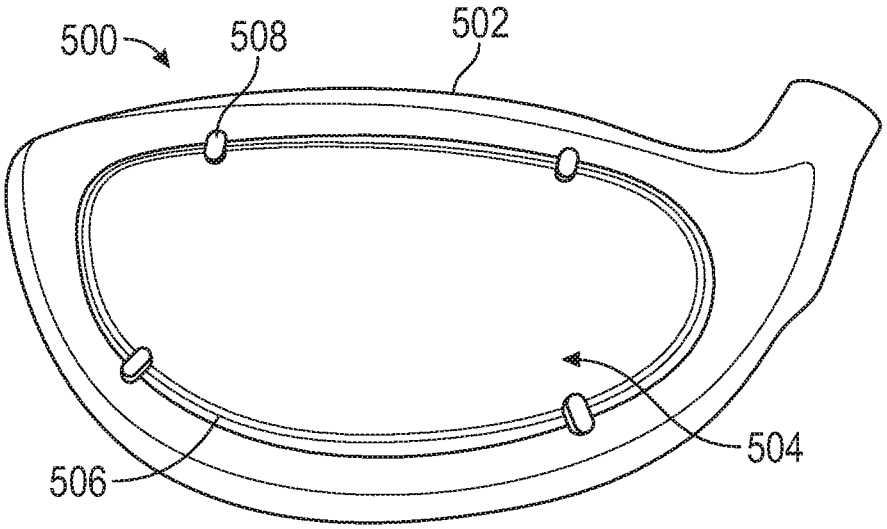
FIG. 49 illustrates a two-piece wax body with the wax face formed separately from the rest of the wax body.
Figure 50:
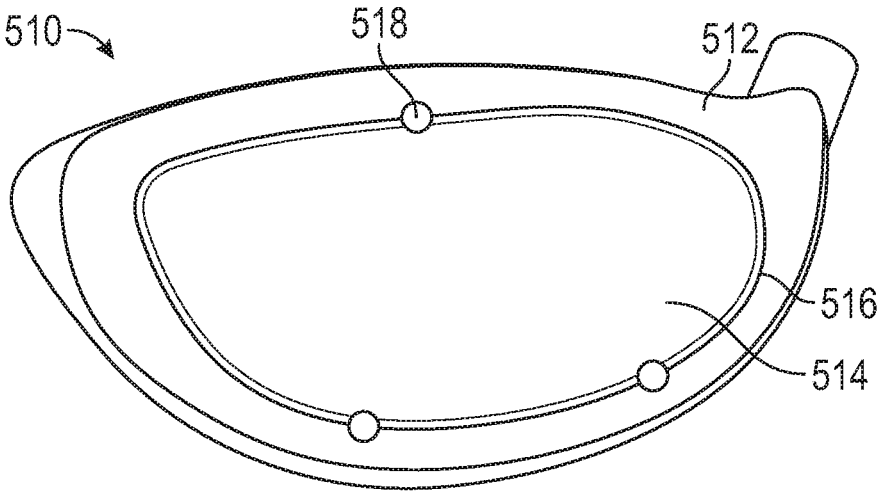
FIG. 50 shows the wax face wax welded to the rest of the wax body.

FIGS. 49 and 50 illustrate part of a method for manufacturing a golf club head, and in particular, part of a method for manufacturing a mold for casting the front cup 402 of club head 400. FIG. 49 shows a wax cup 500 that is a combination of a wax cup frame 502 and a wax face 504. The wax cup frame 502 and wax face 504 are formed separately, and then the wax face is placed into a slightly larger sized face opening in the wax cup frame 502. The two wax pieces can then be wax welded around their annular joint 506 by adding hot liquid wax into the joint and allowing it to cool and meld the face to the frame. The added hot wax fills the joint 506 and joins the wax cup frame 503 and wax face 504 into a single unitary wax cup 500. After the wax cools, excess wax can be removed from the front and rear of the weld joint 506. In some embodiments, the wax face 504 can include prongs 508 that extend radially outwardly and contact the front surface of the wax cup frame 502 to help set the depth of the wax face 504 relative to the wax cup frame, such that the front surfaces of the resultant wax cup 500 are even and smooth across the joint 506. The wax prongs 508 can be removed after the wax welding process.

FIG. 50 shows another example of a wax cup 510 form by wax welding together a wax cup frame 512 and a wax face 514 via added wax around joint 516, optionally using wax prongs 518 on the wax face to help set the depth of the wax face in the opening of the wax cup frame. In this example, the wax cup 510 includes an additional protrusion 520 that creates an additional gate in the resultant mold to help assist molten metal flowing evenly toward the face portion of the mold. Wax cups 500 and 510 also can include gate-creating portions in other locations, such as at the heel side near the hosel, as illustrated, in the rear side of the face, and/or at other locations.

Forming the wax cup from two separate wax pieces (as in FIGS. 49 and 50 for example) can facilitate creation of more intricate geometries for the wax cup and can facilitate forming several different geometry embodiments in a simplified and more rapid and cost effective manner. Starting with the two separate wax pieces causes the tooling and formation process for the wax frame to be disconnected from the tooling and formation process for the wax face. With regard to the wax cup 500, the same wax cup frame 502 (and same tooling) can be combined with any of several differently shaped wax faces 504 to create a corresponding number of different wax cups, meaning only the tooling for the wax face need be changed to produce a different wax cup. For example, a manufacturer can create two identical wax frames 502, and then can combine one wax frame with a first wax face, and can combine the second wax frame with a second wax face that has a different thickness profile than the first wax face. These two different wax cups and the resultant molds and end-product metal cups can then be measured, compared, tested, etc. See FIGS. 51-54 for various exemplary face thickness profiles, and the related discussion herein. Thus, using a two-part wax cup formation process can provide advantages in rapid prototyping and other manufacturing and development efficiencies.

Starting with two separate wax pieces also allows for efficiencies in forming large numbers of the wax pieces, as each wax piece is smaller and can be produced in greater numbers per batch on the same tree.

Once the wax cup (e.g., 500 or 510) is created, the wax cup can be used to form a mold for casting a metal cup (e.g., cup 402). The mold can comprise ceramic material and/or any other suitable material for casting a metal cup. Once the mold is formed around the wax cup, the wax can be melted and drained out of the mold. Various subsequent steps can then be applied to prepare the mold for casting, including adding gating and/or surface treatments to the mold. In addition, several cup molds can be combined into one mold tree for casting several metallic cups at the same time. After the mold is prepared, molten metal can then be introduced into the mold to cast the metal cup. The mold can then be opened/removed to access the cast metal cup. The cast metal cup can be formed of any suitable metal or metal alloy, including titanium alloys (any suitable metallic material disclosed herein can be used for the cast cup).

After the metal cup is cast, portions of the cast cup can be machined or modified to remove parts of the cast cup as desired. For one example, the front surface of the face portion of the cup can be machined to add horizontal score lines and/or to create a more precise texture, curvature, and twist. For another example, the rear surface of the face portion of the cup can be machined to modify the thickness profile across the height and width of the face portion, producing a desired variable thickness profile across the face portion. The front and/or rear surface of the face portion of the cast cup can also be machined or chemically etched (e.g., using hydrofluoric acid) to remove part or all of the alpha case layer formed during the casting process (e.g., for titanium alloys), such as to make the face portion less brittle and to increase durability of the face portion.

In anticipation of post-casting removal of material from the face portion of the cup, the face portion of the cup can be cast with extra thickness of material, such that a desired amount of material and a desired thickness profile is left after post-casting material removal.

As shown in FIGS. 39 and 40, and as discussed above, the cup 402 and ring 404 can be formed (e.g., cast) separately, and then combined together (e.g., welding, brazing, adhesive bonding, mechanical fasteners, etc.) at joints 420 to form a metallic club head body, which serves as a rigid frame that receives other components to form the golf club head 400. One advantage of this method of creating the club head body from a separate cup 402 and ring 404 is that the absence of the rear ring portion allows better access to the rear surface of the face portion of the cup 402 for post-casting machining, chemical etching, and/or other post-casting modifications to the rear surface of the face portion. For example, with the ring 404 not present, there is more room for a cutting tool, milling machine, CNC machine, drill bit, or other tool to access the entire rear surface of the face portion of the cup 402. After such post-casting modifications are performed on the cup 402, the ring 404 can be attached to the cup and the rest of the club head can be assembled.

Another advantage of casting the cup and the ring separately is that it allows for efficiencies in casting large numbers of each of the ring and cup pieces, as each cast piece is smaller than the combined body and can be produced in greater numbers per batch on the same tree. Also, the same ring piece can be used with various differently shaped cup pieces, so only the tooling for the cup piece need be changed to accommodate a change to the club head body or making several different variations of the club head with different cup/face geometries.

Figure 51:
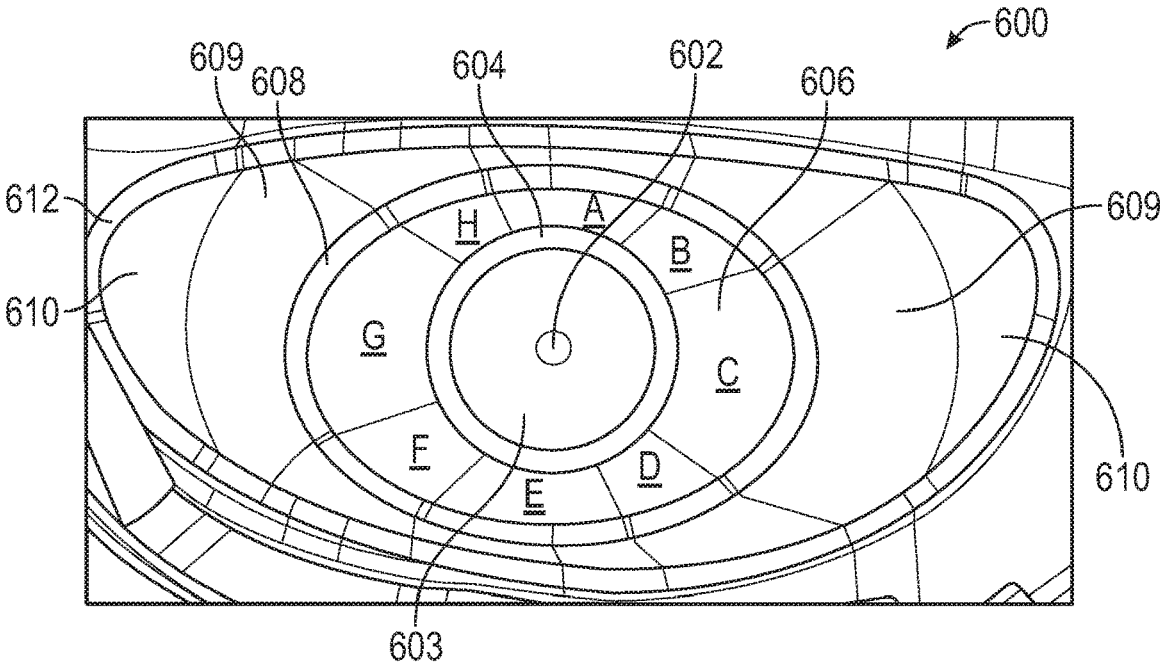
FIG. 51 shows a varying thickness profile on the rear side of the face.
Figure 52:
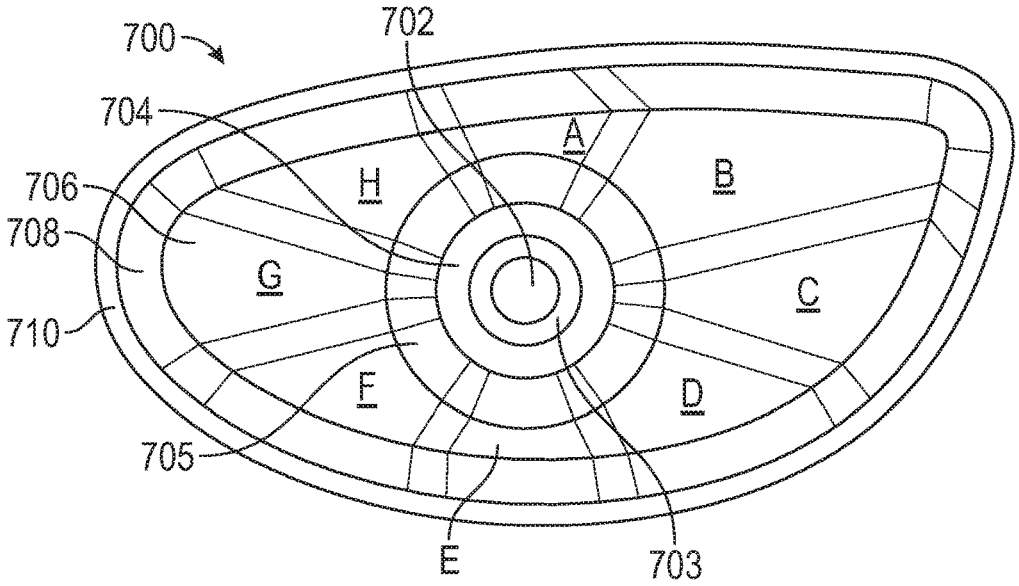
FIG. 52 shows another varying thickness profile on the rear side of a face.
Figure 53:
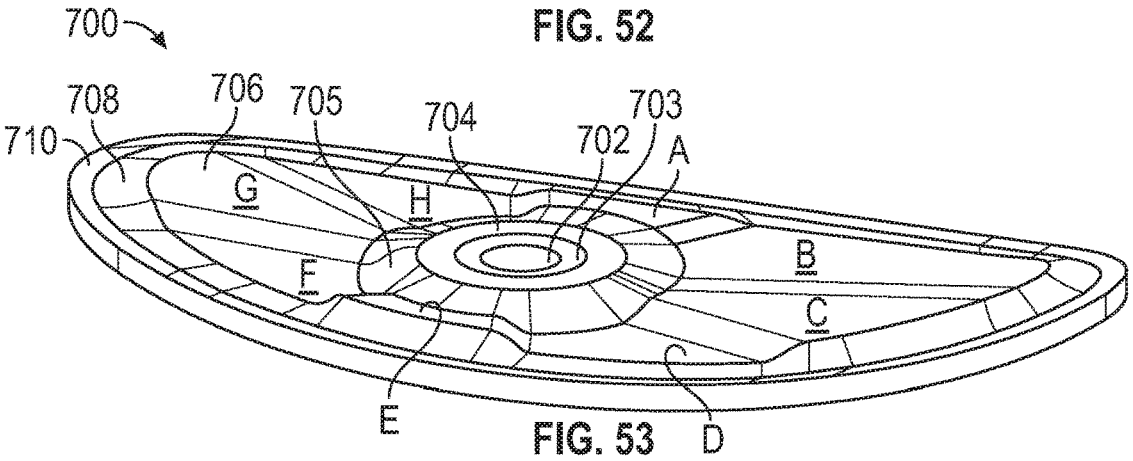
FIG. 53 is a perspective view of the face of FIG. 52.
Figure 54:
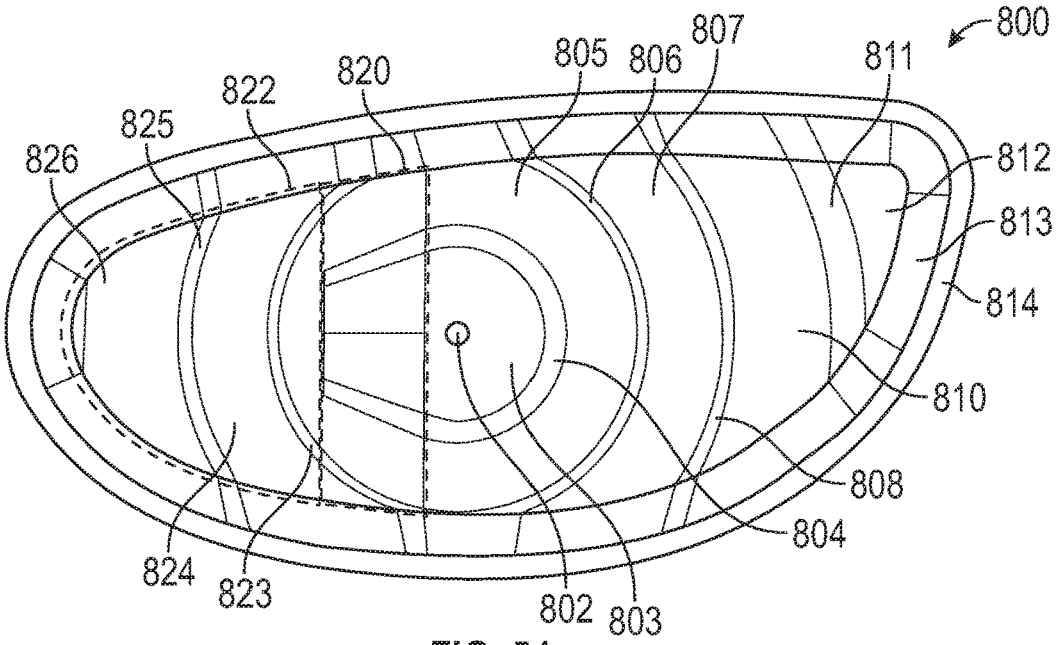
FIG. 54 shows another varying thickness profile that is offset to the heel side.

FIG. 51 illustrates an exemplary rear surface of a face portion of a cast cup 600, similar to the cup 402, as viewed from the rear with the hosel/heel to the left and the toe to the right. FIGS. 52 and 53 illustrate another exemplary face portion 700 having a variable thickness profile, and FIG. 54 illustrates yet another exemplary face portion 800 having a variable thickness profile. As a result of the casting process and optional post-casting modifications to the face portion, the face portion of the cast cup can have a great variety of novel thickness profiles. By casting the face into a desired geometry, rather than forming the face plate from a flat rolled sheet of metal in a traditional process, the face can be created with greater variety of geometries and can have different material properties, such as different grain direction and chemical impurity content, which can provide advantages for a golf performance and manufacturing.

In a traditional process, the face plate is formed from a flat sheet of metal having a uniform thickness. Such a sheet of metal is typically rolled along one axis to reduce the thickness to a certain uniform thickness across the sheet. This rolling process can impart a grain direction in the sheet that creates a different material properties in the rolling axis direction compared to the direction perpendicular to the rolling direction. This variation in material properties can be undesirable and can be avoided by using the disclosed casting methods instead to create face portion.

Furthermore, because a conventional face plate starts off as a flat sheet of uniform thickness, the thickness of the whole sheet has to be at least as great as the maximum thickness of the desired end product face plate, meaning much of the starting sheet material has to be removed and wasted, increasing material cost. By contrast, in the disclosed casting methods, the face portion is initially formed much closer to the final shape and mass, and much less material has to be removed and wasted. This saves time and cost.

Still further, in a conventional process, the initial flat sheet of metal has to be bent in a special process to impart a desired bulge and roll curvature to the face plate. Such a bending process is not needed when using the disclosed casting methods.

The unique thickness profiles illustrated in FIGS. 51-54 are made possible using the disclosed casting methods, and were previously not possible to achieve using the conventional process, wherein the sheet of metal having a uniform thickness is mounted in a lathe or similar machine and turned to produce a variable thickness profile across the rear of the face plate. In such a turning process, the imparted thickness profile must be symmetrical about the central turning axis, which limits the thickness profile to a composition of concentric circular ring shapes each having a uniform thickness at any given radius from the center point. In contrast, no such limitations are imposed using the disclosed casting methods, and more complex face geometries can be created.

By using the herein disclosed casting methods, large numbers of the disclosed club heads can be manufacture faster and more efficiently. For example, 50 or more of the cups 402 can be cast at the same time on a single casting tree, whereas it would take much longer and require more resources to create the novel face thickness profiles on face plates using a conventional milling methods using a lathe, one at a time.

In FIG. 51, the rear face surface of the cast cup 600 includes an non-symmetrical variable thickness profile, illustrating just one example of the wide variety of variable thickness profiles made possible using the disclosed casting methods. The center 602 of the face can have a center thickness, and the face thickness can gradually increase moving radially outwardly from the center across an inner blend zone 603 to a maximum thickness ring 604, which can be circular. The face thickness can gradually decrease moving radially outwardly from the maximum thickness ring 604 across an variable blend zone 606 to a second ring 608, which can be non-circular, such as elliptical. The face thickness can gradually decrease moving radially outwardly from the second ring 608 across an outer blend zone 609 to heel and toe zones 610 of constant thicknesses (e.g., minimum thickness of the face portion) and/or to a radial perimeter zone 612 defining the extent of the face portion where the face transitions to the rest of the cast cup 600.

The second ring 608 can itself have a variable thickness profile, such that the thickness of the second ring 608 varies as a function of the circumferential position around the center 602. Similarly, the variable blend zone 606 can have a thickness profile that varies as a function of the circumferential position around the center 602 and provides a transition in thickness from the maximum thickness ring 604 to the variable and less thicknesses of the second ring 608. For example, the variable blend zone 606 to a second ring 608 can be divided into eight sectors that are labeled A-H in FIG. 51, including top zone A, top-toe zone B, toe zone C, bottom-toe zone D, bottom zone E, bottom-heel zone F, heel zone G, and top-heel zone H. These eight zones can have differing angular widths as shown, or can each have the same angular width (e.g., one eighth of 360 degrees). Each of the eight zones can have its own thickness variance, each ranging from a common maximum thickness adjacent the ring 604 to a different minimum thickness at the second ring 608. For example, the second ring can be thicker in zones A and E, and thinner in zones C and G, with intermediate thicknesses in zones B, D, F, and H. In this example, the zones B, D, F, and H can vary in thickness both along a radial direction (thinning moving radially outwardly) and along a circumferential direction (thinning moving from zones A and E toward zones C and G).

One example of the cast cup 600 can have the following thicknesses: 3.1 mm at center 602, 3.3 mm at ring 604, the second ring 608 can vary from 2.8 mm in zone A to 2.2 mm in zone C to 2.4 mm in zone E to 2.0 mm in zone G, and 1.8 mm in the heel and toe zones 610.

FIGS. 52 and 53 show the rear face surface of another exemplary cast face portion 700 that includes a non-symmetrical variable thickness profile. The center 702 of the face can have a center thickness, and the face thickness can gradually increase moving radially outwardly from the center across an inner blend zone 703 to a maximum thickness ring 704, which can be circular. The face thickness can gradually decrease moving radially outwardly from the maximum thickness ring 704 across an variable blend zone 705 to an outer zone 706 comprised of a plurality of wedge shaped sectors A-H having varying thicknesses. As best shown in FIG. 53, sectors A, C, E, and G can be relatively thicker, while sectors B, D, F, and H can be relatively thinner. An outer blend zone 708 surrounding the outer zone 706 transitions in thickness from the variable sectors down to a perimeter ring 710 having a relatively small yet constant thickness. The outer zone 706 can also include blend zones between each of the sectors A-H that gradually transition in thickness from one sector to an adjacent sector.

One example of the face portion 700 can have the following thicknesses: 3.9 mm at center 702, 4.05 mm at ring 704, 3.6 mm in zone A, 3.2 mm in zone B, 3.25 mm in zone C, 2.05 mm in zone D, 3.35 mm in zone E, 2.05 mm in zone F, 3.00 mm in zone G, 2.65 mm in zone H, and 1.9 mm at perimeter ring 710.

FIG. 54 shows the rear face of another exemplary cast face portion 800 that includes a non-symmetrical variable thickness profile having a targeted thickness offset toward the heel side (left side). The center 802 of the face has a center thickness, and to the toe/top/bottom the thickness gradually increases across an inner blend zone 803 to inner ring 804 having a greater thickness that at the center. The thickness then decreases moving radially outwardly across a second blend zone 805 to a second ring 806 having a thickness less than that of the inner ring 804. The thickness then decreases moving radially outwardly across a third blend zone 807 to a third ring 808 having a thickness less than that of the second ring 806. The thickness then decreases moving radially outwardly across a fourth blend zone 810 to a fourth ring 811 having a thickness less than that of the third ring 808. A toe end zone 812 blends across an outer blend zone 813 to an outer perimeter 814 having a relatively small thickness.

To the heel side, the thicknesses are offset by set amount (e.g., 0.15 mm) to be slightly thicker relative to their counterpart areas on the toe side. A thickening zone 820 (dashed lines) provides a transition where all thicknesses gradually step up toward the thicker offset zone 822 (dashed lines) at the heel side. In the offset zone 822, the ring 823 is thicker than the ring 806 on the heel side by a set amount (e.g., 0.15 mm), and the ring 825 is thicker that the ring 808 by the same set amount. Blend zones 824 and 826 gradually decrease in thickness moving radially outwardly, and are each thicker than their counterpart blend zones 807 and 810 on the toe side. In the thickening zone 820, the inner ring 804 gradually increases in thickness moving toward the heel.

One example of the face portion 800 can have the following thicknesses: 3.8 mm at the center 802, 4.0 mm at the inner ring 804 and thickening to 4.15 mm across the thickening zone 820, 3.5 mm at the second ring 806 and 3.65 mm at the ring 823, 2.4 mm at the third ring 808 and 2.55 mm at the ring 825, 2.0 mm at the fourth ring 811, and 1.8 mm at the perimeter ring 814.

The targeted offset thickness profile shown in FIG. 54 can help provide a desirable characteristic time (CT) profile across the face. Thickening the heel side can help avoid having a CT spike at the heel side of the face, for example, which can help avoid having a non-conforming CT profile across the face. Such an offset thickness profile can similarly be applied to the toe side of the face, or to both the toe side and the heel side of the face to avoid CT spikes at both the heel and toe sides of the face. In other embodiments, an offset thickness profile can be applied to the upper side of the face and/or toward the bottom side of the face.

Various other varying face thickness profiles can be produced using the disclosed methods, including those disclosed in U.S. patent application Ser. No. 12/006,060 and U.S. Pat. Nos. 6,997,820; 6,800,038; 6,824,475; 7,731,603; 8,801,541; 9,943,743; and 9,975,018; the entire contents of each of which are incorporated herein by reference in their entireties. For example, U.S. Pat. No. 9,975,018 discloses examples of striking faces that include a localized stiffened region, such as an inverted cone or 'donut' shaped thickness profile that is offset from the center of the face, which alters the launch conditions of golf balls struck by the club head in a way that wholly or partially compensates for, overcomes, or prevents the occurrence of a rightward/leftward deviation. In particular, the localized stiffened region is located on the striking face such that a golf ball struck under typical conditions will not impart a left-tending and/or right-tending sidespin to the golf ball.

All of the disclosed face thickness profiles can be made possible by the casting methods disclosed herein. Such configurations would not be possible using a conventional turning process of removing material in concentric circle patterns from the rear of an originally flat face plate.

In some golf club head embodiments, the face plate can be cast individually, and then welded into a front opening in the frame of the club head. When a face plate is welded to the front opening of frame, extra material is typically produces around the weld zone, and this extra material has to be removed after the welding process to smooth out the transition between the face plate and the frame. This process can be avoided by casting the entire cup, including the face and the frontal frame, as a single cast unit, as disclosed herein.

Figure 55:
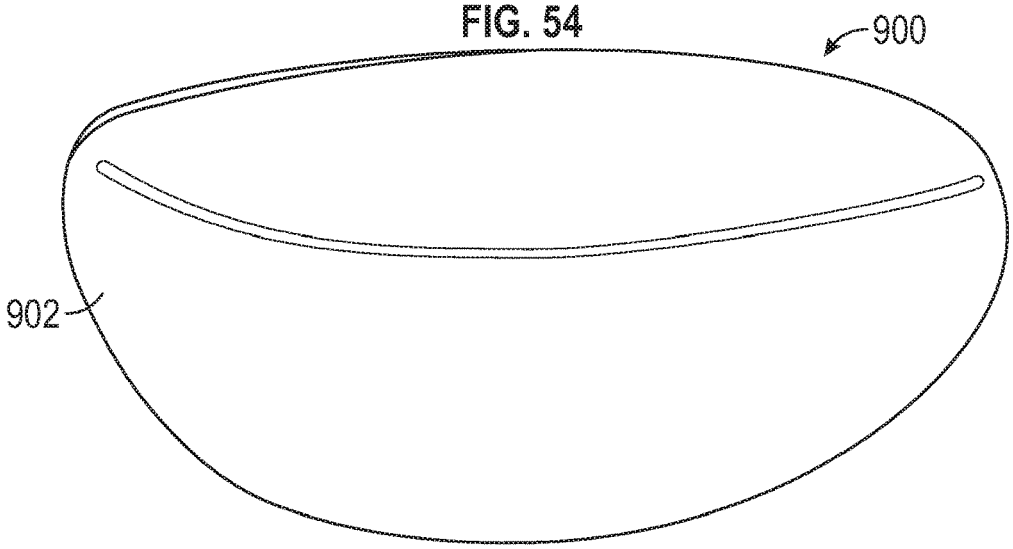
FIG. 55 shows the front side of an exemplary cast face plate.
Figure 56:
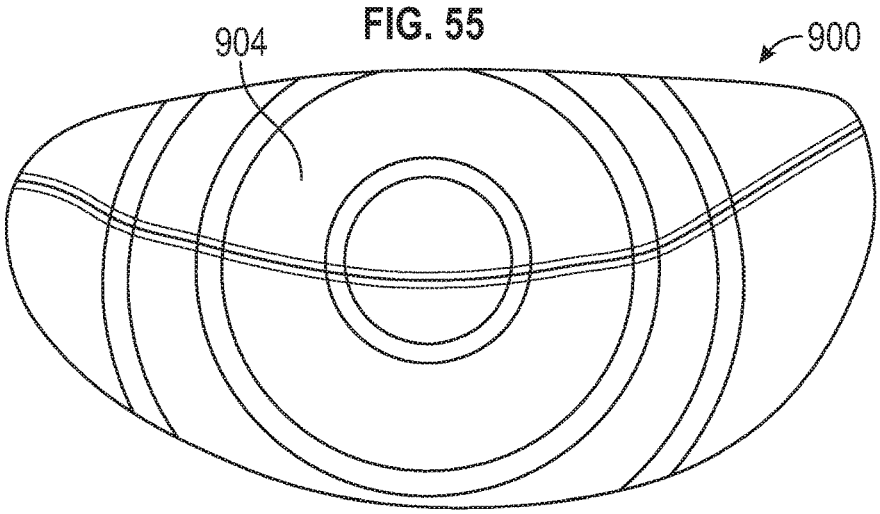
FIG. 56 shows the rear side of the cast face plate of FIG. 55.

However, casting the face plate separately can provide advantages over casting the entire cup as a unit. For example, post-processing of the cast face plate is much easier compared to post-processing the face surfaces when it is part of a cup. FIGS. 55 and 56 show the front 902 and rear 904 of an exemplary cast face plate 900. In particular, it is much easier to access to the all parts of the rear surface of a cast face plate compared to the rear face surface of a cast cup. There is unlimited room to approach the cast face plate with tooling for any desired post-casting process because there are no parts of the sole, crown, toe, heel, hosel, etc., to get in the way. Also, a cast face plate can be cast closer to the exact final shape of the face plate such that less material has to be removed and less work is required to modify the face after casting. For example, a face plate can be cast with less than 0.5 mm, less than 0.4 mm, less than 0.3 mm, and/or less than 0.2 mm of excess material on each side of the face to be removed after casting. This equates to less wasted material removed compared to machining a face plate from a flat sheet of rolled metal. The front surface of the cast face can be machined to remove some or all of the alpha case layer, achieve a precise bulge, roll, and twist curvature, and/or add scorelines. The rear of the cast face can be machined to remove part or all of the alpha case layer and/or to achieve a precise variable thickness profile across the face. As described elsewhere herein, the casting process allows for much more intricate and asymmetric thickness profiles, as opposed to the required 360 degree concentric circle symmetry required by the conventional face sheet turning process.

Golf club heads that are cast including the face as an integral part of the body (e.g., cast at the same time as a single cast object) can provide superior structural properties compared to club heads where the face is formed separately and later attached (e.g., welded or bolted) to a front opening in the club head body. However, the advantages of having an integrally cast Ti face are mitigated by the need to remove the alpha case on the surface of cast Ti faces.

With the herein disclosed club heads comprising an integrally cast titanium alloy face and body unit (e.g., cast cup), the drawback of having to remove the alpha case can be eliminated, or at least substantially reduced. For a cast 9-1-1 Ti face, using a mold pre-heat temperature of 1000 C or more, the thickness of the alpha case can be about 0.10 mm or less, 0.15 mm or less, or about 0.20 mm or less, or about 0.30 mm or less, such as between 0.10 mm and 0.30 mm in some embodiments, whereas for a cast 6-4 Ti face the thickness of the alpha case can be greater than 0.10 mm, greater than 0.15 mm, or greater than 0.20 mm, or greater than 0.30 mm, such as from about 0.25 mm to about 0.30 mm in some examples. In some embodiments, the alpha case thickness can be as low as 0.1 mm and up to 0.15 mm while providing sufficiently durable products that have a desirably high CT time across the face. In some embodiments, the alpha case on the rear of the face at the geometric center of the face can have a thickness less than 0.30 mm and/or less than 0.20 mm, and this can be accomplished without chemically etching the surface after formation.

Other titanium alloys that can be used to form any of the striking faces and/or club heads described herein can comprise titanium, aluminum, molybdenum, chromium, vanadium, and/or iron. For example, in one representative embodiment the alloy may be an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti (one example is sometimes referred to as "1300" titanium alloy).

In another representative embodiment, the alloy may comprise 6.75% to 9.75% Al by weight, 0.75% to 3.25% or 2.75% Mo by weight, 1.0% to 3.0% Cr by weight, 0.25% to 1.75% V by weight, and/or 0.25% to 1% Fe by weight, with the balance comprising Ti.

In another representative embodiment, the alloy may comprise 7% to 9% Al by weight, 1.75% to 3.25% Mo by weight, 1.25% to 2.75% Cr by weight, 0.5% to 1.5% V by weight, and/or 0.25% to 0.75% Fe by weight, with the balance comprising Ti.

In another representative embodiment, the alloy may comprise 7.5% to 8.5% Al by weight, 2.0% to 3.0% Mo by weight, 1.5% to 2.5% Cr by weight, 0.75% to 1.25% V by weight, and/or 0.375% to 0.625% Fe by weight, with the balance comprising Ti.

In another representative embodiment, the alloy may comprise 8% Al by weight, 2.5% Mo by weight, 2% Cr by weight, 1% V by weight, and/or 0.5% Fe by weight, with the balance comprising Ti. Such titanium alloys can have the formula Ti-8Al-2.5Mo-2Cr-1V-0.5Fe. As used herein, reference to "Ti-8Al-2.5Mo-2Cr-1V-0.5Fe" refers to a titanium alloy including the referenced elements in any of the proportions given above. Certain embodiments may also comprise trace quantities of K, Mn, and/or Zr, and/or various impurities.

Ti-8Al-2.5Mo-2Cr-1V-0.5Fe can have minimum mechanical properties of 1150 MPa yield strength, 1180 MPa ultimate tensile strength, and 8% elongation. These minimum properties can be significantly superior to other cast titanium alloys, including 6-4 Ti and 9-1-1 Ti, which can have the minimum mechanical properties noted above. In some embodiments, Ti-8Al-2.5Mo-2Cr-1V-0.5Fe can have a tensile strength of from about 1180 MPa to about 1460 MPa, a yield strength of from about 1150 MPa to about 1415 MPa, an elongation of from about 8% to about 12%, a modulus of elasticity of about 110 GPa, a density of about 4.45 g/cm$^3$, and a hardness of about 43 on the Rockwell C scale (43 HRC). In particular embodiments, the Ti-8Al-2.5Mo-2Cr-1V-0.5Fe alloy can have a tensile strength of about 1320 MPa, a yield strength of about 1284 MPa, and an elongation of about 10%.

In some embodiments, striking faces and/or cups with a face portion can be cast from Ti-8Al-2.5Mo-2Cr-1V-0.5Fe. In some embodiments, striking surfaces and club head bodies can be integrally formed or cast together from Ti-8Al-2.5Mo-2Cr-1V-0.5Fe, depending upon the particular characteristics desired.

The mechanical parameters of Ti-8Al-2.5Mo-2Cr-1V-0.5Fe given above can provide surprisingly superior performance compared to other existing titanium alloys. For example, due to the relatively high tensile strength of Ti-8Al-2.5Mo-2Cr-1V-0.5Fe, cast striking faces comprising this alloy can exhibit less deflection per unit thickness compared to other alloys when striking a golf ball. This can be especially beneficial for metalwood-type clubs configured for striking a ball at high speed, as the higher tensile strength of Ti-8Al-2.5Mo-2Cr-1V-0.5Fe results in less deflection of the striking face, and reduces the tendency of the striking face to flatten with repeated use. This allows the striking face to retain its original bulge, roll, and "twist" dimensions over prolonged use, including by advanced and/or professional golfers who tend to strike the ball at particularly high club velocities.

Any of the herein disclosed embodiments can include face portion that has a striking surface that is twisted such that an upper toe portion of the striking surface is more open than a lower toe portion of the striking surface, and such that a lower heel portion of the striking surface is more closed than an upper heel portion of the striking surface. More information regarding golf club heads with twisted striking surfaces can be found in U.S. Pat. No. 9,814,944; U.S. Provisional Patent Application No. 62/687,143 filed Jun. 19, 2018; U.S. patent application Ser. No. 16/160,884 filed Oct. 15, 2018; all of which are herein incorporated by reference in there entireties. Any of these twisted face technologies disclosed in these incorporated references can be implemented in the herein disclosed club heads, in any combination with the herein disclosed technologies.

The herein disclosed technology can be implemented for any type of golf club head, not just the examples disclosed, including drivers, fairways, rescues, hybrids, utility clubs, irons, wedges, and putters.

For purposes of this description, certain aspects, advantages, and novel features of the embodiments of this disclosure are described herein. The disclosed methods, apparatus, and systems should not be construed as being limiting in any way. Instead, the present disclosure is directed toward all novel and nonobvious features and aspects of the various disclosed embodiments, alone and in various combinations and sub-combinations with one another. The methods, apparatus, and systems are not limited to any specific aspect or feature or combination thereof, nor do the disclosed embodiments require that any one or more specific advantages be present or problems be solved.

Although the operations of some of the disclosed embodiments are described in a particular, sequential order for convenient presentation, it should be understood that this manner of description encompasses rearrangement, unless a particular ordering is required by specific language set forth herein. For example, operations described sequentially may in some cases be rearranged or performed concurrently.

Moreover, for the sake of simplicity, the attached figures may not show the various ways in which the disclosed methods can be used in conjunction with other methods.

As used in this application and in the claims, the singular forms "a," "an," and "the" include the plural forms unless the context clearly dictates otherwise. Additionally, the term "includes" means "comprises." Further, the terms "coupled" and "associated" generally mean electrically, electromagnetically, and/or physically (e.g., mechanically or chemically) coupled or linked and does not exclude the presence of intermediate elements between the coupled or associated items absent specific contrary language.

In some examples, values, procedures, or apparatus may be referred to as "lowest," "best," "minimum," or the like. It will be appreciated that such descriptions are intended to indicate that a selection among many alternatives can be made, and such selections need not be better, smaller, or otherwise preferable to other selections.

In the description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

In view of the many possible embodiments to which the principles of the disclosure may be applied, it should be recognized that the illustrated embodiments are only preferred examples and should not be taken as limiting the scope of the disclosure. It will be evident that various modifications may be made thereto without departing from the broader spirit and scope of the disclosure as set forth. The specification and drawings are, accordingly, to be regarded in an illustrative sense rather than a restrictive sense. Accordingly, the scope of the disclosure is at least as broad as the following claims. We therefore claim all that comes within the scope of these claims.

The invention claimed is:

1. A fairway wood type golf club head comprising:

a metallic cast cup comprising a forward portion of the club head, including a hosel, a striking face, a forward portion of a crown, a forward portion of a sole, and a forward portion of a crown opening defined by a forward crown opening recessed ledge of the metallic cast cup;

a metallic rear ring formed separately from the cast cup and coupled to heel and toe portions of the metallic cast cup to form a club head body, wherein the metallic rear ring fully encloses the sole and includes a rearward portion of a crown opening defined by a rearward crown opening recessed ledge of the metallic rear ring; and a composite crown insert encloses the crown opening and is coupled to the forward crown opening recessed ledge and the rearward crown opening recessed ledge;

wherein a length from leading edge of the club head to a trailing edge of the club head is 73-97 mm;

wherein the metallic rear ring comprises steel and the metallic cast cup comprises a titanium alloy;

wherein the metallic cast cup comprises a mass pad formed in the forward portion of the sole of the metallic cast cup;

wherein the metallic cast cup further comprises toe and heel male projections and the metallic rear ring further comprises toe and heel female notches, wherein the toe and heel male projections mate with corresponding ones of the toe and heel female notches to couple the metallic cast cup to the metallic rear ring; or the metallic cast cup further comprises toe and heel female notches and the metallic rear ring further comprises toe and heel male projections, wherein the toe and heel male projections mate with corresponding ones of the toe and heel female notches to couple the metallic rear ring to the metallic cast cup;

wherein the golf club head has a volume from 120 cc to 300 cc and the club head has a total mass from 115 g to 260 g; and wherein the striking face has a loft angle of 13-26 degrees.

2. The club head of claim 1, wherein the cast cup is composed entirely of a titanium alloy.

3. The club head of claim 1, wherein the cast cup comprises a titanium alloy including 6.75% to 9.75% aluminum by weight and 0.75% to 3.25% molybdenum by weight.

4. The club head of claim 1, wherein the cast cup further comprises a slot in the forward portion of the sole.

5. The club head of claim 1, wherein the rear ring forms a skirt portion of the club head defining an outermost perimeter around a rear of the club head.

6. The club head of claim 1, wherein the striking face of the cast cup is twisted such that an upper toe portion of the striking face is more open than a lower toe portion of the striking face, and such that a lower heel portion of the striking face is more closed than an upper heel portion of the striking face.

7. The club head of claim 1, wherein the striking face comprises an asymmetric variable face thickness profile.

8. The club head of claim 1, wherein a rear surface of the striking face comprises a surface pattern that is asymmetric about a center point of the striking face.

9. The club head of claim 8, wherein the surface pattern comprises variable thickness profile that is offset toward a toe side or heel side of the striking face.

10. The club head of claim 1, further comprising an adjustable head-shaft connection assembly coupled to the hosel.

11. The club head of claim 1, further comprising a forward weight port and rearward weight port each configured to receive one or more adjustable weight members.

12. A fairway wood type golf club head comprising:

a metallic cast cup comprising a forward portion of the club head, including a hosel, a striking face, a forward portion of a crown, a forward portion of a sole, a forward portion of a crown opening defined by a forward crown opening recessed ledge of the metallic cast cup, and a forward portion of a sole opening defined by a forward sole opening recessed ledge of the metallic cast cup;

a metallic rear ring formed separately from the cast cup and coupled to heel and toe portions of the metallic cast cup to form a club head body, wherein the metallic rear ring including a rearward portion of a crown opening defined by a rearward crown opening recessed ledge of the metallic rear ring, and a rearward portion of a sole opening defined by a rearward sole opening recessed ledge of the metallic rear ring;

a metallic sole plate encloses the sole opening and is coupled to the forward sole opening recessed ledge and the rearward sole opening recessed ledge; and a composite crown insert encloses the crown opening and is coupled to the forward crown opening recessed ledge and the rearward crown opening recessed ledge;

wherein a length from leading edge of the club head to a trailing edge of the club head is 73-97 mm;

wherein the metallic rear ring comprises aluminum and the metallic cast cup comprises a titanium alloy;

wherein the metallic cast cup comprises a mass pad formed in the forward portion of the sole of the metallic cast cup;

wherein the metallic cast cup further comprises toe and heel male projections and the metallic rear ring further comprises toe and heel female notches, wherein the toe and heel male projections mate with corresponding ones of the toe and heel female notches to couple the metallic cast cup to the metallic rear ring; or the metallic cast cup further comprises toe and heel female notches and the metallic rear ring further comprises toe and heel male projections, wherein the toe and heel male projections mate with corresponding ones of the toe and heel female notches to couple the metallic rear ring to the metallic cast cup;

wherein the golf club head has a volume from 120 cc to 300 cc and the club head has a total mass from 115 g to 260 g; and wherein the striking face has a loft angle of 13-26 degrees.

13. The club head of claim 12, further comprising an adjustable head-shaft connection assembly coupled to the hosel.

14. The club head of claim 12, further comprising a forward weight port and rearward weight port each configured to receive one or more adjustable weight members.

15. A fairway wood type golf club head comprising:

a metallic cast cup comprising a forward portion of the club head, including a hosel, a striking face, a forward portion of a crown, a forward portion of a sole, a forward portion of a crown opening defined by a forward crown opening recessed ledge of the metallic cast cup, and a forward portion of a sole opening defined by a forward sole opening recessed ledge of the metallic cast cup;

a metallic rear ring formed separately from the cast cup and coupled to heel and toe portions of the metallic cast cup to form a club head body, wherein the metallic rear ring including a rearward portion of a crown opening defined by a rearward crown opening recessed ledge of the metallic rear ring, and a rearward portion of a sole opening defined by a rearward sole opening recessed ledge of the metallic rear ring;

a metallic sole plate encloses the sole opening and is coupled to the forward sole opening recessed ledge and the rearward sole opening recessed ledge; and a composite crown insert encloses the crown opening and is coupled to the forward crown opening recessed ledge and the rearward crown opening recessed ledge;

wherein a length from leading edge of the club head to a trailing edge of the club head is 73-97 mm;

wherein the metallic rear ring comprises a titanium alloy and the metallic cast cup comprises a titanium alloy;

wherein the metallic cast cup comprises a mass pad formed in the forward portion of the sole of the metallic cast cup;

wherein the metallic cast cup further comprises toe and heel male projections and the metallic rear ring further comprises toe and heel female notches, wherein the toe and heel male projections mate with corresponding ones of the toe and heel female notches to couple the metallic cast cup to the metallic rear ring; or the metallic cast cup further comprises toe and heel female notches and the metallic rear ring further comprises toe and heel male projections, wherein the toe and heel male projections mate with corresponding ones of the toe and heel female notches to couple the metallic rear ring to the metallic cast cup;

wherein the golf club head has a volume from 120 cc to 300 cc and the club head has a total mass from 115 g to 260 g; and wherein the striking face has a loft angle of 13-26 degrees.

16. The club head of claim 15, wherein the rear ring is welded to a heel portion and a toe portion of the cast cup.

17. The club head of claim 15, further comprising an adjustable head-shaft connection assembly coupled to the hosel.

18. The club head of claim 15, further comprising a forward weight port and a rearward weight port each configured to receive one or more adjustable weight members.

* * * * *